US010000935B2

(12) United States Patent
Kell

(10) Patent No.: US 10,000,935 B2
(45) **Date of Patent: *Jun. 19, 2018**

(54) VERTICAL JOINT SYSTEM AND ASSOCIATED SURFACE COVERING SYSTEM

(71) Applicant: Inotec Global Limited, Hong Kong (HK)

(72) Inventor: Richard William Kell, North Beach (AU)

(73) Assignee: Inotec Global Limited, Hong Kong (HK)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/813,684

(22) Filed: Jul. 30, 2015

(65) Prior Publication Data

US 2015/0368910 A1 Dec. 24, 2015

Related U.S. Application Data

(63) Continuation of application No. 14/202,260, filed on Mar. 10, 2014, now Pat. No. 9,103,126, which is a (Continued)

(30) Foreign Application Priority Data

Mar. 18, 2011 (AU) ..... 2011900987
May 24, 2011 (AU) ..... 2011902017
(Continued)

(51) Int. Cl.
*E04F 15/02* (2006.01)
*E04F 15/08* (2006.01)
(Continued)

(52) U.S. Cl.
CPC ..... *E04F 15/02038* (2013.01); *E04F 13/26* (2013.01); *E04F 15/02011* (2013.01);
(Continued)

(58) Field of Classification Search
CPC ..... E04F 15/02011; E04F 15/107; E04F 15/02038; E04F 15/0215; E04F 15/10;
(Continued)

(56) References Cited

U.S. PATENT DOCUMENTS 714,987 A 12/1902 Wolfe ..... 52/578
2,004,193 A 6/1935 Cherry ..... 52/506.1
(Continued)

FOREIGN PATENT DOCUMENTS

BE 765817 A2 9/1971
CA 991373 A1 6/1976
(Continued)

*Primary Examiner* — Charles A Fox
*Assistant Examiner* — Joseph J. Sadlon
(74) *Attorney, Agent, or Firm* — Sunstein, Kann, Murphy & Timbers LLP

(57) ABSTRACT

A vertical joint system 10 for substrates 12 is formed with joints Jm and Jf which engaged by relative motion in a direction perpendicular to major surfaces 14 and 16 of the substrate 12. The joints are configured to enable relative rotation of up to 3 degrees (i.e. clockwise or anticlockwise) while maintaining engagement of the joints. The joints Jm and Jf are further configured to form two locking planes 18, 20 one on each of the inner and outer most sides of the joint. Engagement about the locking planes 18, 20 is provided by transverse outward extending surfaces Cm1, Cm2, Cf1 and Cf2. The surface Cf1 and Cf2 overhang the surfaces Cm1 and Cm2. At least one surface in each pair of engaging surfaces: Cf1 and Cm1; and, Cf2 and Cm2 is smoothly curved. The joints Jm and Jf can be further arranged to provide a third locking plane 74 parallel to and between the
(Continued)

locking planes 18, 20. The joints are disengaged by combination of a downward rotation of one joint relative the other then application of a downward force. By virtue of these features flooring with the joint system can be laid on sub-surfaces which have undulations greater than current world industry standards. Additionally replacement of damaged substrates is possible by vertical lifting of damaged substrates without the need to pull up excess flooring from the closest wall to the damaged substrates.

17 Claims, 28 Drawing Sheets

Related U.S. Application Data continuation of application No. 14/014,863, filed on Aug. 30, 2013, now Pat. No. 8,806,832, which is a continuation of application No. PCT/AU2012/000280, filed on Mar. 16, 2012.

(30) Foreign Application Priority Data

Jul. 19, 2011 (AU) ..... 2011902871
Nov. 9, 2011 (AU) ..... 2011904668

(51) Int. Cl.

| | |
|---|---|
| ***E04F 15/04*** | (2006.01) |
| ***E04F 15/10*** | (2006.01) |
| ***E04G 23/00*** | (2006.01) |
| ***E04G 23/02*** | (2006.01) |
| ***E04F 13/26*** | (2006.01) |

(52) U.S. Cl.

CPC .... *E04F 15/0215* (2013.01); *E04F 15/02033* (2013.01); *E04F 15/04* (2013.01); *E04F 15/087* (2013.01); *E04F 15/10* (2013.01); *E04F 15/107* (2013.01); *E04G 23/006* (2013.01); *E04G 23/0285* (2013.01); *E04F 2201/0146* (2013.01); *E04F 2201/041* (2013.01); *E04F 2201/07* (2013.01); *Y10T 403/7005* (2015.01); *Y10T 403/7073* (2015.01)

(58) Field of Classification Search

CPC . E04F 15/04; E04F 15/02033; E04F 2201/07; E04F 2201/0146; E04F 2201/041; E04F 13/26; E04G 23/0285; E04G 23/006

USPC .. 52/578, 588.1, 589.1, 590.2, 590.3, 591.4, 52/592.1, 592.4

See application file for complete search history.

(56) References Cited

U.S. PATENT DOCUMENTS

| | | | | |
|---|---|---|---|---|
| 2,023,066 | A | 12/1935 | Joergen et al. | 52/578 |
| 2,430,200 | A | 11/1947 | Joergen et al. | 52/588.1 |
| 2,740,167 | A | 12/1955 | Rowley | 52/591.1 |
| 2,947,040 | A | 8/1960 | Schultz | |
| 3,347,048 | A | 10/1967 | Joergen et al. | 405/16 |
| 3,444,660 | A | 5/1969 | Feichter et al. | 52/389 |
| 3,479,784 | A | 11/1969 | Massagli | 52/588.1 |
| 3,553,919 | A | 1/1971 | Omholt | 52/506.1 |
| 3,694,983 | A | 10/1972 | Couquet | 52/384 |
| 3,720,027 | A | 3/1973 | Christensen | 52/309.8 |
| 3,731,445 | A | 5/1973 | Hoffmann et al. | 52/391 |
| 3,798,111 | A | 3/1974 | Lane et al. | 428/219 |
| 3,807,113 | A | 4/1974 | Turner | 52/314 |
| 3,849,111 | A | 11/1974 | Joergen et al. | 75/749 |
| 3,859,000 | A | 1/1975 | Webster | 404/41 |
| 3,921,312 | A | 11/1975 | Fuller | 434/96 |
| 4,299,070 | A | 11/1981 | Granz et al. | |
| 4,426,820 | A | 1/1984 | Terbrack et al. | 52/590.1 |
| 4,449,346 | A | 5/1984 | Tremblay | 52/509 |
| 4,573,300 | A | 3/1986 | Bezner | 52/563 |
| 4,940,503 | A | 7/1990 | Danielsson et al. | 156/279 |
| 5,050,362 | A | 9/1991 | Hakim et al. | 52/588.1 |
| 5,086,599 | A | 2/1992 | Meyerson | 52/309.9 |
| 5,117,603 | A | 6/1992 | Weintraub | 52/390 |
| 5,148,850 | A | 9/1992 | Urbanick | 160/231.1 |
| 5,216,861 | A | 6/1993 | Meyerson | 52/586.2 |
| 5,295,341 | A | 3/1994 | Kajiwara | 52/586.2 |
| 5,325,649 | A | 7/1994 | Kajiwara | 52/586.1 |
| 5,344,700 | A | 9/1994 | Bailey et al. | 428/304.4 |
| 5,348,778 | A | 9/1994 | Knipp et al. | 428/35.8 |
| 5,502,939 | A | 4/1996 | Anati et al. | 52/309.9 |
| 5,527,128 | A | 6/1996 | Gaylor et al. | 404/35 |
| 5,616,389 | A | 4/1997 | Blatz | 428/45 |
| 5,630,304 | A | 5/1997 | Austin | 52/384 |
| 5,706,621 | A | 1/1998 | Pelwan et al. | 52/403.1 |
| 5,791,114 | A | 8/1998 | Mandel | 52/591.3 |
| 5,797,237 | A | 8/1998 | Finkell | 52/589.1 |
| 5,860,267 | A | 1/1999 | Pelwan et al. | 52/748.1 |
| 5,907,934 | A | 6/1999 | Austin | 52/177 |
| 5,971,655 | A | 10/1999 | Shirakawa | 404/40 |
| 6,006,486 | A | 12/1999 | Bernard et al. | 52/589.1 |
| 6,023,907 | A | 2/2000 | Pelwan et al. | 52/748.1 |
| 6,094,882 | A | 8/2000 | Pervan | 52/745.19 |
| 6,101,778 | A | 8/2000 | Kulik et al. | 52/582.1 |
| 6,182,410 | B1 | 2/2001 | Pelwan et al. | 52/403.1 |
| 6,205,639 | B1 | 3/2001 | Pervan et al. | 29/509 |
| 6,209,278 | B1 | 4/2001 | Tychsen | 52/592.4 |
| 6,216,409 | B1 | 4/2001 | Roy et al. | 52/589.1 |
| 6,247,285 | B1 | 6/2001 | Moebus | 52/589.1 |
| 6,314,701 | B1 | 11/2001 | Meyerson | 52/588.1 |
| 6,324,796 | B1 | 12/2001 | Heath et al. | 52/177 |
| 6,324,803 | B1 | 12/2001 | Pelwan et al. | 52/403.1 |
| 6,339,908 | B1 | 1/2002 | Chuang | 52/589.1 |
| 6,397,547 | B1 | 6/2002 | Kulik et al. | 52/582.1 |
| 6,418,683 | B1 | 7/2002 | Kulik et al. | 52/282.1 |
| 6,421,970 | B1 | 7/2002 | Kulik et al. | 52/282.1 |
| 6,446,405 | B1 | 9/2002 | Darko et al. | 52/403.1 |
| 6,453,632 | B1 | 9/2002 | Huang | 52/403.1 |
| 6,490,836 | B1 | 12/2002 | Bernard et al. | 52/589.1 |
| 6,505,452 | B1 | 1/2003 | Eisermann et al. | 52/582.1 |
| 6,510,665 | B2 | 1/2003 | Pervan | 52/589.1 |
| 6,516,579 | B1 | 2/2003 | Pelwan et al. | 52/403.1 |
| 6,532,709 | B2 | 3/2003 | Darko et al. | 52/403.1 |
| 6,536,178 | B1 | 3/2003 | Palsson et al. | 52/589.1 |
| 6,588,166 | B2 | 7/2003 | Kulik et al. | 52/578 |
| 6,591,568 | B1 | 7/2003 | Joergen et al. | 52/592.2 |
| 6,606,834 | B2 | 8/2003 | Kulik et al. | 52/578 |
| 6,647,690 | B1 | 11/2003 | Martensson | 52/601 |
| 6,715,253 | B2 | 4/2004 | Pervan | 52/578 |
| 6,763,643 | B1 | 7/2004 | Martensson | 52/586.1 |
| 6,769,218 | B2 | 8/2004 | Pervan | 52/591.4 |
| 6,769,835 | B2 | 8/2004 | Stridsman | 404/41 |
| 6,772,568 | B2 | 8/2004 | Bernard et al. | 52/592.1 |
| 6,804,926 | B1 | 10/2004 | Eisermann et al. | 52/592.1 |
| 6,851,237 | B2 | 2/2005 | Elliot et al. | 52/480 |
| 6,851,241 | B2 | 2/2005 | Pervan | 52/592.1 |
| 6,854,235 | B2 | 2/2005 | Maertensson et al. | 52/601 |
| 6,862,857 | B2 | 3/2005 | Joergen et al. | 52/582.1 |
| 6,874,292 | B2 | 4/2005 | Bernard et al. | 52/590.2 |
| 6,880,305 | B2 | 4/2005 | Pervan et al. | 52/480 |
| 6,880,307 | B2 | 4/2005 | Mensing et al. | 52/592.1 |
| 6,898,913 | B2 | 5/2005 | Pervan | 52/589.1 |
| 6,918,220 | B2 | 7/2005 | Pervan | 52/578 |
| 6,920,732 | B2 | 7/2005 | Martensson | 52/586.1 |
| 6,922,964 | B2 | 8/2005 | Darko et al. | 52/551 |
| 6,928,779 | B2 | 8/2005 | Bernard et al. | 52/403.1 |
| 6,955,020 | B2 | 10/2005 | Bernard et al. | 52/592.2 |
| 6,957,675 | B2 | 10/2005 | Risi | 144/347 |
| 6,966,161 | B2 | 11/2005 | Palsson et al. | 52/589.1 |
| 6,968,663 | B2 | 11/2005 | Bernard et al. | 52/589.1 |
| 6,968,664 | B2 | 11/2005 | Bernard et al. | 52/592.1 |
| 6,993,877 | B2 | 2/2006 | Bernard et al. | 52/592.2 |
| 7,003,925 | B2 | 2/2006 | Pervan | 52/578 |
| 7,040,068 | B2 | 5/2006 | Bernard et al. | 52/591.3 |
| 7,047,697 | B1 | 5/2006 | Heath | 52/177 |

(56) References Cited

U.S. PATENT DOCUMENTS 7,051,486 B2 5/2006 Pervan ..... 52/586.1
7,065,935 B2 6/2006 Eisermann et al. ..... 52/747.1
7,081,300 B2 * 7/2006 Laurence ..... B32B 27/36 428/147
7,086,205 B2 8/2006 Pelwan et al. ..... 52/403.1
7,093,399 B2 8/2006 Bernard et al. ..... 52/592.1
7,107,913 B2 9/2006 Smith ..... 108/64
7,121,058 B2 10/2006 Joergen et al. ..... 52/592.2
7,121,059 B2 10/2006 Pelwan et al. ..... 52/592.2
7,127,860 B2 10/2006 Darko et al. ..... 52/592.1
7,131,242 B2 11/2006 Kulik et al. ..... 52/591.3
7,137,229 B2 11/2006 Pervan ..... 52/313
7,150,135 B2 12/2006 Moller et al. ..... 52/592.1
7,171,791 B2 2/2007 Pervan ..... 52/592.1
7,188,456 B2 3/2007 Franz et al. ..... 52/592.1
7,275,350 B2 10/2007 Darko et al. ..... 52/592.1
7,328,536 B2 2/2008 Bernard et al. ..... 52/588.1
7,332,053 B2 2/2008 Curtis Rollin et al. ..... 156/305
7,343,717 B2 3/2008 Bernard et al. ..... 52/592.1
7,356,971 B2 4/2008 Pervan ..... 52/578
7,386,963 B2 6/2008 Darko et al. ..... 52/589.1
7,398,625 B2 7/2008 Pervan ..... 52/578
7,441,385 B2 10/2008 Kettler et al. ..... 52/589.1
7,444,791 B1 11/2008 Pervan ..... 52/590.2
7,451,578 B2 11/2008 Hannig et al. ..... 52/586.1
7,454,875 B2 11/2008 Bergelin et al. ..... 52/586.2
7,467,499 B2 12/2008 Bernard et al. ..... 52/390
7,484,337 B2 2/2009 Grafenauer et al. ..... 52/578
7,484,338 B2 2/2009 Pervan et al. ..... 52/588.1
7,497,058 B2 3/2009 Kulik et al. ..... 52/582.1
7,516,588 B2 4/2009 Pervan ..... 52/592.1
7,520,092 B2 4/2009 Showers et al. ..... 52/177
7,543,418 B2 6/2009 Weitzer et al. ..... 52/592.1
7,550,192 B2 * 6/2009 Dempsey ..... B26F 1/40 428/192
7,552,568 B2 6/2009 Palsson et al. ..... 52/589.1
7,568,322 B2 8/2009 Darko et al. ..... 52/792.11
7,584,583 B2 * 9/2009 Bergelin ..... E04F 15/02 52/177
7,617,645 B2 11/2009 Bernard et al. ..... 52/384
7,617,651 B2 11/2009 Grafenauer et al. ..... 52/592.1
7,621,092 B2 11/2009 Gollatz et al. ..... 52/586.1
7,621,094 B2 11/2009 Bernard et al. ..... 52/588.1
7,624,552 B2 12/2009 Bernard et al. ..... 52/403.1
7,634,884 B2 12/2009 Bergelin et al. ..... 52/582.1
7,634,886 B2 12/2009 Bernard et al. ..... 52/588.1
7,634,887 B2 12/2009 Bernard et al. ..... 52/588.1
7,637,066 B2 12/2009 Bernard et al. ..... 52/588.1
7,637,067 B2 12/2009 Bernard et al. ..... 52/588.1
7,637,068 B2 12/2009 Darko et al. ..... 52/592.1
7,640,708 B2 1/2010 Bernard et al. ..... 52/588.1
7,644,554 B2 1/2010 Bernard et al. ..... 52/588.1
7,644,555 B2 1/2010 Bernard et al. ..... 52/588.1
7,644,557 B2 1/2010 Bernard et al. ..... 52/745.19
7,647,741 B2 1/2010 Bernard et al. ..... 52/588.1
7,647,743 B2 1/2010 Bernard et al. ..... 52/745.19
7,650,727 B2 1/2010 Bernard et al. ..... 52/588.1
7,650,728 B2 1/2010 Bernard et al. ..... 52/588.1
7,654,054 B2 2/2010 Bernard et al. ..... 52/588.1
7,658,048 B2 2/2010 Bernard et al. ..... 52/588.1
7,661,238 B2 2/2010 Bernard et al. ..... 52/588.1
7,665,265 B2 2/2010 Bernard et al. ..... 52/588.1
7,665,266 B2 2/2010 Bernard et al. ..... 52/588.1
7,665,267 B2 2/2010 Bernard et al. ..... 52/588.1
7,665,268 B2 2/2010 Bernard et al. ..... 52/588.1
7,669,376 B2 3/2010 Bernard et al. ..... 52/588.1
7,669,377 B2 3/2010 Bernard et al. ..... 52/592.1
7,673,431 B2 3/2010 Bernard et al. ..... 52/588.1
7,677,005 B2 3/2010 Darko et al. ..... 52/582.1
7,677,008 B2 3/2010 Bernard et al. ..... 52/588.1
7,681,371 B2 3/2010 Bernard et al. ..... 52/588.1
7,698,868 B2 4/2010 Bernard et al. ..... 52/588.1
7,698,869 B2 4/2010 Bernard et al. ..... 52/588.1
7,707,793 B2 5/2010 Bernard et al. ..... 52/589.1
7,712,280 B2 5/2010 Bernard et al. ..... 52/588.1
7,716,896 B2 5/2010 Darko et al. ..... 52/588.1
7,721,504 B2 5/2010 Bernard et al. ..... 52/592.1
7,726,088 B2 6/2010 Mueehlebach et al. ..... 52/582.1
7,726,089 B2 6/2010 Bernard et al. ..... 52/588.1
7,735,288 B2 6/2010 Bernard et al. ..... 52/591.3
7,739,849 B2 6/2010 Darko et al. ..... 52/58.21
7,748,176 B2 7/2010 Harding et al. ..... 52/177
7,757,452 B2 7/2010 Darko et al. ..... 52/586.1
7,757,453 B2 7/2010 Bernard et al. ..... 52/588.1
7,762,293 B2 7/2010 Pervan ..... 144/82
7,770,350 B2 8/2010 Bernard et al. ..... 52/589.1
7,775,007 B2 8/2010 Pelwan et al. ..... 52/403.1
7,779,596 B2 8/2010 Pervan ..... 52/588.1
7,779,597 B2 8/2010 Bernard et al. ..... 52/588.1
7,779,601 B2 8/2010 Darko et al. ..... 52/745.19
7,788,871 B2 9/2010 Darko et al. ..... 52/592.1
7,793,471 B2 * 9/2010 Hill ..... B32B 3/10 428/33
7,802,411 B2 9/2010 Bergelin et al. ..... 52/586.2
7,810,297 B2 10/2010 Bernard et al. ..... 52/591.1
7,823,359 B2 11/2010 Pelwan et al. ..... 52/588.1
7,827,749 B2 11/2010 Windmoeller et al. ..... 52/316
7,827,754 B2 11/2010 Bernard et al. ..... 52/590.2
7,827,755 B2 11/2010 Bernard et al. ..... 52/592.1
7,832,161 B2 * 11/2010 Ligabue ..... E04F 13/142 428/157
7,841,144 B2 11/2010 Pervan ..... 52/395
7,841,145 B2 11/2010 Bergelin et al. ..... 52/395
7,841,150 B2 11/2010 Darko et al. ..... 52/582.1
7,845,133 B2 12/2010 Pervan ..... 52/578
7,849,642 B2 12/2010 Forster et al. ..... 52/177
7,849,655 B2 12/2010 Chen et al. ..... 52/592.1
7,856,784 B2 12/2010 Kulik et al. ..... 52/582.1
7,856,785 B2 12/2010 Pelwan et al. ..... 52/588.1
7,856,789 B2 12/2010 Eisermann et al. ..... 52/747.1
7,861,482 B2 1/2011 Boo et al. ..... 52/586.1
7,866,110 B2 1/2011 Pervan ..... 52/586.2
7,874,118 B2 1/2011 Schitter ..... 52/578
7,874,119 B2 1/2011 Pervan et al. ..... 52/578
7,886,497 B2 2/2011 Darko et al. ..... 52/588.1
7,895,805 B2 3/2011 Darko et al. ..... 52/578
7,896,571 B1 3/2011 Eisermann et al. ..... 403/339
7,900,416 B1 3/2011 Haney et al. ..... 52/592.1
7,908,815 B2 3/2011 Paaisson et al. ..... 52/582.1
7,913,471 B2 3/2011 Pervan ..... 52/590.2
7,954,295 B2 6/2011 Pervan ..... 52/592.1
7,980,039 B2 7/2011 Grafenauer et al. ..... 52/582.2
7,980,041 B2 7/2011 Bergelin et al. ..... 52/586.2
7,980,043 B2 7/2011 Moebus ..... 52/588.1
8,006,458 B1 8/2011 Maertensson et al. ..... 52/582.1
8,011,155 B2 9/2011 Pervan ..... 52/588.1
8,024,904 B2 9/2011 Hannig et al. ..... 52/586.1
8,028,486 B2 10/2011 Darko et al. ..... 52/588.1
8,033,074 B2 10/2011 Paaisson et al. ..... 52/582.1
8,033,075 B2 10/2011 Darko et al. ..... 52/589.1
8,037,656 B2 10/2011 Liu et al. ..... 52/589.1
8,037,657 B2 10/2011 Engstroem et al. ..... 52/592.1
8,038,363 B2 10/2011 Eisermann et al. ..... 403/339
8,042,311 B2 10/2011 Bergelin et al. ..... 52/586.1
8,061,104 B2 11/2011 Pervan ..... 52/592.1
8,069,631 B2 12/2011 Darko et al. ..... 52/592.1
8,071,193 B2 12/2011 Pervan ..... 428/60
8,079,196 B2 12/2011 Pervan ..... 52/586.2
8,091,238 B2 1/2012 Hannig et al. ..... 29/897.32
8,092,036 B2 1/2012 Jacobsson ..... 362/153
8,099,924 B2 1/2012 Braun et al. ..... 52/588.1
8,104,244 B2 1/2012 Darko et al. ..... 52/586.1
8,112,967 B2 2/2012 Pervan et al. ..... 52/747.11
8,132,384 B2 3/2012 Hannig et al. ..... 52/582.1
8,146,318 B2 4/2012 Wilson ..... 52/588.1
8,166,723 B2 5/2012 Bernard et al. ..... 52/592.1
8,171,692 B2 5/2012 Pervan ..... 52/592.2
8,181,416 B2 5/2012 Bergelin et al. ..... 52/586.2
8,191,333 B2 6/2012 Braun et al. ..... 52/745.19
8,191,334 B2 6/2012 Kihlstedt ..... 52/747.11
8,205,407 B2 6/2012 Genova ..... 52/582.1
8,215,076 B2 7/2012 Pervan et al. ..... 52/588.1
8,234,831 B2 8/2012 Pervan ..... 52/588.1
8,234,834 B2 8/2012 Kulik et al. ..... 52/747.1

(56) References Cited

U.S. PATENT DOCUMENTS 8,250,825 B2 8/2012 Darko et al. ..... 52/592.1
8,266,849 B2 * 9/2012 Bravo ..... E04F 15/043 52/177
8,276,342 B2 10/2012 Kulik et al. ..... 52/582.1
8,281,549 B2 10/2012 Du ..... 52/747.1
8,293,058 B2 10/2012 Darko et al. ..... 156/265
8,302,361 B2 11/2012 Braun et al. ..... 52/588.1
8,302,367 B2 11/2012 Schulte ..... 52/747.11
8,336,272 B2 12/2012 Lehnhoff et al. ..... 52/588.1
8,341,914 B2 1/2013 Paaisson et al. ..... 52/582.1
8,341,915 B2 1/2013 Bergelin et al. ..... 52/586.2
8,341,916 B2 1/2013 Engstroem et al. ..... 52/592.4
8,353,140 B2 1/2013 Nilsson et al. ..... 52/588.1
8,359,805 B2 1/2013 Paaisson et al. ..... 52/582.1
8,359,806 B2 1/2013 Darko et al. ..... 52/588.1
8,365,494 B2 2/2013 Bernard et al. ..... 52/588.1
8,365,499 B2 2/2013 Nilsson et al. ..... 52/747.1
8,375,672 B2 2/2013 Hannig et al. ..... 52/588.1
8,375,674 B2 2/2013 Braun et al. ..... 52/592.1
8,381,476 B2 2/2013 Hannig et al. ..... 52/582.1
8,381,477 B2 2/2013 Bergelin et al. ..... 52/586.2
8,387,327 B2 3/2013 Pervan ..... 52/586.2
8,397,466 B2 3/2013 Forster et al. ..... 52/745.11
8,402,709 B2 3/2013 Kulik et al. ..... 52/582.1
8,419,877 B2 4/2013 Boucke et al. ..... 156/219
8,429,869 B2 4/2013 Pervan ..... 52/578
8,431,054 B2 4/2013 Boucke et al. ..... 264/112
8,438,814 B2 5/2013 Bernard et al. ..... 52/591.1
8,448,402 B2 5/2013 Pervan et al. ..... 52/582.1
8,474,208 B2 7/2013 Rulan et al. ..... 52/390
8,484,924 B2 7/2013 Tychsen ..... 52/588.1
8,495,849 B2 7/2013 Pervan ..... 52/592.1
8,499,521 B2 8/2013 Pervan et al. ..... 52/588.1
8,544,233 B2 10/2013 Becker ..... 52/588.1
8,925,264 B2 * 1/2015 Thrush ..... E04F 15/02016 52/177
2001/0029720 A1 10/2001 Pervan et al.
2002/0112429 A1 8/2002 Elliot et al. ..... 52/392
2002/0170258 A1 11/2002 Mensing et al. ..... 52/592.1
2002/0178674 A1 12/2002 Pelwan et al. ..... 52/385
2002/0178681 A1 12/2002 Fantoni et al. ..... 52/592.1
2003/0093964 A1 5/2003 Bushey et al. ..... 52/592.1
2003/0094230 A1 5/2003 Joergen et al. ..... 156/91
2003/0136494 A1 7/2003 Brown et al. ..... 156/62.2
2003/0205017 A1 11/2003 Palmberg ..... 52/592.1
2004/0074189 A1 4/2004 Deschenes ..... 52/589.1
2004/0182033 A1 9/2004 Wernersson ..... 52/578
2004/0221537 A1 11/2004 Kulik et al. ..... 52/578
2004/0250492 A1 12/2004 Becker ..... 52/578
2005/0055972 A1 3/2005 Luty ..... 52/741.1
2005/0108970 A1 5/2005 Liu ..... 52/581
2005/0115181 A1 6/2005 Grau ..... 52/390
2005/0144879 A1 7/2005 Fiorino ..... 52/578
2005/0144881 A1 7/2005 Engstroem et al. ..... 52/578
2005/0166502 A1 8/2005 Pervan et al. ..... 52/387
2005/0166512 A1 8/2005 Teuwen ..... 52/578
2005/0166516 A1 8/2005 Pervan ..... 52/589.1
2005/0183370 A1 8/2005 Cripps ..... 52/591.5
2005/0204661 A1 9/2005 Showers et al. ..... 52/263
2005/0210810 A1 9/2005 Pervan ..... 52/578
2005/0214475 A1 9/2005 Carling et al. ..... 427/532
2005/0252130 A1 11/2005 Martensson ..... 52/384
2005/0284067 A1 12/2005 Mei ..... 52/480
2006/0032168 A1 2/2006 De Boe et al. ..... 52/390
2006/0032169 A1 2/2006 Mei ..... 52/392
2006/0101773 A1 * 5/2006 Turner ..... E04F 15/02183 52/650.3
2006/0156666 A1 7/2006 Caufield ..... 52/483.1
2006/0185297 A1 8/2006 Mei ..... 52/506.05
2006/0260252 A1 11/2006 Brice ..... 52/588.1
2007/0003366 A1 1/2007 Engstroem et al. ..... 403/410
2007/0011980 A1 1/2007 Kerkhof et al. ..... 52/586.1
2007/0022689 A1 2/2007 Grimm et al. ..... 52/392
2007/0062148 A1 3/2007 Geltink et al. ..... 52/592.1
2007/0107359 A1 5/2007 Zhang ..... 52/582.1
2007/0130872 A1 6/2007 Goodwin et al. ..... 52/592.1
2007/0214737 A1 9/2007 Hauck ..... 52/302.1
2007/0220822 A1 9/2007 Claus et al. ..... 52/392
2008/0005998 A1 1/2008 Darko et al. ..... 52/589.1
2008/0110125 A1 5/2008 Pervan ..... 52/582.2
2008/0127593 A1 6/2008 Janesky ..... 52/581
2008/0134613 A1 6/2008 Agne et al. ..... 52/582.2
2008/0216920 A1 9/2008 Darko et al. ..... 144/363
2008/0241440 A1 10/2008 Bauer ..... 428/33
2008/0271403 A1 11/2008 Joergen et al. ..... 52/588.1
2009/0038260 A1 2/2009 Michel ..... 52/782.1
2009/0041987 A1 2/2009 Schitter ..... 428/172
2009/0049796 A1 2/2009 Grau et al. ..... 52/762
2009/0064624 A1 3/2009 Sokol ..... 52/589.1
2009/0107076 A1 4/2009 Kim et al. ..... 52/582.1
2009/0133358 A1 5/2009 Grafenauer et al. ..... 52/741.1
2009/0151285 A1 6/2009 Tuente et al. ..... 52/403.1
2009/0155612 A1 6/2009 Boucke et al. ..... 428/498
2009/0193741 A1 8/2009 Cappelle ..... 52/309.1
2009/0199502 A1 8/2009 Eisermann ..... 52/589.1
2009/0217615 A1 9/2009 Engstroem et al. ..... 52/588.1
2009/0320402 A1 12/2009 Cappelle et al. ..... 52/588.1
2010/0058590 A1 3/2010 Braun et al. ..... 29/897.32
2010/0083603 A1 4/2010 Goodwin ..... 52/589.1
2010/0088982 A1 4/2010 Carra et al. ..... 52/177
2010/0088993 A1 4/2010 Grafenauer et al. ..... 52/588.1
2010/0116405 A1 5/2010 Kipp et al. ..... 156/39
2010/0200826 A1 8/2010 Olsson et al. ..... 256/48
2010/0229491 A1 9/2010 Pervan ..... 52/588.1
2010/0236171 A1 9/2010 Liu ..... 52/309.3
2010/0257809 A1 10/2010 Theirs et al. ..... 52/588.1
2010/0281803 A1 11/2010 Cappelle et al. ..... 52/309.1
2010/0281810 A1 11/2010 Rulan et al. ..... 52/588.1
2010/0314368 A1 12/2010 Braun et al. ..... 219/121.72
2011/0011020 A1 * 1/2011 Shen ..... E04F 15/10 52/309.1
2011/0030300 A1 * 2/2011 Liu ..... E04F 15/02 52/403.1
2011/0030303 A1 2/2011 Boo et al. ..... 52/582.1
2011/0067340 A1 3/2011 Groeke et al. ..... 52/578
2011/0094083 A1 4/2011 Schulte ..... 29/446
2011/0094178 A1 4/2011 Braun et al. ..... 52/588.1
2011/0131909 A1 6/2011 Hannig et al. ..... 52/309.1
2011/0138722 A1 6/2011 Hannig et al. ..... 52/309.1
2011/0167750 A1 7/2011 Pervan ..... 52/588.1
2011/0167751 A1 7/2011 Engstrom ..... 52/588.1
2011/0173914 A1 7/2011 Engstroem et al. ..... 52/582.2
2011/0179728 A1 7/2011 Cerny et al. ..... 52/177
2011/0186217 A1 8/2011 Tack et al. ..... 156/272.2
2011/0247285 A1 10/2011 Lasseel et al. ..... 52/309.1
2011/0271631 A1 11/2011 Engstroem et al. ..... 52/582.2
2011/0271632 A1 11/2011 Cappelle et al. ..... 52/582.2
2012/0011796 A1 1/2012 Hannig et al. ..... 52/588.1
2012/0031029 A1 2/2012 Bergelin et al. ..... 52/309.13
2012/0042598 A1 2/2012 De Rick et al. ..... 52/588.1
2012/0055112 A1 3/2012 Engstroem ..... 52/582.2
2012/0073235 A1 3/2012 Hannig et al. ..... 52/588.1
2012/0096801 A1 4/2012 Cappelle ..... 52/592.1
2012/0124932 A1 5/2012 Eschlbeck et al. ..... 52/588.1
2012/0174515 A1 7/2012 Bergelin et al. ..... 52/309.1
2012/0174519 A1 7/2012 Schulte ..... 52/588.1
2012/0174520 A1 7/2012 Pervan ..... 52/588.1
2012/0174521 A1 7/2012 Schulte ..... 52/588.1
2012/0180408 A1 * 7/2012 Harris ..... E04F 15/02038 52/177
2012/0180416 A1 7/2012 Perra et al. ..... 52/309.1
2012/0192521 A1 8/2012 Schulte ..... 52/588.1
2012/0216472 A1 8/2012 Kulik et al. ..... 52/302.1
2012/0233948 A1 9/2012 Joergen et al. ..... 52/309.1
2012/0233953 A1 9/2012 Pervan et al. ..... 52/588.1
2012/0247053 A1 10/2012 Kulik et al. ..... 52/588.1
2012/0266555 A1 10/2012 Cappelle ..... 52/309.1
2012/0291396 A1 11/2012 Kulik et al. ..... 52/745.13
2012/0304590 A1 12/2012 Engstroem et al. ..... 52/745.21
2012/0317916 A1 12/2012 Oh et al. ..... 52/588.1
2013/0008119 A1 1/2013 De Rick et al. ..... 52/588.1
2013/0008127 A1 1/2013 Braun et al. ..... 52/745.21
2013/0014890 A1 1/2013 Darko et al. ..... 156/265
2013/0025231 A1 1/2013 De Rick et al. ..... 52/588.1

(56) References Cited

U.S. PATENT DOCUMENTS

| | | | | |
|---|---|---|---|---|
| 2013/0036695 | A1 | 2/2013 | Duernberger et al. | 52/309.3 |
| 2013/0042555 | A1 | 2/2013 | Kulik et al. | 52/309.1 |
| 2013/0045043 | A1 | 2/2013 | Engstroem et al. | 403/267 |
| 2013/0047536 | A1 | 2/2013 | Joergen et al. | 52/309.1 |
| 2013/0067840 | A1 | 3/2013 | Kulik et al. | 52/309.1 |
| 2013/0081349 | A1 | 4/2013 | Bergelin et al. | 52/588.1 |
| 2013/0097959 | A1 | 4/2013 | Michel | 52/588.1 |
| 2013/0104487 | A1 | 5/2013 | Bernard et al. | 52/588.1 |
| 2013/0111758 | A1 | 5/2013 | Nilsson et al. | 29/897.3 |
| 2013/0111843 | A1 | 5/2013 | Litral | 52/588.1 |
| 2013/0111845 | A1 | 5/2013 | Paaisson et al. | 52/588.1 |
| 2013/0145708 | A1 | 6/2013 | Bergelin et al. | 52/309.13 |
| 2013/0160390 | A1 | 6/2013 | Stockl et al. | 52/588.1 |
| 2013/0160391 | A1 | 6/2013 | Nilsson et al. | 52/588.1 |
| 2013/0167458 | A1* | 7/2013 | Cerny | E04F 15/02038 52/177 |
| 2013/0167467 | A1 | 7/2013 | De Rick et al. | 52/588.1 |
| 2013/0192158 | A1 | 8/2013 | Cappelle et al. | 52/588.1 |
| 2013/0247501 | A1 | 9/2013 | Thiers et al. | 52/588.1 |

FOREIGN PATENT DOCUMENTS

| | | | |
|---|---|---|---|
| CH | 200949 | A | 11/1938 |
| CN | 2391943 | Y | 8/2000 |
| CN | 201155195 | Y | 11/2008 |
| CN | 201254820 | Y | 6/2009 |
| CN | 201261936 | Y | 6/2009 |
| CN | 201665978 | U | 12/2010 |
| DE | 557844 | C1 | 8/1932 |
| DE | 1484108 | A1 | 4/1969 |
| DE | 7214698 | U | 1/1973 |
| DE | 2159042 | A1 | 6/1973 |
| DE | 2251762 | A1 | 5/1974 |
| DE | 2252643 | A1 | 5/1974 |
| DE | 2502992 | A1 | 7/1976 |
| DE | 2516843 | A1 | 10/1976 |
| DE | 2917025 | A1 | 11/1980 |
| DE | 3544845 | A1 | 6/1987 |
| DE | 3343601 | C2 | 7/1988 |
| DE | 4344089 | A1 | 7/1994 |
| DE | 29520966 | U1 | 10/1996 |
| DE | 29521315 | U1 | 3/1997 |
| DE | 19538177 | A1 | 4/1997 |
| DE | 19636021 | A1 | 4/1997 |
| DE | 29706474 | U1 | 7/1997 |
| DE | 19718319 | A1 | 11/1998 |
| DE | 29922649 | U1 | 4/2000 |
| DE | 20000484 | U1 | 6/2000 |
| DE | 19933343 | A1 | 2/2001 |
| DE | 20017461 | U1 | 3/2001 |
| DE | 19963203 | A1 | 9/2001 |
| DE | 20203311 | U1 | 6/2002 |
| DE | 20210942 | U1 | 1/2003 |
| DE | 20307578 | U1 | 8/2003 |
| DE | 20307580 | U1 | 8/2003 |
| DE | 29724742 | U1 | 8/2003 |
| DE | 10204991 | C1 | 10/2003 |
| DE | 10212324 | A1 | 10/2003 |
| DE | 10242647 | A1 | 6/2004 |
| DE | 10305695 | A1 | 9/2004 |
| DE | 10321758 | A1 | 12/2004 |
| DE | 20312628 | U1 | 1/2005 |
| DE | 29724868 | U1 | 2/2005 |
| DE | 29724876 | U1 | 3/2005 |
| DE | 10206835 | B4 | 4/2005 |
| DE | 29724883 | U1 | 5/2005 |
| DE | 202005000722 | U1 | 5/2005 |
| DE | 202005004537 | U1 | 7/2005 |
| DE | 102004001363 | A1 | 8/2005 |
| DE | 102004004245 | A1 | 8/2005 |
| DE | 102005002297 | A1 | 8/2005 |
| DE | 102005012827 | B3 | 7/2006 |
| DE | 102005062982 | B3 | 1/2007 |
| DE | 102005037811 | A1 | 2/2007 |
| DE | 102005042644 | A1 | 3/2007 |
| DE | 202006015942 | U1 | 3/2007 |
| DE | 102006001167 | A1 | 7/2007 |
| DE | 102006030852 | A1 | 11/2007 |
| DE | 102007019786 | A1 | 6/2008 |
| DE | 102007020271 | A1 | 8/2008 |
| DE | 102007032885 | A1 | 1/2009 |
| DE | 102007035648 | A1 | 1/2009 |
| DE | 102007059247 | A1 | 6/2009 |
| DE | 202009004497 | U1 | 10/2009 |
| DE | 102008021970 | A1 | 11/2009 |
| DE | 102008003117 | A1 | 12/2009 |
| DE | 202009011997 | U1 | 3/2010 |
| DE | 202007019281 | U1 | 4/2010 |
| DE | 102008053230 | A1 | 5/2010 |
| DE | 102004055951 | A1 | 8/2010 |
| DE | 202006020874 | U1 | 11/2010 |
| DE | 102009038750 | A1 | 3/2011 |
| EP | 85196 | A1 | 8/1983 |
| EP | 498778 | A1 | 8/1992 |
| EP | 624696 | A2 | 11/1994 |
| EP | 688921 | A1 | 12/1995 |
| EP | 939163 | A2 | 9/1999 |
| EP | 715037 | B1 | 7/2003 |
| EP | 1279778 | A3 | 12/2003 |
| EP | 1441086 | A1 | 7/2004 |
| EP | 1736613 | A2 | 12/2006 |
| EP | 1691002 | A3 | 6/2007 |
| EP | 1808547 | A1 | 7/2007 |
| EP | 1930524 | A2 | 6/2008 |
| EP | 1614829 | B1 | 1/2009 |
| EP | 2025829 | A2 | 2/2009 |
| EP | 2055455 | A1 | 5/2009 |
| EP | 2112297 | A2 | 10/2009 |
| EP | 2180116 | A2 | 4/2010 |
| EP | 2206853 | A2 | 7/2010 |
| EP | 2270292 | A1 | 1/2011 |
| EP | 1980683 | B1 | 2/2011 |
| EP | 1380710 | B1 | 3/2011 |
| EP | 1978179 | B1 | 4/2011 |
| EP | 2270291 | B1 | 5/2011 |
| EP | 2320006 | A1 | 5/2011 |
| EP | 2357298 | A2 | 8/2011 |
| EP | 2390437 | A2 | 11/2011 |
| EP | 2397624 | A2 | 12/2011 |
| EP | 2447442 | A2 | 5/2012 |
| EP | 1350904 | B2 | 10/2012 |
| EP | 1359266 | B1 | 10/2012 |
| EP | 2000610 | B1 | 11/2012 |
| FR | 809481 | A | 3/1937 |
| FR | 1215852 | A | 4/1960 |
| FR | 1293043 | A | 5/1962 |
| FR | 2568295 | A1 | 1/1986 |
| FR | 2733264 | A1 | 10/1996 |
| FR | 2760481 | A3 | 9/1998 |
| FR | 2826391 | A1 | 12/2002 |
| FR | 2851595 | A1 | 8/2004 |
| FR | 2903707 | A1 | 1/2008 |
| FR | 2934625 | A1 | 2/2010 |
| GB | 424057 | A | 2/1935 |
| GB | 647812 | A | 12/1950 |
| GB | 812671 | A | 4/1959 |
| GB | 1430423 | A | 3/1976 |
| GB | 2256023 | A | 11/1992 |
| GB | 2365880 | A | 2/2002 |
| GB | 2436570 | A | 10/2007 |
| GB | 2457669 | A | 8/2009 |
| JP | 3169967 | A | 7/1991 |
| JP | 5018028 | A | 1/1993 |
| JP | 9256603 | A | 9/1997 |
| JP | 10219975 | A | 8/1998 |
| JP | 3461569 | B2 | 10/2003 |
| JP | 2006077449 | A | 3/2006 |
| JP | 2006161312 | A | 6/2006 |
| JP | 4492324 | B2 | 6/2010 |
| KR | 623960 | B1 | 9/2006 |
| KR | 758104 | B1 | 9/2007 |
| NL | 1025787 | C2 | 9/2005 |
| NL | 1028881 | C2 | 10/2006 |

(56) References Cited

FOREIGN PATENT DOCUMENTS

| | | | |
|---|---|---|---|
| WO | WO 1993013280 | A1 | 7/1993 |
| WO | WO 1995014834 | A1 | 6/1995 |
| WO | WO 1996027719 | A1 | 9/1996 |
| WO | WO 2000043611 | A1 | 7/2000 |
| WO | WO 2002031291 | A1 | 4/2002 |
| WO | WO 2003031750 | A1 | 4/2003 |
| WO | WO 2003087497 | A1 | 10/2003 |
| WO | WO 2004003314 | A1 | 1/2004 |
| WO | WO 2004009930 | A1 | 1/2004 |
| WO | WO 2004053256 | A1 | 6/2004 |
| WO | WO 2004053258 | A1 | 6/2004 |
| WO | WO 2005021892 | A1 | 3/2005 |
| WO | WO 2005040523 | A1 | 5/2005 |
| WO | WO 2005068746 | A1 | 7/2005 |
| WO | WO 2005088029 | A1 | 9/2005 |
| WO | WO 2005098163 | A1 | 10/2005 |
| WO | WO 2006111834 | A1 | 10/2006 |
| WO | WO 2006136413 | A1 | 12/2006 |
| WO | WO 2008008016 | A1 | 1/2008 |
| WO | WO 2008011815 | A1 | 1/2008 |
| WO | WO 2008043407 | A1 | 4/2008 |
| WO | WO 2008083662 | A1 | 7/2008 |
| WO | WO 2008110112 | A1 | 9/2008 |
| WO | WO 2008122194 | A1 | 10/2008 |
| WO | WO 2008133377 | A1 | 11/2008 |
| WO | WO 2008148324 | A1 | 12/2008 |
| WO | WO 2009021487 | A1 | 2/2009 |
| WO | WO 2009053185 | A2 | 4/2009 |
| WO | WO 2009077178 | A1 | 6/2009 |
| WO | WO 2010075839 | A1 | 7/2010 |
| WO | WO 2010083815 | A1 | 7/2010 |
| WO | WO 2010100046 | A1 | 9/2010 |
| WO | WO 2010102735 | A1 | 9/2010 |
| WO | WO 2010143943 | A1 | 12/2010 |
| WO | WO 2011015375 | A1 | 2/2011 |
| WO | WO 2011102619 | A2 | 8/2011 |
| WO | WO 2011115559 | A1 | 9/2011 |
| WO | WO 2011131182 | A2 | 10/2011 |
| WO | WO 2011133006 | A2 | 10/2011 |
| WO | WO 2012101171 | A1 | 8/2012 |
| WO | WO 2012168033 | A1 | 12/2012 |

* cited by examiner

Fig 3a
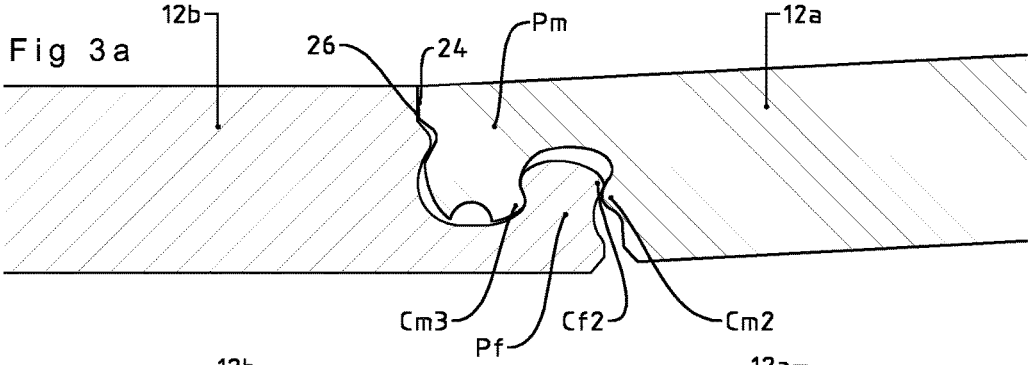
Fig 3b
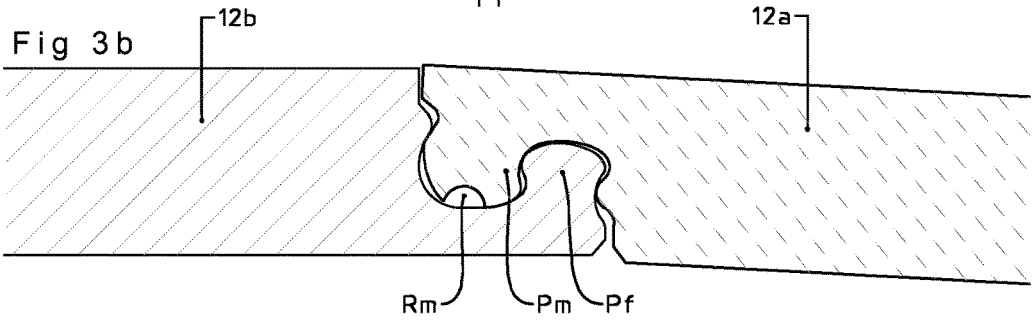
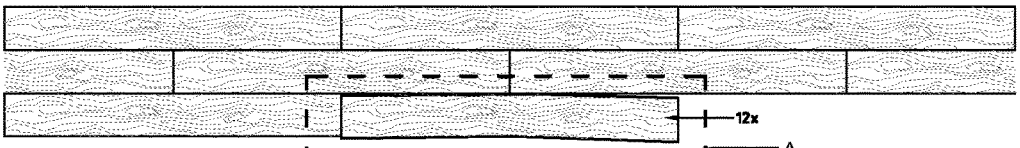
Fig 4a
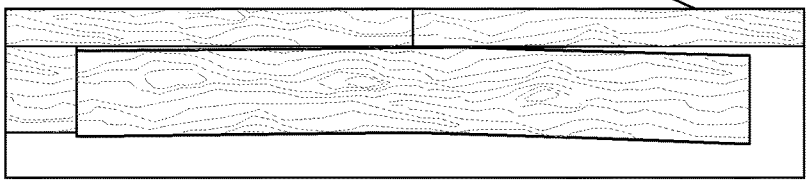
Fig 4b
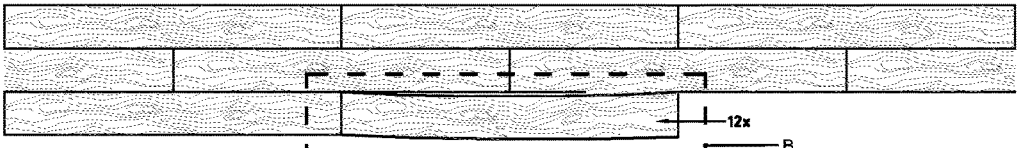
Fig 4c
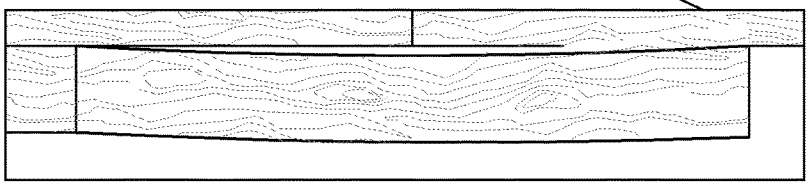
Fig 4d

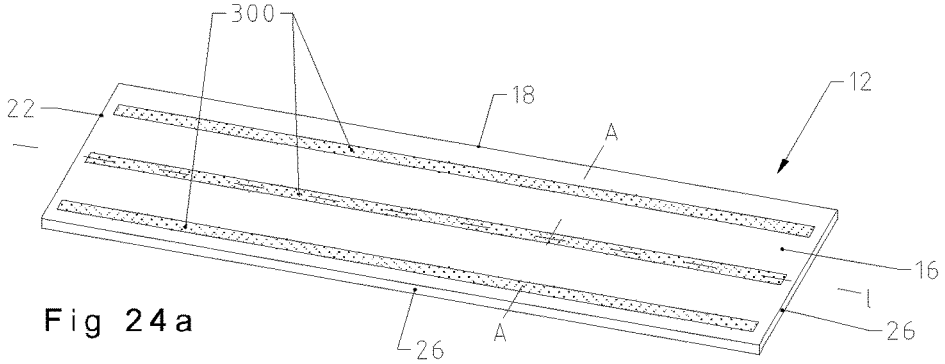
Fig 24a
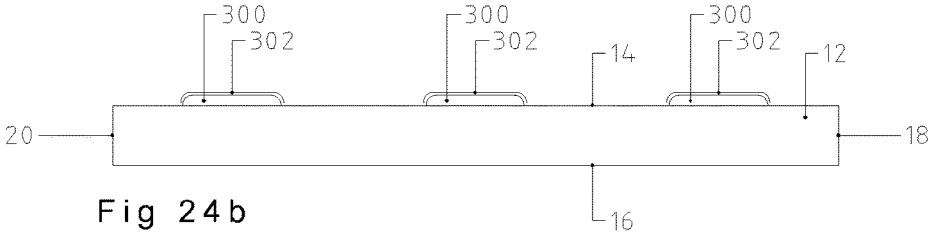
Fig 24b
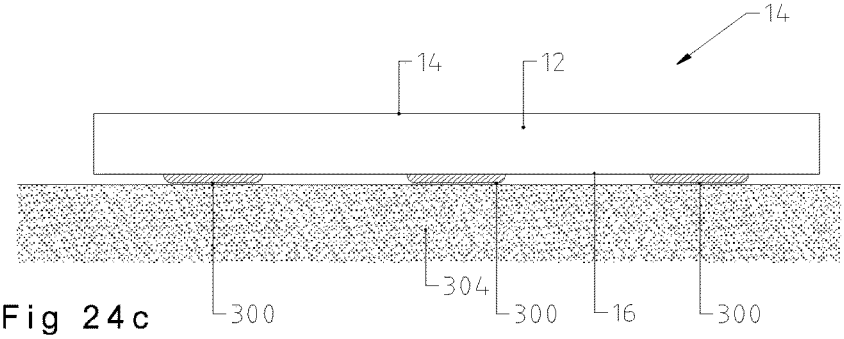
Fig 24c
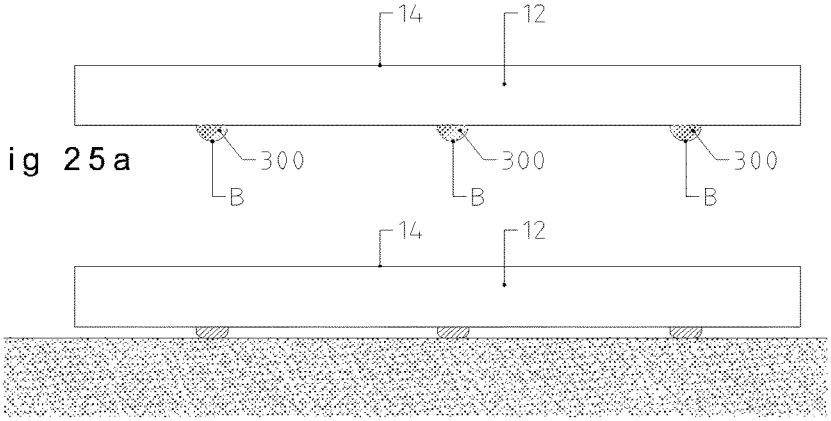
Fig 25a
Fig 25b

VERTICAL JOINT SYSTEM AND ASSOCIATED SURFACE COVERING SYSTEM

FIELD OF THE INVENTION

The present invention relates to a vertical joint system for substrates enabling the substrates to be jointed together side by side. Non-limiting examples of such substrates include wooden boards or panels which may be used as floor, wall or ceiling covering. The present invention also relates to a surface covering system utilising substrates which incorporate the joint system.

BACKGROUND ART

"Click" type floor coverings comprise a plurality of substrates, each provided with like joint systems to facilitate coupling of adjacent substrates. These joint systems often comprise first and second joints running along two opposite sides of the substrate. The joints are configured so that the first joint on one substrate is able to engage the second joint on an adjacent substrate. The joints rely on specific configurations of tongues, grooves, protrusions, recesses and barbs to effect interlocking engagement.

Joint systems for flooring may be generally categorised as horizontal joint systems, lay down joint systems or vertical joint systems. Horizontal joint systems require motion in a plane substantially parallel to a plane containing a major surface of the flooring substrate (i.e. a horizontal plane) in order to effect the engagement of joints on adjacent substrates. In lay down systems panel are joined by inclining one panel to insert a tongue into a groove of a previously laid panel then laying down or pivoting the inclined panel to be co-planar with the previously laid panel. Vertical joint systems on the other hand require motion and/or force in a plane perpendicular to a major surface of the substrates to effect engagement of the joints. Thus it should be understood that the expression "vertical" in the context of the present type of joint system, and as used in this specification, does not mean absolutely vertical but rather perpendicular to a major surface of a substrate. When the substrate is laid on a horizontal surface then "vertical" in this context is also absolute vertical. But as those skilled in the art will understand substrates can be laid on surfaces of other dispositions for example on vertical surfaces such as a vertical wall; or, inclined surfaces such as on a pitched ceiling. In such situations the vertical joint system holds it's meaning as a joint system that operates/engages by way of motion and/or force in a plane perpendicular to a major surface of the substrates Horizontal and lay down system are generally characterised by mutually engageable tongues and grooves. In this context, the term "tongue" is understood as meaning 'a protrusion extending distally from a side of a panel spaced inwardly from the top and bottom surfaces of the panel'. This definition was provided by the Honourable Rudolph T. Randa, Chief Judge in the Markman Claim Construction decision in Order nos. 02-C-1266, 03-C-342, 04-C-121-Mar. 6, 2007 in relation to U.S. Pat. Nos. 6,006,486 and 6,490,836 assigned to Unilin Beheer B. V. Indeed in the Markman hearing Unilin themselves proposed the term "tongue" be construed as "a protrusion extending distally form a side spaced inwardly form the top and bottom surfaces and including at least one locking element". Similarly in US International Trade Commission Investigation no. 337-TA-545 it was held that 'tongue' means 'a coupling part extending from the edge of a board, where the coupling part provides primary coupling in the horizontal direction and primary locking the vertical direction' and 'groove' means 'a coupling part that cooperates with the tongue to connection two panels together'.

The above references to the background art do not constitute an admission that the art forms a part of the common general knowledge of a person of ordinary skill in the art. The above references are also not intended to limit the application of the joint system as disclosed herein.

SUMMARY OF THE INVENTION

Aspects of the present invention provide vertical joint systems for substrates. The vertical joint systems facilitate the provision of surface covering system that allow for very easy installation and more particularly repair. To this end repair can be achieved by vertical lifting of damaged panels without the need to pull up excess flooring from the closest wall to the damaged panels.

Other aspects of the present invention a provide vertical joint systems for substrates wherein engaged substrates can rotate or pivot relative to each other in either positive or negative (i.e. clockwise or anticlockwise) while maintain engagement In one aspect there is provided vertical joint system for a substrate having an opposed major first and second surfaces, the joint system comprising:

first and second non-symmetrical joints extending along opposite sides of the substrate, the first and second joints configured to enable two substrates with like joint systems to engage each other in response to a force applied in an engagement direction which is perpendicular to the major surfaces;

the first and second joints each provided with two laterally spaced transversely extending surfaces configured to enable the first joint of one substrate to engage the second joint of a second substrate with the two transversely extending surfaces of the first joint located relative to the two transversely extending surfaces of the second joint to form respective first and second locking planes on an innermost and an outermost side of each joint, each locking plane lying parallel to the engagement direction and wherein the transversely extending surfaces associated with each locking plane extend laterally toward each other from opposite sides of the locking plane with the transversely extending surfaces of the second joint overhanging the transversely extending surfaces of the first joint to inhibit separation if the engaged joints, wherein in at least one of the transversely extending surfaces associated with each locking plane has a curved profile.

In one embodiment the transversely extending surfaces are configured to enable relative rotation of two engaged substrates by up to 3° while maintaining engagement of the two substrates.

In one embodiment the transversely extending surfaces are configured to enable relative rotation of one of the engaged substrates relative to the other by an angle of between 7° to 10° in a direction into a surface of which the substrates are laid while maintaining engagement of the two substrates.

In one embodiment a void is created on at least one side of each locking plane by virtue of the non-symmetrical configuration of the first and second joints.

In one embodiment at least one of the transversely extending surfaces associated with at least one of the locking planes has a profile of a continuous convex curve.

In one embodiment at least one of the locking planes one of the transversely extending surface has a profile of a continuous convex curve and the other has a profile comprising one or more straight lines.

In one embodiment each of the transversely extending surfaces has a profile of a continuous convex curve.

In one embodiment two or more of the transversely extending surfaces have profiles of different continuous convex curves.

In one embodiment each joint comprises a protrusion extending in the engagement direction and an adjacent recess formed along a respective side of the substrate; and the transversely extending surfaces are formed on an outermost surface of each protrusion and an inner most surface of each recess.

In one embodiment the protrusion of the first joint has a bulbous profile with a neck of reduced width wherein a portion of the transversely extending surface on the protrusion of the first joint is adjacent an outermost side of the neck.

In one embodiment the recess of the second joint has a bulbous profile with a neck of reduced width wherein a portion of the transversely extending surface on the recess of the second joint is adjacent an outermost side of the neck.

In one embodiment a plane containing a line of shortest distance across the or each neck of is inclined relative to the major surfaces.

In one embodiment a plane containing a line of shortest distance across the or each neck lies in a plane inclined relative to the major surfaces.

In one embodiment the respective lines of shortest distance across each neck are parallel to each other.

In one embodiment the lines of shortest distance across each neck are collinear.

In one embodiment each transversely extending surface constitutes a portion of a respective inflexion surface.

In one embodiment each of the first and second joints is formed with a third transversely extending surface located between the two transversely extending surfaces of that joint, the third transversely extending surfaces relatively located to form a third locking plane disposed intermediate the first and second locking planes and wherein the third transversely extending surfaces associated with the third locking plane extend laterally toward each other from opposites of the third locking plane with the third transversely extending surface of the second joint in alignment with or overhanging the third transversely extending surface of the first joint.

In one embodiment the first and second joints are relatively configured to engage each other about a third locking plane inhibiting separation of the engaged joints in a direction parallel to the engagement direction, the third locking plane being disposed parallel to and between the first and second locking planes.

In one embodiment each of the first and second joints comprise a third transversely extending surface wherein the third transversely extending surfaces extend to opposite sides of the third locking plane when in the engaged joint.

In a second aspect there is provided vertical joint system for a substrate having an opposed major first and second surfaces, the joint system comprising:

first and second non-symmetrical joints extending along opposite sides of the substrate, the first and second joints configured to enable two substrates with like joint systems to engage each other in response to a force applied in an engagement direction which is perpendicular to the major surfaces;

the first and second joints each provided with two laterally spaced inflexion surfaces configured to enable the first joint of one substrate to engage the second joint of a second substrate with the two inflexion surfaces of the first joint engaging the two inflexion surfaces of the second joint on inner most and outer most sides of each joint to form respective first and second locking planes each of which independently inhibit separation of the engaged joints in a direction parallel to the engagement direction each locking plane lying parallel to the engagement direction and wherein the inflexion surfaces associated with each locking plane lie on both sides of that locking plane.

In one embodiment the inflexion surfaces are configured to enable relative rotation of two engaged substrates by up to 3° while maintaining engagement of the two substrates.

In one embodiment the inflexion surfaces are configured to enable relative rotation of one of the engaged substrates relative to the other by an angle of between 7° to 10° in a direction into a surface of which the substrates are laid while maintaining engagement of the two substrates.

In one embodiment each joint comprises a third inflexion surface and the respective third inflexion surfaces are relatively configured to engage each other to form a third locking plane disposed between the first and second locking planes.

In one embodiment a void is created on at least one side of each locking plane by virtue of the non-symmetrical configuration of the first and second joints.

In one embodiment at least one of the inflexion surfaces associated with each locking plane has a profile of a continuous curve.

In one embodiment one inflexion surface associated with one locking plane has a profile of a continuous curve and the other inflexion of that locking plane has a profile comprising one or more straight lines.

In one embodiment each of the inflexion surfaces has a profile of a continuous curve.

In one embodiment each joint comprises a protrusion extending in the engagement direction and an adjacent recess formed along a respective side of the substrate; and the inflexion surfaces associated with the first and second locking planes are formed on an outermost surface of each protrusion and an inner most surface of each recess.

In one embodiment the protrusion of the first joint has a bulbous profile having a neck of reduced width wherein a portion of the inflexion surface on the protrusion of the first joint is formed along an outermost side of the neck.

In one embodiment the recess of the second joint has a bulbous profile having a neck of reduced width wherein a portion of the inflexion surface on the recess of the second joint is formed along an outermost side of the neck.

In one embodiment a plane containing a line of shortest distance across the or each neck of is inclined relative to the major surfaces.

In one embodiment a plane contain a line of shortest distance across the or each neck lies in a plane inclined relative to the major surfaces.

In one embodiment the respective lines of shortest distance across each neck are parallel to each other.

In one embodiment the lines of shortest distance across each neck are collinear.

In a third aspect there is provided a vertical joint system for a substrate having an opposed major first and second surfaces, the joint system comprising:

non-symmetrical male and female joints extending along opposite sides of the substrate, the male and female joints configured to enable two substrates with like joint systems to engage each other in response to a force applied in an engagement direction which is perpendicular to the major surfaces;

the male joint comprising a male protrusion extending generally perpendicular from the first major surface toward the second major surface and a male recess formed inboard of the male protrusion; the female joint comprising a female protrusion extending generally perpendicular from the second major surface toward the first major surface and a female recess formed inboard of the female protrusion; the male joint having a first male locking surface formed on a side of its male protrusion most distant from its female recess, a second male locking surface formed on a side of its female recess most distant from its male protrusion and a third male locking surface being a surface common to the male protrusion and male recess; the female joint having a first female locking surface formed on a side of its female recess most distant from its male protrusion, a second female locking surface formed on a side of its male protrusion most distant from its female recess, and a third female locking surface being a surface common to the female protrusion and female recess; the locking surfaces being configured so that when a male and female joint of two substrates are engaged, the first male and first female locking surfaces engage to form a first locking plane, the second male and second female locking surfaces engage to form a second locking plane, and the third male and third female locking surfaces engage to form a third locking plane located between the first and second locking planes each locking plane inhibiting separation of the engaged joints in a direction parallel to the engagement direction.

In one embodiment the locking surfaces are configured to enable relative rotation of two engaged substrates by up to 3° while maintaining engagement of the two substrates.

In one embodiment the locking surfaces are configured to enable relative rotation of one of the engaged substrates relative to the other by an angle of between 7° to 10° in a direction into a surface of which the substrates are laid while maintaining engagement of the two substrates.

In one embodiment: at least one of the first male locking surface and the first female locking surface is provided with a smoothly curved transversely extending portion; and at least one of the second male locking surface and the second female locking surface is provided with a smoothly curved transversely extending portion.

In one embodiment the other of the first male locking surface and the first female locking surface is provided with a transversely extending portion comprising at least one planar surface.

In one embodiment the other of the second male locking surface and the second female locking surface is provided with a transversely extending portion comprising at least one planar surface.

In one embodiment each of first and second male and female locking surfaces comprises a smoothly curved transversely extending portion.

In one embodiment each of the first male locking surface, first female locking surface, second male locking surface and second female locking surface is formed with an inflexion; wherein the inflexions engage each other about the first and second locking planes.

In one embodiment at least one of the third male locking surface and the third female locking surface is formed with an inflexion.

In a fourth aspect there is provided a vertical joint system for a substrate having an opposed major first and second surfaces, the joint system comprising:

first and second non-symmetrical joints extending along opposite sides of the substrate, the first and second joints configured to enable two or more substrates with like joint systems to engage each other in response to a force applied in an engagement direction which is perpendicular to the major surfaces and to enable engaged substrates to be disengaged by lifting a first substrate in a direction opposite the engagement direction to facilitate rotation of adjacent engaged substrates along opposite sides of the first substrate to lie in planes declined from the first substrate and subsequently applying a force in the engagement direction to the second joints of the engaged substrates.

In one embodiment the first and second joints are each provided with two laterally spaced transversely extending surface portions configured to enable the first joint of one substrate to engage the second joint of a second substrate with the two transversely extending surfaces of the first joint located relative to the two transversely extending surfaces of the second joint to form respective first and second locking planes on an innermost and an outermost side of each joint, each locking plane lying parallel to the engagement direction and wherein the transversely extending portions associated with each locking plane extend laterally toward each other from opposites of the locking plane with the transversely extending portions of the second joint overhanging the transversely extending portions of the first joint.

In one embodiment at least one of the transversely extending surfaces associated with at least one of the locking planes has a profile of a continuous convex curve.

In one embodiment the first and second joints are each provided with two laterally spaced inflexion surfaces configured to enable the first joint of one substrate to engage the second joint of a second substrate with the two inflexion surfaces of the first joint engaging the two inflexion surfaces of the second joint on inner and outer most sides of each joint to form respective first and second locking planes each of which independently inhibit separation of the engaged joints in a direction parallel to the engagement direction each locking plane lying parallel to the engagement direction and wherein the inflexion surfaces associated with each locking plane lie on both sides of that locking plane.

In one embodiment the first joint is a male joint and the second joint is a female joint, the male joint comprising a male protrusion extending generally perpendicular from the first major surface toward the second major surface and a male recess formed inboard of the male protrusion; the female joint comprising a female protrusion extending generally perpendicular from the second major surface toward the first major surface and a female recess formed inboard of the female protrusion; the male joint having a first male locking surface formed on a side of its male protrusion most distant from its female recess, a second male locking surface formed on a side of its female recess most distant from its male protrusion and a third male locking surface being a surface common to the male protrusion and male recess; the female joint having a first female locking surface formed on a side of its female recess most distant from its male protrusion, a second female locking surface formed on a side of its male protrusion most distant from its female recess, and a third female locking surface being a surface common to the female protrusion and female recess; the locking surfaces being configured so that when a male and female joint of two substrates are engaged, the first male and first female locking surfaces engage to form a first locking plane, the second male and second female locking surfaces engage to form a second locking plane, and the third male and third female locking surfaces engage to form a third locking plane located between the first and second locking planes each locking plane inhibiting separation of the engaged joints in a direction parallel to the engagement direction.

In one embodiment the first and second joints are configured to create three locking planes when mutually engaged, each locking plane lying parallel to the engagement direction and inhibiting separation of engaged joints in a direction opposite the engagement direction.

In one embodiment when the substrate is in the configuration of a planar rectangular or square substrate having four sides, the first joint extends for two adjacent sides and the second joint extends for the remaining two adjacent sides.

In a fifth aspect there is provided a surface covering system comprising a plurality of substrates where in each substrate is provided with a vertical joint system in accordance with any one of the first to fourth and tenth aspects.

In a sixth aspect there is provided a semi-floating surface covering system comprising:

a plurality of substrates each substrate having a vertical joint system in accordance with any one of the first to fourth and tenth aspects;

a quantity of re-stickable adhesive bonded to the first major surface; and, one or more release strips covering the re-stickable adhesive.

In one embodiment the quantity of re-stickable adhesive is applied it two or more spaced apart lines extending in a longitudinal direction of the substrate.

In one embodiment the quantity of re-stickable adhesive is applied as a continuous strip or bead in at least one of the spaced apart lines.

In one embodiment the re-stickable adhesive is applied in a plurality of lines which are evenly spaced from each other and symmetrically disposed about a longitudinal centre line of the substrate.

In one embodiment the re-stickable adhesive has a thickness measured perpendicular to the first major surface of between 1-6 mm.

In one embodiment the re-stickable glue has a thickness of between 2-4 mm.

In one embodiment the quantity of adhesive comprises a quantity of joint adhesive bonded to the substrate and covered with a release strip, the joint adhesive located in a position wherein when the joint system of one substrate is coupled to the joint system of another substrate with the cover strip removed, the joint adhesive on the one substrate adheres to the joint of the other substrate.

In one embodiment the substrate is made from a material selected from the group consisting of; solid timber, engineered timber, laminate, Bamboo, plastics, and vinyl.

In a seventh aspect there is provided a method of manufacturing a semi-floating surface covering substrate comprising:

providing a surface covering system in accordance with the fifth aspect;

bonding a quantity of a re-stickable adhesive to the first major surface; and, covering the adhesive with a release strip.

In one embodiment bonding the adhesive comprises applying the adhesive in two or more spaced apart lines extending in a longitudinal direction of the substrate.

In one embodiment the bonding comprises applying the adhesive as a continuous strip or bead in at least one of the spaced apart lines onto the first major surface.

In one embodiment the method comprises applying the adhesive with a uniform thickness of between 1-6 mm measured in a direction perpendicular to the major surfaces.

In one embodiment the method comprises applying the adhesive with uniform thickness of between 2-4 mm.

In one embodiment the method comprises bonding a quantity of re-stickable adhesive to at least a portion of the joint and covering the adhesive in the joints with a release strip, the re-stickable adhesive being applied at a location on a first substrate wherein when the vertical joint systems of the first and a second substrate are coupled together with a release strip covering the adhesive in the joint of the first substrate being removed, the adhesive adheres to the joint of the second substrate.

In an eighth aspect there is provided a surface covering system comprising a plurality of substrates, each substrate having: opposite first and second major surfaces wherein the first major surface is arranged to face an underlying support to be covered by the system; and a vertical joint system, the vertical joint system comprising:

first and second non-symmetrical joints extending along opposite sides of a substrate, the first and second joints configured to enable two or more substrates to engage each other in response to a force applied in an engagement direction which is perpendicular to the major surfaces and to enable engaged substrates to be disengaged by: (a) lifting a first substrate in a direction opposite to the engagement direction to facilitate rotation of adjacent engaged substrates along opposite sides of the first substrate to lie in planes declined from the first substrate; and (b) subsequently applying a force in the engagement direction to the second joints of the engaged substrates.

In one embodiment the surface covering system comprises at least one a jack demountably attachable to the first substrate the jack comprising a shaft arranged to pass through a hole formed in the first substrate to bear on the underlying support, the jack being operable to extend the shaft through the hole to thereby lift the first substrate form the underlying support.

In one embodiment of the surface covering system the vertical joint system is in accordance with any one of the first to fourth and tenth aspects.

In one embodiment the surface covering system comprises a quantity of re-stickable adhesive bonded to the first major surface; and, one or more release strips covering the re-stickable adhesive.

In one embodiment the surface covering system comprises a quantity of re-stickable adhesive bonded to one or both of the first and second joints and respective release strips overlying the re-stickable adhesive bonded on the joints.

In one embodiment the vertical joint system comprises a quantity of re-stickable adhesive bonded to one or both of the first and second joints and respective release strips overlying the re-stickable adhesive bonded on the joints.

In a ninth aspect there is provided a substrate for a surface covering system, the substrate comprising a vertical joint system according to any one of the first to fourth and tenth aspects.

In one embodiment the substrate comprises a quantity of re-stickable adhesive bonded to one or both of the first and second joints and respective release strips overlying the re-stickable adhesive bonded on the joints.

In one embodiment of the substrate each joint provided with the bonded re-stickable adhesive is provide with a recess for seating the bonded re-stickable adhesive.

In one embodiment the substrate comprises a quantity of re-stickable adhesive bonded to the first major surface; and, one or more release strips covering the re-stickable adhesive on the first major surface.

In one embodiment the vertical joint system comprises a layer of wax being provide on surfaces of the joint which when engaged with a like joint engage to form the first and second locking planes.

In one embodiment of vertical joint system each recess of one substrate is provided with the joint system is configured to elastically open to enable a corresponding protrusion of a second substrate with a like joint system to like to enter and engage the recess.

In a tenth aspect there is provided a vertical joint system for a substrate having an opposed major first and second surfaces, the joint system comprising:

first and second non-symmetrical joints extending along opposite sides of the substrate, the first and second joints configured to enable two substrates with like joint systems to engage each other in response to a force applied in an engagement direction which is perpendicular to the major surfaces;

the first and second joints being configured to enable relative rotation of two engaged substrates by up to 3° while maintaining engagement of the two substrates.

In one embodiment of the tenth aspect the first and second joints are each provided with two laterally spaced generally convex surfaces configured to enable the first joint of one substrate to engage the second joint of a second substrate with the two generally convex surfaces of the first joint located relative to the two generally convex surfaces of the second joint to form respective first and second locking planes on an innermost and an outermost side of each joint, each locking plane lying parallel to the engagement direction and wherein the generally convex surfaces associated with each locking plane extend laterally toward each other from opposite sides of the locking plane with the generally convex surfaces of the second joint overhanging the generally convex surfaces of the first joint to inhibit separation if the engaged joints, wherein in at least one of the generally convex associated with each locking plane has a curved profile.

In one embodiment of the tenth aspect each joint comprises a protrusion extending in the engagement direction and an adjacent recess formed along a respective side of the substrate; and the transversely extending surfaces are formed on an outermost surface of each protrusion and an inner most surface of each recess.

In one embodiment of the tenth aspect each recess configured to elastically open to enable a protrusion of a substrate with a like joint system to like to enter and engage the recess.

In one embodiment of the tenth aspect the first and second joints are configured to form a third locking plane intermediate the first and second locking planes.

BRIEF DESCRIPTION OF THE DRAWINGS

Notwithstanding any of forms which may fall within the scope of the joint system as set forth in the Summary, specific embodiments will now be described, by way of example only, with reference to the accompanying drawings in which:

FIG. 3*a* illustrates the ability of engaged panels incorporating the vertical joint system to rotate in a first direction relative to each other;

FIG. 3*b* illustrates the ability of engaged panels incorporating the vertical joint system to rotate in a second opposite direction relative to each;

FIG. 4*a* illustrates the effect of lateral bowing of a substrate overlying a depression or hollow in a supporting surface;

FIG. 4*b* is an enlarged view of detail A marked on FIG. 4*a;*

FIG. 4*c* illustrates the effect of lateral bowing of a panel when overlying a hump or rise in an underlying surface;

FIG. 4*d* is an enlarged view of detail B marked on FIG. 4*c;*

FIG. 24*a* depicts a panel provided with incorporating any embodiment of the vertical joint system with the addition of a re-stickable adhesive laid as strips;

FIG. 24*b* is a view of section AA of the panel shown in FIG. 24*a;*

FIG. 24*c* shows the panel of FIGS. 24*a* and 24*b* when adhered to an underlying supporting surface;

FIG. 25*a* depicts a panel provided with any embodiment of the vertical joint system with the addition of a re-stickable adhesive laid as beads;

FIG. 25*b* shows the panel of FIG. 25*a* when adhered to an underlying supporting surface;

DETAILED DESCRIPTION OF SPECIFIC EMBODIMENTS

Figure 1A:
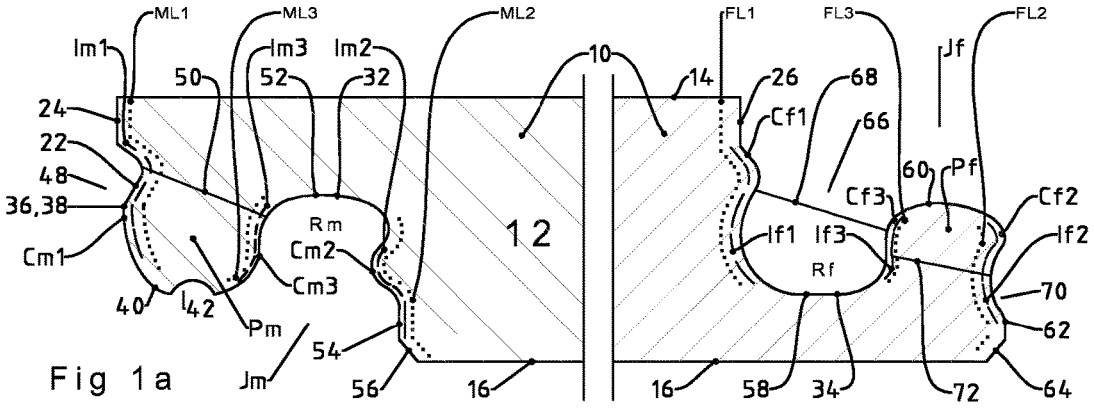
FIG. 1*a* is a section view of a panel incorporating an embodiment of the vertical joint system.
Figure 1B:
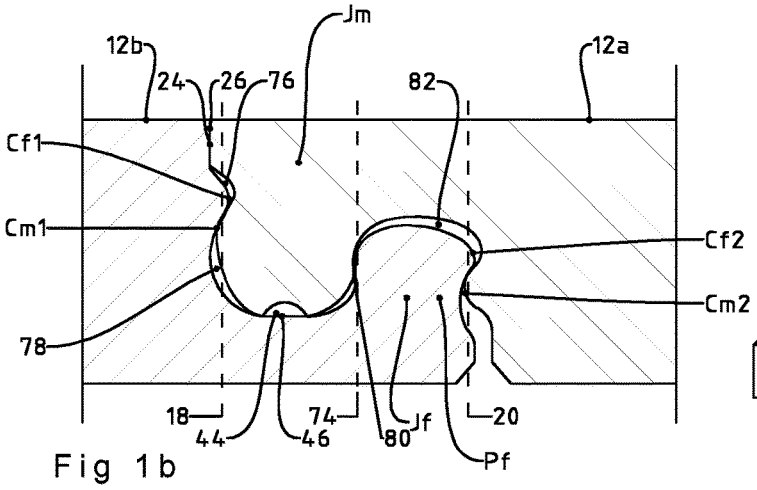
FIG. 1*b* is a cross section view of a portion of two panels incorporating the vertical joint system in an engaged state.
Figure 2:
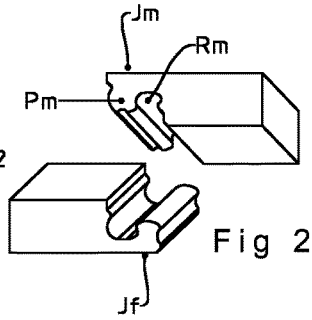
FIG. 2 is an isometric view of a portion of two panels incorporating the vertical joint system when in a disengaged state.

FIGS. 1*a*-2 illustrate a first embodiment of a vertical joint system 10 (hereinafter referred to as "joint system 10") for a substrate. The substrate is shown in cross section view and in this embodiment is in the form of an elongated rectangular panel 12. The substrate or panel 12 has opposed major first and second surfaces 14 and 16 respectively. Each of the surfaces 14 and 16 are planar surfaces and lie parallel to each other. In one orientation the surface 14 is an exposed surface of the panel 12 while the surface 16 bears against a support surface or structure such as but not limited to a concrete, timber, tile or vinyl floor or timber battens. Joint system 10 comprises a first joint Jm and a non-symmetrical second joint Jf. The first joint Jm can be notionally considered to be a male joint while the second joint Jf can be notionally considered to be a female joint. This designation of the joints will be explained shortly.

Assuming the substrate to be in the shape of a quadrilateral the joint Jm extends along two adjacent sides and Jf extend along the remaining two adjacent sides. For example when the substrate is an elongated rectangular floor board as shown in FIGS. 1*b* and 1*c* the joint Jm extends along one longitudinal side and an adjacent transverse side, while the joint Jf extends along the other (i.e. opposite) longitudinal side and the other (i.e. opposite) adjacent transverse side.

FIG. 1*b* illustrates a first joint Jm of a first panel 12*a* engaged with a second joint Jf of a second panel 12*b* having an identical joint system 10. For ease of description the panels 12*a* and 12*b* will be referred to in general as "panels 12".

As will be explained in greater detail shortly, the first and second joints Jm and Jf are configured to enable two panels 12 (i.e. panels 12*a* and 12*b*) to engage each other in response to a pressure or force F (see FIG. 5) applied in an engagement direction D which is perpendicular to the major surfaces 14 and 16. When the panels 12 are floor panels the direction D lies in the vertical plane and more particularly is directed downwardly toward a surface on which the panels are laid. This is equivalent to the joints Jm and Jf engaging by virtue of motion of one joint (or substrate) relative to another in a direction perpendicular to a plane containing the major surfaces.

The joint Jm comprises a male protrusion Pm and a male recess Rm, while the joint Jf comprises a female protrusion Pf and a female recess Rf. The first joint Jm is notionally designated as the male joint by virtue of its protrusion Pm depending from the upper surface 14. The second joint Jf is notionally designated as the female joint by virtue of its recess Rf being configured to receive the protrusion Pm.

When describing features or characteristic common to all protrusions the protrusions will be referred to in general in this specification in the singular as "protrusion P", and in the plural as "protrusions P". When describing features or characteristic common to all recesses the recesses will be referred to in general in this specification in the singular as "recess R", and in the plural as "recesses R". When describing features or characteristic common to all joints the joints will be referred to in general in this specification in the singular as "joint J", and in the plural as "joints J".

The male joint Jm has first, second and third male locking surfaces ML1, ML2 and ML3 respectively (referred to in general as "male locking surfaces ML"). Each of the male locking surfaces ML extends continuously in the general direction perpendicular to the major surfaces. Similarly the female joint Jf has first, second and third female locking surfaces FL1, FL2 and FL3 respectively, (referred to in general as "female locking surfaces FL"). The male and female locking surfaces collectively and generally are referred to locking surfaces L.

Each of the locking surfaces L extends continuously in the general direction perpendicular to the major surfaces. The expression "extend continuously in the general direction perpendicular to the major surfaces" in the context of the male and female locking surfaces is intended to denote that the surfaces extend generally between the opposite major surfaces but continuously so that it extends in one direction only, i.e. always in the direction of the surface 14 to the surface 16 or vice versa and thus does not return upon itself as would be the case for example if the surface included a barb or hook like structure.

The male locking surface ML1 extends from an edge of the major surface 14 adjacent the protrusion Pm and down the adjacent side of the protrusion Pm to appoint prior to the surface of the protrusion Pm turning through greater than 45° from the perpendicular to the major surface 14. It will be noted that the locking surface ML1 extends continuously in the general direction perpendicular to the major surface 14, without returning upon itself. Thus every point on the surface ML1 lies on a different horizontal plane. In contrast, in the event that a hook or barb like structure were provided then the corresponding surface would turn upon itself and a plane parallel to the major surface 14 would insect the surface at three different locations.

The male locking surface ML2 extends from the second major surface 16 up along an adjacent side of the recess Rm to a point prior to the deepest portion of the recess Rm turning through more than 45° toward the protrusion Pm. Finally, the third male surface ML3 extends along a shared or common surface between a protrusion Pm and Rm and denoted by end points prior to the surface turning through more than 45° to the perpendicular at the deepest portion of the recess Rm, or the most distant portion of the protrusion Pm.

As will be explained shortly, the first and second male and female locking surfaces engage about respective locking planes inhibiting vertical separation of engaged joints Jm and Jf. The third male and female locking planes ML3 and FL3 may also be configured to form a third locking plane. Also, the locking surfaces L in various embodiments comprise inflexion surfaces which in turn may comprise transverse outward extending surfaces which may take the form of convex or cam surfaces, or bulges. The relationship between the locking surfaces L, inflexion surfaces and transverse outward extending surfaces will be apparent in the following description.

Looking at the configuration of the first and second joints Jm and Jf (referred to in general as "joints J") more closely, it will be seen that each of these joints is provided with two laterally spaced apart transversely outward extending surfaces or bulges. The transversely extending surfaces bulges may also be considered and termed as "cam surfaces" as they move across and in contact with each other and at times often with a rolling or pivoting action. The transversely extending surfaces are designated as Cm1 and Cm2 on the first joint Jm and Cf1 and Cf2 on the joint Jf. In many embodiments transversely extending surfaces are smoothly curved convex surfaces. However as will be apparent from the following description is some embodiments the transversely extending surfaces are of other configurations. For example a transversely extending surface may be generally convex in that the surface is not continuously or smoothly curved for its entire length but is composed of one or more straight/planar surfaces. For ease of reference the transversely extending surfaces on the male joint Jm will be referred to "surface Cmi" where i=1, 2, 3 and similarly the transversely extending surfaces on the female joint Jf will be referred to "surface Cfi" where i=1, 2, 3.

The surface Cm1 is formed on a protrusion Pm of a first joint Jm while the surface Cm2 is formed in a recess Rm of joint Jm. Similarly the surface Cf2 is formed on a protrusion Pf on the joint Jf while the surface Cf1 is formed in a recess Rf of the second joint Jf. (For ease of description the surfaces Cm2 and Cm1 will be referred to in general as "surface Cm"; surfaces Cf1 and Cf2 will be referred to in general as "surface Cf"; and collectively the surfaces Cm2, Cm1, Cf1 and Cf2 will be referred to in general as "surfaces C").

FIG. 1*b* depicts the joints J in an engaged state. As is evident when the joints J are engaged their respective transversely extending surfaces are located relative to each other to form respective first and second locking planes 18 and 20 which inhibit the separation of the engaged joints in a direction opposite the engagement direction D.

Each locking plane 18, 20 lies parallel to the engagement direction D. The transversely extending surfaces Cm1, Cf1, Cm2, Cf2 associated with each locking plane extend laterally toward each other from opposite sides of the locking plane with the transversely extending surfaces of the second or female joint (i.e. Cf1 and Cf2) overhanging the transversely extending surfaces of the first or male joint (i.e. Cm1 and Cm2). This inhibits separation of the engaged joints Jm and Jf. It will also be noted that at least one of the transversely extending surfaces associated with each locking plane has a curved profile. In this instance the surface Cf1 associated with locking plane 18, and both surfaces Cf2 and Cm2 associated with locking plane 20 have curved profiles.

During the engagement of the joints Jm and Jf the surfaces Cm1 and Cm2 pass and snap over the surfaces Cf1 and Cf2. This action is enabled by one or both of resilient compression of the protrusions Pm and Pf and resilient tension in the recesses Rm and Rf as the surfaces Cm pass the surfaces Cf in response to application of the force F. Whether there is one or both of resilient compression of the protrusions Pm and Pf and resilient tension in the recesses Rm and Rf is dependent on the material from which the panel 12 is made. For example in the case of a panel made from a very stiff or hard material such as strand bamboo there would be very little compression of the protrusions P but tension in the recess R which results in its opening or widening would allow for the engagement. The ability for the protrusions P to enter the recesses R is assisted by the provision of a lubricant such as wax on the joints Jm and Jf. The provision of the lubricant and in particular wax also substantially eliminates joint noise and aids in the ability of adjacent engaged joints J to rotate relative to each other. This rotation motion is describe later in the specification.

Horizontal separation between engaged joints Jm and Jf is inhibited by the seating of the protrusions P in the respective recesses R. The joints Jm and Jf are also provided with respective planar abutment surfaces 24 and 26. The surfaces 24 and 26 extend from opposite edges of and perpendicular to the major surface 14. The respective surfaces Cm and Cf are configured to create lateral compression forces between the surfaces 24 and 26 maintaining them in contact thus preventing the creation of a gap between joined panels 12*a* and 12*b*.

Accordingly as described above, the surfaces Cm and Cf co-operate to provide both vertical and horizontal arrestment of panels 12*a* and 12*b* when the respective joints Jm and Jf are engaged. However in addition to this the surfaces Cm and Cf enable limited relative rotation between panels 12*a* and 12*b* while maintaining engagement of the panels 12. This is depicted in FIGS. 3*a* and 3*b*.

FIG. 3*a* shows the panel 12*a* being rotated by −3° (3° in an anticlockwise direction) relative to the panel 12*b*. The rotation is facilitated by pivoting at an upper corner of surface 24 on surface 26. This rotates the protrusion Pm within recess Rf and causes the surface cam Cm2 to ride or roll up, but not past the apex of, the surface Cf2. The projection Pf is now effectively pinched between the surfaces Cm2 and Cm3. In this configuration vertical separation between the substrates 12*a* and 12*b* is inhibited by this pinching effect as well as due to the surface Cm1 remaining below surface Cf1. Horizontal arrestment is maintained by virtue of the projections Pm and Pf remaining within respective recesses Rm and Rf.

With reference to FIG. 3*b*, the panel 12*a* is rotated by −3° (3° in a clockwise direction) relative to panel 12*b*. This is facilitated by the surface Cm2 rolling down and acting as a pivot or fulcrum point against the side of Joint Jf containing the surface Cm2. This causes separation of the surfaces 24 and 26 creating a gap at the upper major surfaces 14. Nevertheless the panels 12*a* and 12*b* remain vertically and horizontally engaged. Vertical arrestment between the substrates is maintained by engagement of the surfaces Cm2 and Cf2; and surfaces Cm1 and Cf1. Horizontal arrestment is provided by the projections Pm and Pf being maintained in their recess Rf and Rm.

The relative rotation between the panel 12*a* and 12*b* is of great assistance in the installation of the substrates particularly on uneven surfaces such as an undulating concrete floor. This is of great importance to the "do-it-yourself" user although benefits also flow through to the professional layer. Consider for example an uneven undulating surface on which it is desired to lay a click type floor covering having say a prior art joint system where the tongue is inserted laterally or at an inclined angle into a groove or recess. The undulation may be in the form of a concave recess or shallow in a portion of the surface having a width several times greater than the width of the panels. Depending on the degree or slope of the concavity it may be extremely difficult if not impossible to insert a tongue of a "to be" installed panel into the groove of a previously laid panel. This arises because the two panels do not and will not lie in the same plane, but rather are angled relative to each other due to the concavity.

Additionally, when installing floor boards of a length of about 1 m or longer on an uneven surface, banana-ing or lateral bowing occurs of the previously installed floor board by virtue of an installer kneeling on it when trying to lay the next floor board. The kneeled on board will bow under the weight of the installer due to the uneven underlying surface. This effect is depicted in FIGS. 4*a* to 4*d*. FIGS. 4*a* and 4*b* show lateral bowing of a panel 12*x* outwardly when the uneven surface is a fall or hollow. FIGS. 4*c* and 4*d* show lateral inward bowing of a panel 12*x* when the uneven surface is a hump. It will be appreciated that this bowing makes it very difficult to get full longitudinal engagement with an adjacent panel without gapping. In these circumstances, even professional installers have difficulty in laying the floor and will need to rely on substantial physical exertion and experience. The do-it-yourself installer will often give up and either returns the flooring to the retailer on the basis that it does not "click" together or end up paying for a profession installer.

To provide perspective of the effect of the relative rotation capabilities of the joint system 10 in comparison to the prior art reference made to FIGS. 4*e* to 4*h*. Conventional flooring systems are able to accommodate a concavity or a hump in an underlying substrate for example a concrete floor of 3-5 mm over a length of 1 m, being the industry standard. Undulations greater than this either prohibit the use of many prior art systems or at least make them very difficult to install. Assuming that they can be installed the undulation can subsequently cause prior art joint systems to disengage horizontally and thus gap excessively. Specifically in the event that the undulation is in the form of a hump or undulation there is the possibility of either total horizontal separation between the adjacent panels and/or splitting or shearing of the joints. In the event that the undulation is a concavity prior art joints are liable to shear or break due to excessive tensile force being applied to the joints.

Figure 4E:
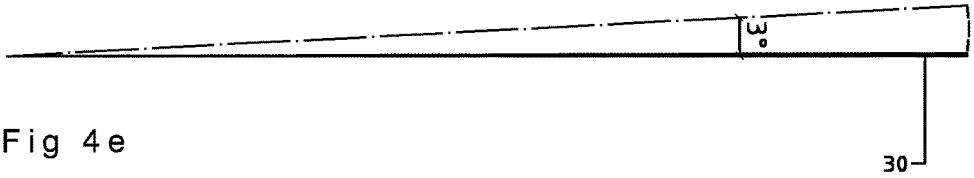
FIG. 4*e* is a schematic representation providing a comparison in the ability to accommodate surface a hump or rise between prior art joint systems and vertical joint systems in accordance with embodiments of the present invention.
Figure 4F:
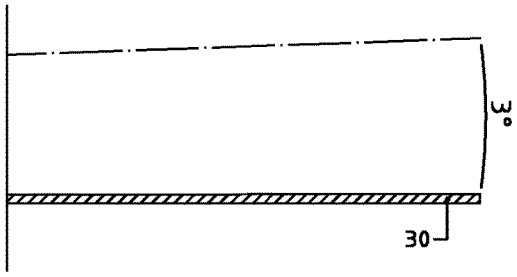
FIG. 4*f* is an enlarged view of detail C marked on FIG. 4*e;*
Figure 4G:
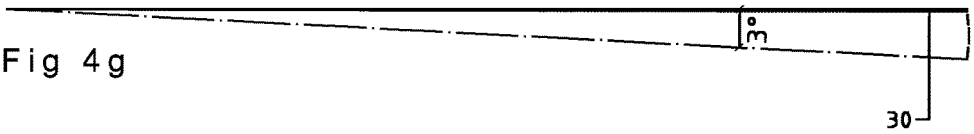
FIG. 4*g* is a schematic representation providing a comparison in the ability to accommodate surface a hollow or dip between prior art joint systems and vertical joint systems in accordance with embodiments of the present invention.
Figure 4H:
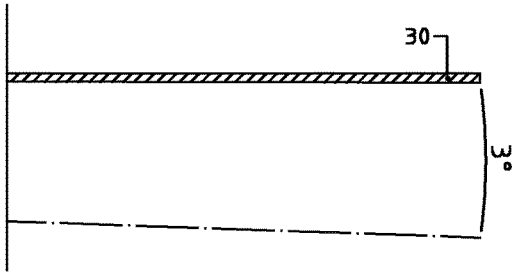
FIG. 4*h* is an enlarged view of detail D marked on FIG. 4*g;*

In FIGS. 4*e* to 4*h* (which are schematic only and not drawn to scale) the 3-5 mm surface undulation which can be accommodated by the prior art system is shown as shaded area 30. FIGS. 4*e* and 4*f* represent an undulation in the form of a rise or hump of 3-5 mm, whereas FIGS. 4*g* and 4*h* represent an undulation in the form of a fall or hollow of 3-5 mm. In comparison the + or −3° rotation available by embodiments of the joint system 10 over a 1 m length provide a total possible displacement of 52 mm. The +3° rotation is illustrated in FIGS. 4*e* and 4*f*, while the −3° rotation is illustrated in FIGS. 4*g* and 4*h*. This enables substrates utilising embodiments of the joint system 10 to be successfully laid on floors without horizontal disengagement or separation where the floor may have for example a concave undulation which over a distance of one meter drops by 52 mm below adjacent planar surface portion of the floor. Maintaining horizontal engagement maintains the structural integrity of the floor. This is beneficial in terms of the appearance of the floor which in turn can add value to an associated house.

It will be recognised by those skilled in the art that this enables the laying of a flooring system incorporating the embodiments of the current joint system on substrates that fall outside of 3-5 mm undulation over a length of 1 m dictated by the world industry standards. This has significant practical and commercial benefits. The practical benefits are that the flooring will be able to be successfully and easily laid by do-it-yourself installers and professional installer on substrates that hitherto were unsuitable for conventional click type flooring. The commercial benefit is that because the flooring systems can be laid they are not returned to the point of sale by disgruntled and frustrated installers requesting a refund for a system that, in their eye, does not work. The conventional systems will work if the substrate is within the narrow band prescribed as the world industry standard. But the installer is usually unaware of the standard and in any event has not idea as to whether or not their substrate complies. This is not an issue with embodiments of the present invention as it is able to be installed without separation on substrates that fall outside of the world industry standards.

Returning to FIGS. 1 and 2, it can be seen that the surfaces Cm and Cf constitute portions of respective inflexion surfaces, which in turn form portions of respective locking surfaces L. Specifically, the surface Cm1 constitutes a part of an inflexion surface Im1 (indicated by a phantom line) which in turn forms part of first male locking surface ML1 (indicated by broken dot line) of the protrusion Pm. The inflexion surface Im1 extends generally in the direction D from the abutment surface 24.

Similarly surface Cm2 constitutes a portion of inflexion surface Im2 (indicated by a phantom line) which in turn forms part of second male locking surface ML2 (indicated by broken dot line). Surface ML2 is formed on the surface of recess Rm and depends generally in the direction D from near a root 32 of the recess Rm.

The surface Cf2 constitutes part of an inflexion surface If2 (indicated by a phantom line) which in turn forms part of second female locking surface FL2 (indicated by broken dot line) formed on an outer most side of the projection Pf and extending generally in the direction parallel to the direction D.

The surface Cf1 constitutes part of the inflexion surface If1 (indicated by a phantom line) which in turn forms part of first female locking surface FL1 (indicated by broken dot line). Surface FL1 depends from abutment surface 26 and in a direction generally parallel to direction D and toward a root 34 of the recess Rf.

Looking at FIG. 1*b*, it will be seen that the surfaces Cm1,Im1 and ML1 engage the surfaces Cf1, If1 and FL1 respectively; and the surfaces Cm2, Im2 and ML2 engage the surfaces Cf2, If2 and FL2 when the joints Jm and Jf are engaged. The engagement of these surfaces forms or create the first and second locking planes 18, 20. Different portions of the locking L, inflexion I and transversely extending surfaces C operate as arresting and rolling surfaces during various stages of engaging and disengaging of the joints Jm and Jf.

To provide the rolling action between adjacent engaged substrates at least one of the surfaces C and indeed one of inflexion surfaces I in each pair of engaged or related surfaces is formed with a profile of a continuous or smooth curve. For example consider the surfaces Cm1 and Cf1 and corresponding inflexion surfaces Im1 and If1. When the joints Jm and Jf are engaged, surfaces Cm1 and Cf1 are located about or adjacent the first locking plane 18; as are corresponding inflexion surfaces Im1 and If1. In this instance the surface Cf1 and the corresponding inflexion surface If1 has a profile of a continuous or smooth curve. However the surface Cm1 and corresponding inflexion surface Im1 has a profile which comprises a straight line 36. The straight line is relatively short and forms a small ridge or peak 38 on the surface Cm1 and inflexion surfaces Im1. The ridge 38 presents a relatively small contact area against the inflexion surface If1 minimising the friction between the surfaces and the possibility of sticking during relative rotational motion.

In contrast, the surfaces Cm2 and Cf2; and corresponding inflexion surfaces Im2 and If2 which are located about and form the second locking plane 20 each have a profile of a continuous curve. However other embodiments will be described later in which one of the surfaces Cm2/Im2 or Cf2/If2 has a profile comprising one or more straight lines.

The first and second male locking surfaces ML1 and ML2, and indeed the associated surfaces Cm1 and Cm2 and corresponding inflexion surfaces Im1 and Im2 constitute the extreme (i.e. inner most and outer most) transversely extending and inflexion surfaces of the first (male) joint Jm. The first and second female locking surfaces FL1 and FL2, and indeed the associated surfaces Cf1 and Cf2 and inflexion surfaces If1 and If2 constitute the extreme transversely extending and inflexion surfaces of the second (female) joint Jf. These extreme transversely extending and inflexion surfaces form respective surface pairs which create the extreme (i.e. inner most and outer most) locking planes 18 and 20 in mutually engaged joints Jm and Jf. This is clearly evident from FIG. 1*b*. Specifically the surface pairs are in this embodiment: Im1 and If1, or Cm1 and Cf1; and, Im2 and If2, or Cm2 and Cf2. The above described relative rotation between panels incorporating embodiments of the joint system 10 is facilitated by forming one surface in each of the surface pairs as a smoothly or continuously curved surface.

The surfaces Cm1 and Im1 form part of an outer peripheral surface 40 of the protrusion Pm. The protrusion Pm has a generally ball like or bulbous profile which depends in the direction D from major surface 14. The outer surface 40 after the inflexion surface Im1 curves toward the recess Rm. The surface 40 is provided with a recess 42 at a location most distant the major surface 14. As shown in FIG. 1*b*, when the joints Jm and Jf are engaged the recess 42 forms a reservoir 44 against a lower most portion of surface 46 of the recess Rf. Save for the recess 42 the end of the protrusion Pm facing the bottom of recess Rf1 is rounded or curved. The first male locking surface ML1 comprises the combination of surface 24 and the inflexion surface Im1.

The recess 42 and corresponding reservoir 44 may be used for various different purposes. These include but are not limited to receiving adhesive and/or sealing compound; acting as a reservoir for debris which may have fallen into the recess Rf during installation, or both. In this regard the recess 42 faces a lowest part of the surface 46 in the recess Rf. It is expected that most debris falling into the recess Rf will collect at the lowest point on the surface 46. As the joints Jm and Jf are engaged by a vertical motion a substantial proportion of any debris is likely to be captured in the subsequently created reservoir 44. In the absence of such a feature, it may be necessary to clean the recess Rf for example by blowing with compressed air, use of a vacuum or a broom to remove debris which may otherwise interfere with the engagement process. The recess 42/reservoir 44 can also accommodate expansion and contraction in the joints J.

The surface 40 after the recess 42 curves around to the recess Rm and incorporates a further inflexion surface Im3. The inflexion surface Im3 is a "shared" surface between the protrusion Pm and recess Rm and includes a surface Cm3. The surface Cm3 transitions the surface 40 from a generally horizontal disposition to a generally vertical disposition. The third male locking surface ML3 is substantially co-extensive with the inflexion surface Im3.

It will be noted that the protrusion Pm is formed with a neck 48 having a reduced width in comparison to other portions of the protrusion Pm. It will be seen that the surface Cm1 is adjacent an outer most side of the neck 48. Moreover, a portion of the inflexion surface Im1 adjacent the abutment surface 24 forms the outer most side of the neck 48. Further, a portion of the inflexion surface Im3 forms the opposite side of neck 48. In this embodiment a line 50 of shortest distance across the neck 48 is inclined relative to the major surface 14.

The inflexion surface Im3 leads to surface 52 formed in the root 32 of the recess Rm. The surface 52 curves around to meet with and join inflexion surface Im2. The surface Im2 extends generally in the direction D leading to a surface 54 which extends perpendicular to the major surfaces 14 and 16 and subsequently to a bevelled surface 56 which leads to the major surface 16. The second male locking surface extends from above the inflexion surface Im2 and along the bevelled surface 56 to the major surface 16.

Looking at the configuration of the joint Jf on an opposite side of panel 12, it can be seen that the surface Cf1 and corresponding inflexion surface If1 extend generally in the direction D from the abutment surface 26. The first female locking surface FL1 comprises the combination of surfaces 26 and If1. The inflexion surface If1 leads to the surface 46 at the root 34 of recess Rf. The surface 46 forms a vertical arrestment surface for the protrusion Pm. Moreover the surface 46 includes a centrally located substantially horizontal land 58 which faces the recess 42 when the joint Jm is inserted in the joint Jf. The land 58 lies substantially parallel to the major surfaces 14 and 16. Moving in a direction toward the protrusion Pf, the surface 46 leads to and incorporates a further inflexion surface If3 and corresponding co-extensive third female locking surface FL3. The surfaces If3 and FL3 are shared surfaces between recess Rf and protrusion Pf and extends in a direction generally opposite the direction D.

The inflexion surface If3 leads to an upper arcuate surface portion 60 of the projection Pf which in turn leads to the surface Cf2 and inflexion surface If2. The inflexion surface If2 leads to the planar surface 62 that extends perpendicular to the major surfaces 14 and 16. This surface in turn leads to inclined surface 64 in turn leads to the major surface 16. The second female locking surface comprises the combination of surfaces If2, 62 and 64.

The recess Rf is configured to receive the protrusion Pm. Moreover, the recess Rf is formed with a neck 66. The neck forms a restricted opening into the recess Rf. A line 68 of shortest distance across the neck 66 is in this embodiment inclined relative to the major surfaces 14 and 16. More particularly, the line 66 is inclined at substantially the same angle as the line 50.

The protrusion Pf like protrusion Pm is of a ball like or bulbous configuration. Further, similar to the protrusion Pm, the protrusion Pf is formed with a neck 70 of reduced width. A line 72 of shortest distance across the neck 70 is inclined to the major surfaces 14 and 16. However in this embodiment the line 70 is inclined at a different angle to the lines 50 and 68.

With reference again to FIG. 1*b*, it is also seen that the shared locking and inflexion surfaces ML3 and FL3; and Im3 and If3 respectively, and indeed their corresponding surfaces Cm3 and Cf3 are located relative to each other to form a third locking plane 74 along which separation of the engaged joints J is inhibited. The third locking plane 74 is parallel with and between the inner and outer most locking planes 18 and 20.

The joints Jm and Jf are based in part on anatomical joints of the human body and in particular the hip joint and shoulder joint. These joints Jm and Jf are designed to provide horizontal and vertical strength and allow relative rotational motion to a limited extent without disengagement. In effect the joints Jm and Jf can be considered as ball and socket type joints. The comparison with anatomical joints is enhanced in some embodiments described hereinafter which include a re-stickable flexible, elastic and non-curing or non-solidifying adhesive acting between the joints Jm and JF. In such embodiments the adhesive acts in a manner akin to both a tendon allowing relative motion but maintaining connection, and as cartilage providing a cushioning effect. Also when wax is provided on the joints can act as a fluid in the joint providing lubrication.

It is further evident from FIG. 1*b* that due to their non-symmetrical nature the joints Jm and Jf are relatively configured so that when they are engaged several spaces or gaps are formed between the engaged joints. A space 76 is formed immediately below the abutment surfaces 24 and 26 and opposite the surface Cf1. The space 76 may also be described as being a space formed between respective upper portions of the inflexion surfaces Im1 and M. Space 78 is formed between lower parts of inflexion surfaces Im1 and If1. A generally vertically extending space 80 is formed between the shared inflexion surfaces Im3 and If3; and a generally horizontal space 82 is formed between the root 32 of recess Rm and arcuate surface portion 60 of the projection Pf. The spaces allow thermal expansion and contraction of the panels 12 without dislocation or fracturing of the joints Jm and Jf as well as assisting in the relative rotation of the panels 12.

The engagement and disengagement of the joints Jm and Jf will now be described in detail with reference to FIGS. 5*a*-9*f*.

Figure 5A:
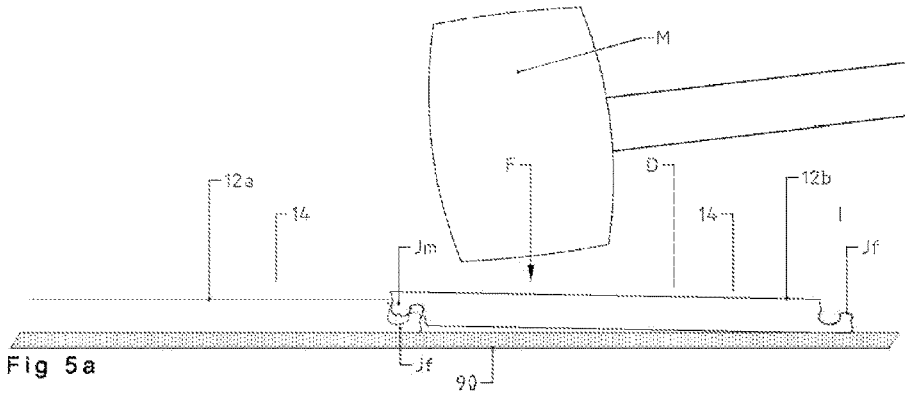
FIG. 5*a* is a representation of the relative juxtaposition of panels incorporating the present vertical joint system being ready for engagement.

FIG. 5*a* depicts a first panel 12*a* which has already been laid and a second panel 12*b* which is in the process of being laid. The panels 12*a* and 12*b* are supported on an underlying horizontal surface 90. Panel 12*a* has a joint Jf which is open and ready for connection with the joint Jm of panel 12*b*. Panel 12*b* is laid adjacent panel 12*a* with the joint Jm resting on the joint Jf. The edge of panel 12*b* provided with the joint Jf is simply resting on the surface 90 so that there is a small angle of approximately 1°-3° between the panels 12*a* and 12*b*.

Figure 5B:
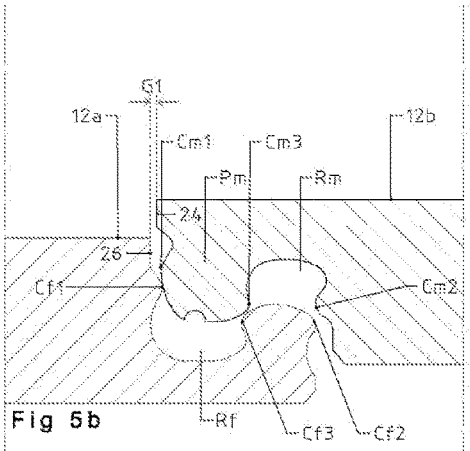
FIGS. 5*b*-5*e* depict sequentially the engagement of panels incorporating embodiments of the vertical joint system from a point of initial contact in FIG. 5*b* to complete engagement in FIG. 5*e;*

From FIG. 5*b* it will be seen that in this position surfaces Cm1 and Cm3 rest on the surfaces Cf1 and Cf3 respectively while the surfaces Cm2 and Cf2 are vertically separated. In this configuration upper portions of the surfaces Cf1 and Cf3 may be considered as cam arresters in that they prohibit the entry of the projection Pm into the recess Rf.

In order to commence engagement of the surfaces Jm and Jf a downward pressure or force F is applied in the direction perpendicular to the major surfaces 14 and directed toward the underlying surface 90. This pressure or force applies compression to the protrusion Pm and tension the recess Rf which depending on the material from which the panels 12 are made will result in one or both of the protrusion Pm compressing and the recess Rf opening or widening so that the surfaces Cm1 and Cm3 can slide past the surfaces Cf1 and Cf3. Again the provision of wax on the joints Jm and Jf assist this sliding action. This results in the protrusion Pm sliding through the neck 66 into recess Rf. The opening the recesses Rm and Rf generates stress in the joints shown by lines T in FIG. 5*c*. This stress is about the curvature at opposite ends of the root of each recess Rf and Rm. The stress is released as the protrusions Pm and Pf pass through the necks of the recesses Rf and Rm providing a spring action closing the recesses onto the protrusions and drawing the protrusions into the recesses. Thus the recesses are able to elastically open and subsequently self close. This action occurs with the other embodiments of the joint system described later in the specification.

The joints in this embodiment are configured so that the respective surfaces Cm and Cf which pass each other do so at slightly different times. In this particular embodiment the surface Cm1 passes the surface Cf1 marginally before the surface Cm3 passes the surface Cf3. Once the surfaces Cm1, Cm3 pass surfaces Cf1, Cf3 the remainder of protrusion Pm is drawn into the recess Rf by an over centre or snap action. This is due to the relative configuration of the inflexion surfaces and the release of compression in the protrusion Pm after the surfaces Cm1 and Cm3 pass through the surfaces Cf1 and Cf3. In effect the respective necks 48 and 66 lay one within the other.

Figure 5D:
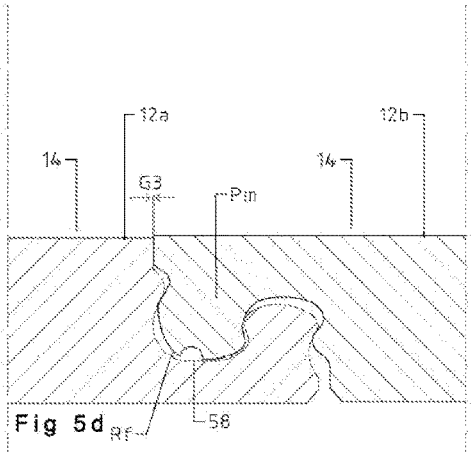
Figure 5C:
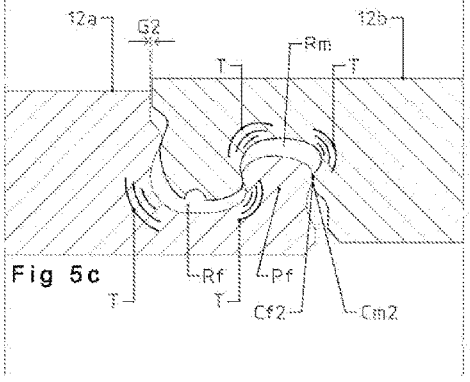

Simultaneously with this action occurring, a similar action is occurring in relation to the protrusion Pf and the recess Rm. The surface Cm2 passes the surface Cf2 marginally after passing of the surfaces Cm3 and Cf3. This is depicted in FIG. 5*c*. As the recess Rm is pushed onto the protrusion Pf, by action of the downward pressure or force F, the protrusion Pf is compressed between the surfaces Cf3 and Cf2. After these surfaces pass the surfaces Cm3 and Cm2 the recess Rf is drawn onto the protrusion Pf by an over centre or snap action.

Figure 5E:
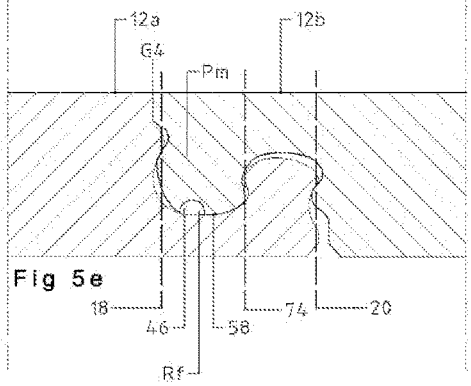

While the joints J are engage by application of pressure or force in a vertical direction (i.e. perpendicular the major surfaces 14, 16) the relative motion between the joints J is not solely vertical. Rather there is a combined vertical motion with lateral displacement. With reference to FIGS. 5*b*-5*e* and the joint Jm, this lateral motion is motion of the joint Jm is to the left and is highlighted by the closing in the horizontal gap or separation G of the surface 24 and 26 during the engagement process. The horizontal gap G reduces from a maximum gap G1 in FIG. 5*b* to progressively smaller gaps G2 and G3 and finally to a zero gap G4 in FIG. 5*e* in which case there is face to face contact between surfaces 24 and 26, when the joints Jm and Jf are fully engaged. Which of the joints Jm and Jf laterally move is just dependant on which one is least constrained from lateral motion. Indeed both could move laterally toward each other to equal or different degree. This lateral motion is symptomatic of the vertical stability of the engaged joint system FIG. 5*d* illustrates the joints Jm and Jf marginally before full engagement. Here it can be seen that there is a small gap between the bottom of projection Pm and the recess Rf and that the major surface 14 of panel 12*b* is marginally raised relative to the major surface 14 on the panel 12*a*. The relative downward motion of the panel 12*b* is halted and the joint fully engaged when the projection Pm hits the arrestment surface 58 on the recess Rf, as shown in FIG. 5*e*. In this configuration the reservoir 46 is formed between the recess 42 and the arrestment surface 58. In this configuration the surfaces Cm1, Cm2, Cm3 on the male joint Jm lay underneath the corresponding surfaces Cf1, Cf2, Cf3 on the female joint.

The aforementioned mentioned ability for the joints Jm and Jf to enable both positive and negative relative rotation without disengagement is able to accommodate for uneven surfaces. Additionally the joints Jm and Jf facilitate self-alignment of adjacent panels 12. These features substantially simplify the installation to the extent that a very average home handyperson can easily install panel incorporating embodiments of the joint system 10.

The self-aligning aspect of the system 10 arises from the shape and configuration of the joints Jf and Jm and is explained with reference to FIGS. 5*b*, and 5*f*-5*k*.

Figure 5F:
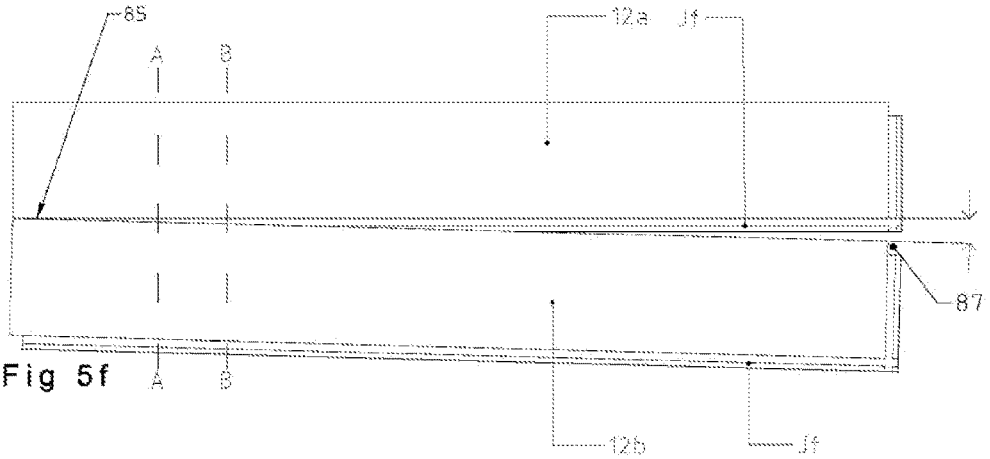
FIGS. 5*f*-5*k* depict in sequence a self-aligning feature of embodiments of the vertical joint system.
Figure 5G:
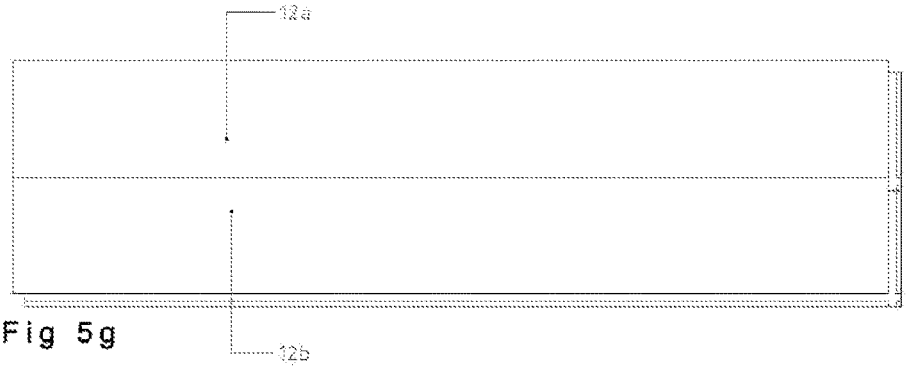
Figure 5H:
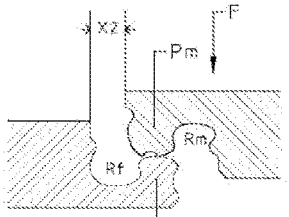
Figure 5I:
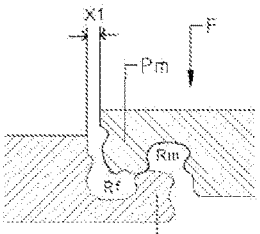
Figure 5J:
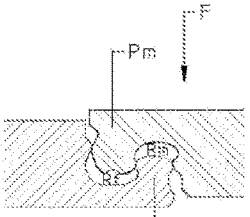

FIG. 5*f* shows a panel 12*b* being roughly positioned for subsequent engagement with panel 12*a* and prior to the application of any downward force or pressure to engage the panels. The panels 12*a* and 12*b* are skewed relative to each other. At one end 85 the protrusion Pm sits on top of recess Rf. The corresponding view in cross section is as shown in FIGS. 5*b* and 5*j* with the joint Jm of panel 12*b* lying on top of the recess Rf of panel 12*a*. At the opposite end 87 the joints are laterally spaced apart. In between, the degree of separation between joints Jm and Jf varies linearly. So at location AA joints Jm and Jf are in contact but protrusion Pm partially rests on protrusion Pf and partially overlies recess Rf and the panels separated by a distance X1 shown in FIG. 5*i*. While at a further location BB along the panels the protrusion Pm lies directly above and on protrusion Pf and the panels are separated by a larger distance X2 shown in FIG. 5*h*.

Now a downward pressure or force F is applied at a location between locations 85 and BB to commence engaging the joints and panels. This force is transmitted between the panels for the length along which they are in contact, i.e. essentially between locations 85 and BB. At most points along this length the protrusion Pf is to the left of the apex of protrusion Pf and at least partially overhanging the recess Rf. Also it will be recognised that due to the curvature of surfaces Cm3 and Cf3 there will be a natural tendency for the protrusion Pf to be drawn into the recess Rf.

Figure 5K:
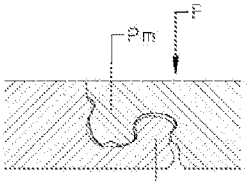

Consequently the force F when transmitted to the contacting surfaces of joints Jm and Jf will initially resolve into components which include a lateral (transverse) component acting to urge the joint Jf into the recess and thus the panel 12*b* toward the panel 12*a*. Accordingly the distance between the panels at end 87 closes. As the location of the application of the force is advanced along the panel 12*b* toward end 87 the this closing effect continues until the at end 87 the protrusion Pm sits above the recess Rf as shown in FIG. 5*j* and the panels are fully aligned as shown in FIG. 5*k*. Thus the panels self-align under application of the downward engaging force. Naturally if the force F is sufficient then in addition to the self-alignment, the joints Jm and Jf will also fully engage as shown in FIG. 5*k*. The self-aligning effect combined with the engagement of the joints Jm and Jf produces a zipper like effect akin to a snap lock bag.

It should also be understood that floors are often under dynamic tensile and compressive load due to variations in temperature and humidity. They are also under static load from furniture or other household items. Should the tensile load exceed the load carrying capacity of the joints one or both of the protrusions Pm and Pf may fracture or shear. This has several effects. It will release tension in the immediate vicinity of the floor. In addition it will result in a horizontal separation along the fractured panel producing a visible gap. Further depending on the prevailing conditions and circumstance there may also be a vertical displacement of one of the adjacent panels resulting in a height difference.

Once this tension has been released it can be extremely difficult if not virtually impossible to reconnect the disengaged panel or fully connect a new panel. This is because the panels on opposite sides of the fracture, which are still under tension, are being pulled and will move away from each other. To reinstate the floor to its original state one must pull the two sides together. If one merely places a new panel in the space of the previous panel then the gap will remain. This leaves the home owner with the only option of using unsightly filler to make good the gap caused by the separation. This in turn is likely to have a negative impact on the value of the home. The self-aligning aspect of the joint system 10 also facilities the self re-tensioning of say a floor upon replacement of damaged panels as described below.

Figure 5L:
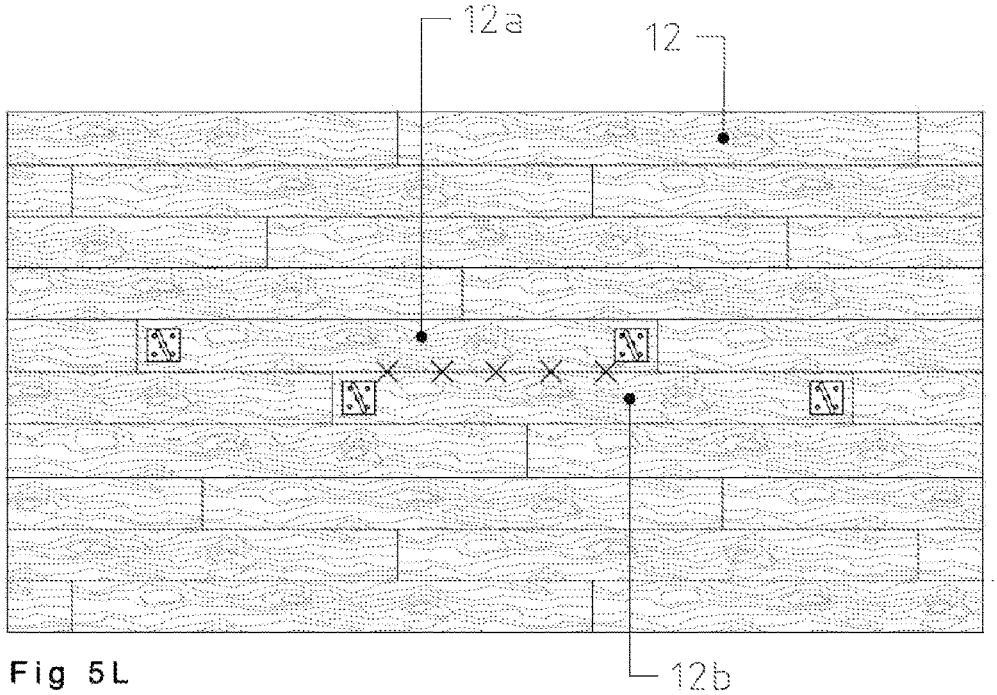
FIGS. 5*l*-5*u* provides a schematic comparison between the effect of the self-aligning feature enabled by embodiments of the present invention and the prior art.
Figure 5M:
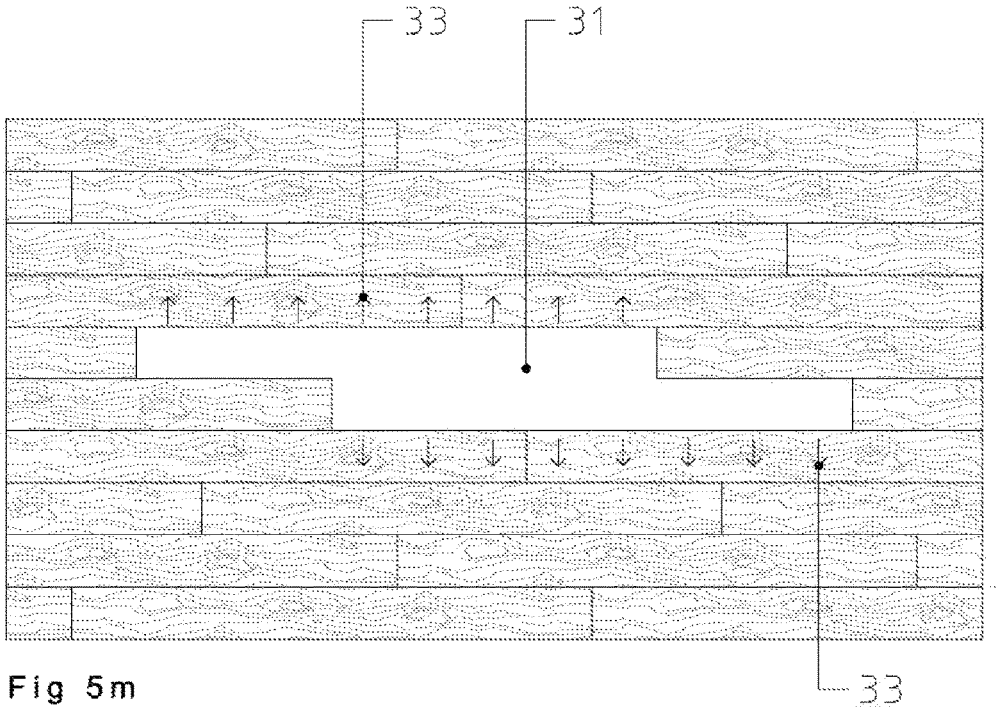
Figure 5N:
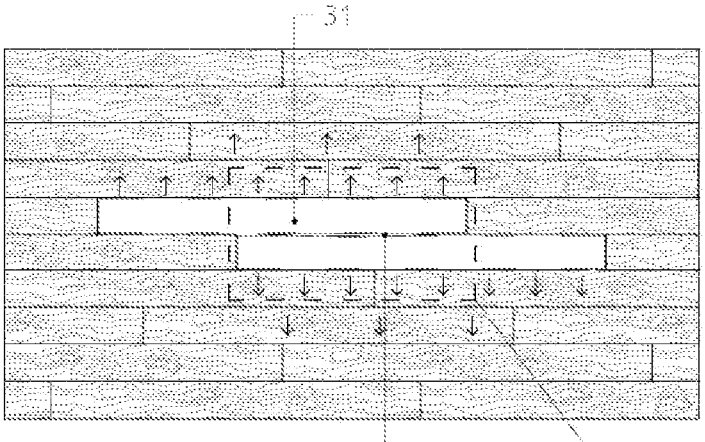
Figure 5O:
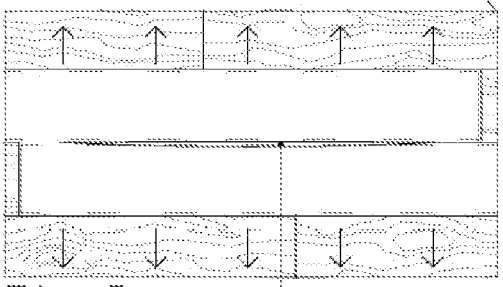
Figure 5P:
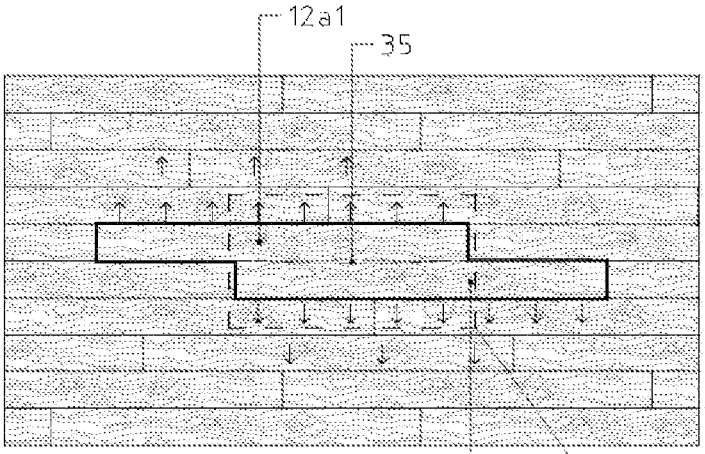
Figure 5Q:
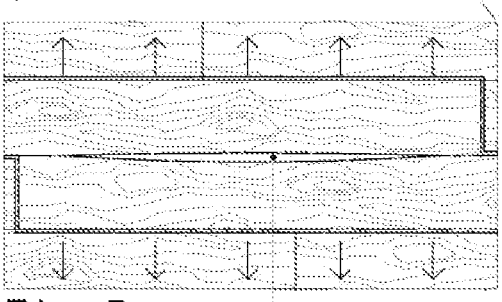
Figure 5R:
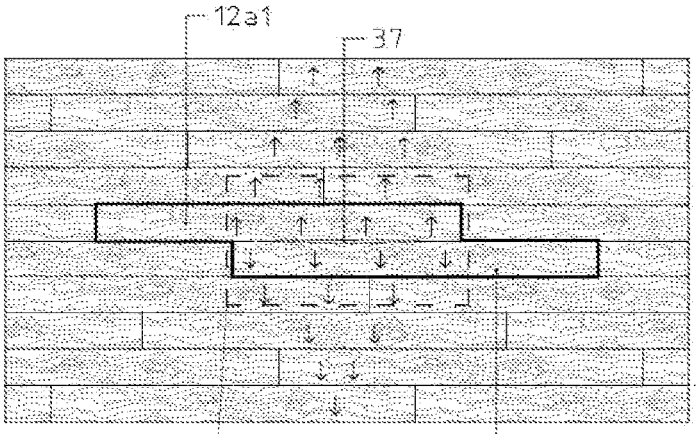
Figure 5S:
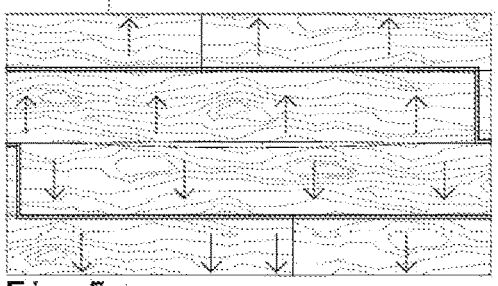

The release in tension, subsequent movement of panels and self re-tensioning is described in greater detail in FIGS. 5*l*-5*u*. FIG. 5*l* illustrates a floor composed of plurality of panels 12. Two of the panels 12*a* and 12*b* are being removed and replaced. Assume that there is tension between the panels 12 as described in the preceding paragraph. Once the two panels 12*a* and 12*b* are removed leaving a gap 31 there is naturally a release of tension in the floor in the area of the gap 31. Consequently, panels 12 adjacent the gap will shift away from each other as shown by the arrows 33 in FIG. 5*m*. The effect of this is to produce a widening of the gap 31. This widening is illustrated in FIG. 5*n*, and in enlarged view in FIG. 5*o*, and occurs as an additional longitudinal band 35 along a line of abutment which previously existed between panels 12*a* and 12*b* prior to their removal. This widening does not only occur within the gap 31. There will also be a separation or at least an increase in tension between remaining adjacent panels along a continuation of the band 35 as there are now fewer panels to accommodate the tension. FIG. 5*p* and corresponding enlarged view of FIG. 5*q* illustrate the effect of replacing the panels with panels having conventional lay down or horizontal locking systems. New panels 12*a*1 and 12*b*1 are inserted into the gap 31 and engaged with adjacent panels on either side. However due to the widening of the gap 31, the new installed panels 12*a*1 and 12*b*1 cannot be fully engaged with each other. The widening may only be in the order of 0.5 to 2 mm but this is sufficient to be easily visible on a floor.

Ordinarily, in the case for example of a tongue and groove type locking system, the tongue will have been sawn off so that there is no mechanical joining between the panels 12*a*1 and 12*b*1. A filler will be used to fill the band 35 between the panels 12*a*1 and 12*b*1. Significantly the filler is unable to transfer tension across the panels 12*a*1 and 12*b*1. Consequently, it is not possible to reinstate the tension within the floor as a whole. Now tension within the floor will act on opposite sides of the filler and the band 35. In time this is likely to lead to the fracturing of the filler and the creation of a new gap 37 shown in FIG. 5*r* and corresponding enlarged view FIG. 5*s* between the panels 12*a*1 and 12*b*1.

Figure 5T:
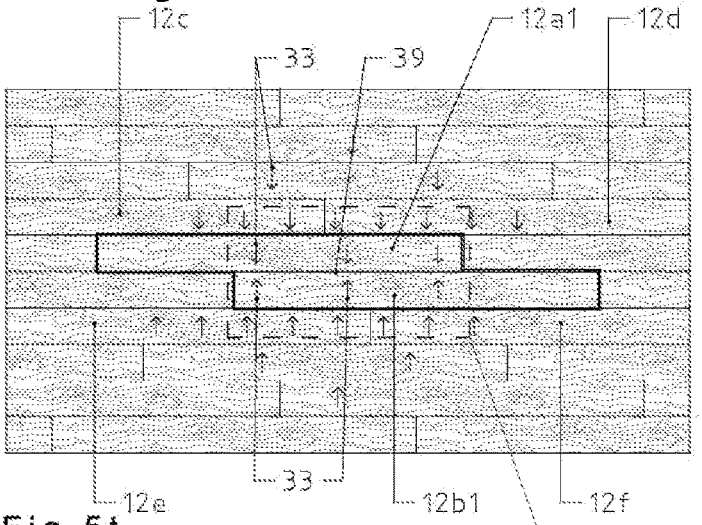
Figure 5U:
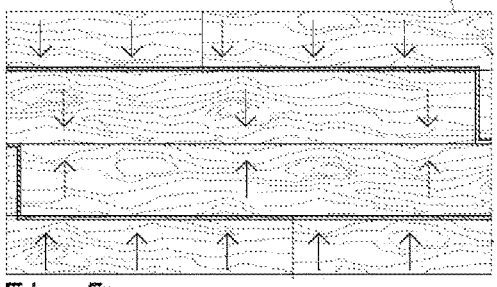

FIG. 5*t* and enlarged view FIG. 5*u* shows the result in using panels or substrates incorporating joint systems in accordance with embodiments of the present invention. That is assume all of the panels 12 in FIGS. 5*l*-5*s* are provided with say joint system 10. When panels 12*a* and 12*b* are removed there is still a widening of gap 31 by creation of band 35. New panel 12*a*1 is installed and engaged with panels 12*c* and 12*d*. Now panel 12*b*1 is inserted with say its female joint Jf beneath the male joint Jm of panel 12*a*1 and the male joint Jm of panel 12*b*1 lying on top of the female joint Jf of adjacent panels 12*e* and 12*f*.

Applying downward pressure on the male joint of panel 12*a*1 where it overlies joint Jf of panel 12*b*1. This results in these joints and corresponding panels engaging. This will cause a slight motion of the panel 12*b*1 away from panels 12*e* and 12*f*. However this motion does not cause a separation greater than the distance X2 shown in FIG. 5*h*. By now applying downward pressure on the male joint Jm of panel 12*b*1, the panels 12*b*1 and 12*e* and 12*f* are pulled toward each other. Moreover the panels on either side of an interface 39 between panels 12*a*1 and 12*b*1 are pulled inwardly toward each other as shown by the arrows 33 in FIGS. 5*t* and 5*u*. Further the joints Jm and Jf of panels 12*b*1; and, 12*e* and 12*f* are engaged and the entirety of the floor thus re-tensioned and structural integrity re-instated.

The above describes the situation where the floor is under tension. But equally problems arise in prior art systems when a floor in under compression in which case there can be a closing in the gap 31. With the prior art systems one must cut the panels to reduce their width to fit in the closed gap. Consequently there will be no full mechanical joint between the newly installed panels and the existing panels. The structural integrity is lost. Embodiments of the present invention can operate in essentially the same manner as described above with reference to FIGS. 5*l*-5*u* but in "reverse" to push the gap open and mechanically engage all adjacent panels 12 to reinstate full structural integrity. Again this will be effective for gap of up to about the lateral extend of surface Cf1 which may range to about 2 mm.

The above self aligning and "zipper" effects also apply when a panel is warped or twisted about its length. Embodiments of the joint system enable a warped panel to be aligned and pulled in having the effect of flattening the warp or twist in the panel provided the panel to which it is being engaged is flat and not itself warped or twisted.

When engaging the joints Jm and Jf downward pressure can be applied by a person of a weight of about 70 kilograms or more traversing the joints Jm a small hopping or one legged jumping or small stomping motion. In this way joining of adjacent panels 12 can be achieved without the need to constantly kneel and stand as is required with prior art systems. The engagement of joint Jm into joint Jf may also be aided by light tapping with a rubber mallet M. The ease of installation not only widely expands the range of do-it-yourself installers by reducing the skill and strength level required it also has significant benefits to all installer including professionals by way of minimising physical stress and exertion. For an employer or installation company this reduces injury and sick leave to workers. Consequently workers are able to work longer and have increased income and insurance premiums for and compensation claims against the employer can be reduced.

When panels 12 with the joint system 10 are used in large area such as for example in commercial premises a modified compactor can be used to apply the force or pressure to engage the joints Jm and Jf. The compactor is envisaged as being in the form similar to those used for compacting sand prior to laying pavers, but having a soft smooth non scratch base lining. The lining may comprise but is not limited to a rubber, foam, felt, or cardboard sheet.

Figure 6A:
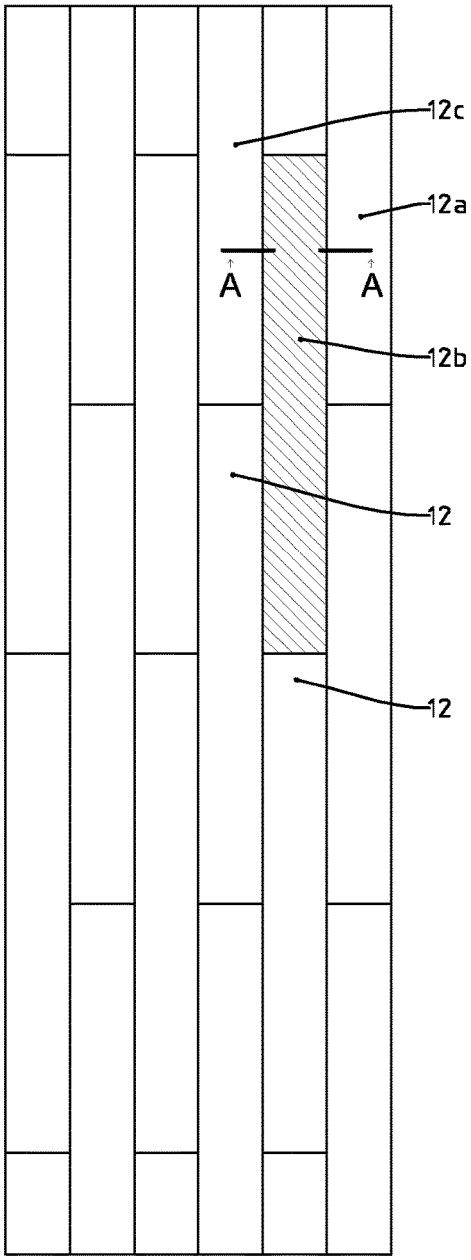
FIG. 6*a* is an elevation view of an area covered by substrates joined together with embodiments of the present vertical joint system and identifying a panel to be removed.
Figure 6C:
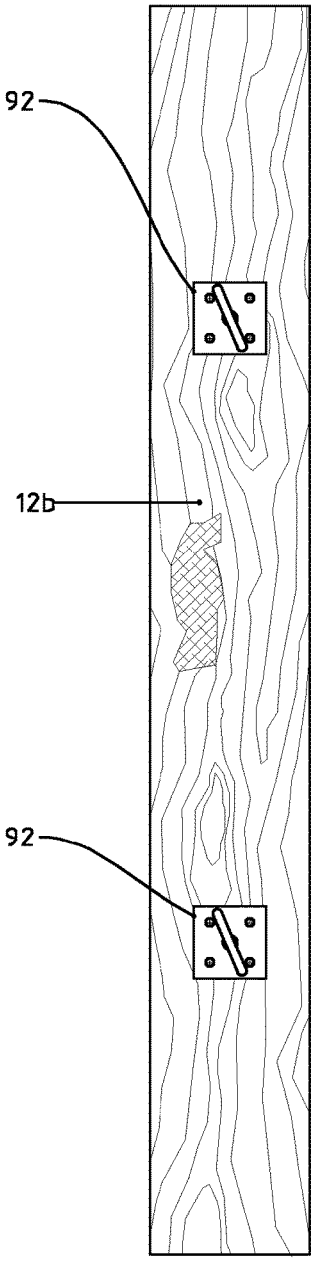
FIG. 6*c* is a top elevation of a panel fitted with jacks enabling the removal of the panel.
Figure 6B:
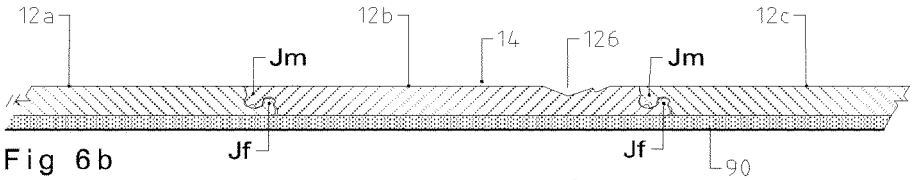
FIG. 6*b* is a view of section A-A from FIG. 6*a;*
Figure 6D:
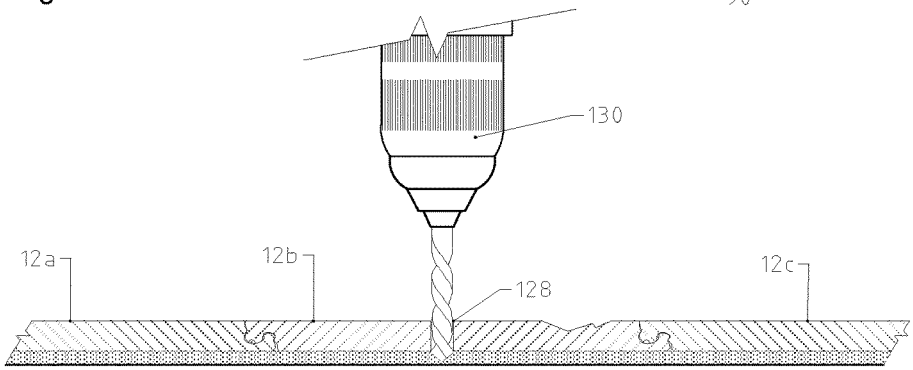
FIG. 6*d*-6*s* depict in sequence steps for the removal and replacement of the highlighted panel in FIG. 6*a;*

The process of removal of a damaged panel will now be described with particular reference to FIGS. 6*a*-9*f*. As will become evident from the following description the removal process of a damaged panel relies on the relative rotation enabled between the joined panels by virtue of the configuration of the joint system 10. FIGS. 6*a*-6*s* depict in sequence various steps in the removal and replacement of a damaged panel. The removal and replacement is facilitated by use of an extraction system which comprises in combination a jack 92 shown in FIGS. 7*a* and 7*b* and a wedge tool 94 shown in FIGS. 8*a* and 8*b*.

The jack 92 is a simple hand screw jack which is applied to a panel being removed. The screw jack 92 is provided with an elongated threaded shaft 96 provided at one end with a cross bar handle 98. The thread of the shank 96 is engaged within a threaded boss 100 formed on a clamp plate 102. The plate 102 is of a square shape with the boss 100 located centrally in the plate 102. The boss 100 overlies a through hole in the plate 102 through which the shaft 96 can extend.

Distributed about the plate 102 are four through holes 104 for receiving respective fastening screws 106.

The wedge tool 94 comprises a wedging block 108 coupled at one end to a handle 110. The wedging block 108 is formed with a base surface 112 which in use will bear against a surface on which the panels 12 are installed, and an opposite surface 114 which lies beneath and contacts a major surface 16 of the panel 12 adjacent the panel being removed. The surface 114 includes the relatively inclined portion 116 and a parallel land 118. The inclined portion 116 extends from a leading edge 120 of the wedge block 108 toward the handle 110. The surface 116 is inclined relative to the surface 112, while land 118 lies parallel to the surface 112 and is formed contiguously with the surface 116. The handle 110 is bent so that a free end 122 of the handle 110 lies parallel with but laterally displaced from a distal end 124 which is connected with the wedge block 108.

FIG. 6*a* depicts an area of flooring including a damaged panel 12*b* which is connected along each side with adjacent panels 12. For the purpose of describing the method of replacing the damaged panel 12*b* reference will be made only to two of the connected panels 12*a* and 12*c* which engage along opposite longitudinal sides of the panel 12*b*. The three side by side interlocked panels 12*a*, 12*b* and 12*c* are each provided with an embodiment of the joint system 10 and cover a surface 90 as shown in FIG. 6*b*. The central panel 12*b* has a major surface 14 which is damaged by virtue of a scratch, gash or water damage 126. It should also be understood that unless one of panels 12*a* or 12*c* is immediately adjacent a wall then other panels 12 will be interlocked with each of panels 12*a* and 12*c*.

In order to replace the damaged panel 12*b*, a drill 130 (see FIG. 6*d*) is used to drill a hole 128 through the panel 12*b* for each jack 92 used in the extraction process. The hole 128 is formed of a diameter sufficient to enable the passage of shank 96. The length of the panel 12*b* being removed dictates the number of jacks 92 that may be required. Thus in some instances, extraction can be effected by the use of one jack 92 whereas others may require two or more jacks. In this particular instance two jacks 92 are used as shown in FIG. 6*c*, but for ease of description the extraction process refers to only one of the jacks 92.

Figure 6E:
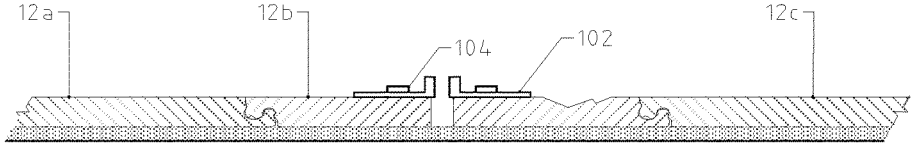
Figure 6F:
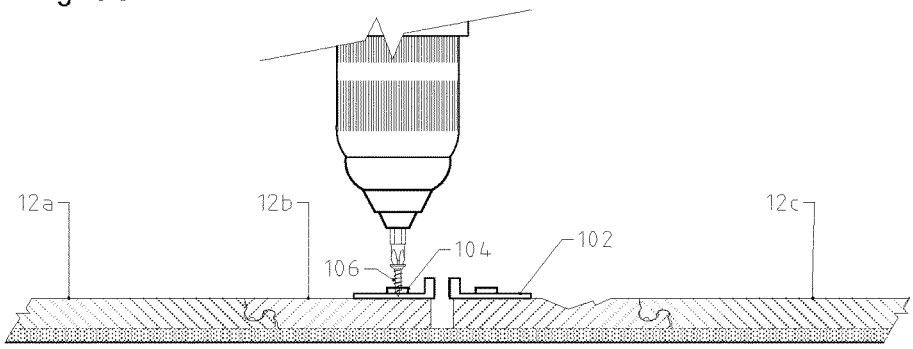

Upon completion of the hole 128, the clamp plate 102 is placed on the panel 12*b* with its boss 100 overlying the hole 128 hole as shown in FIG. 6*e*. The plate 102 is fixed to the panel 12*b* by way of the four self tapping screws 106 that pass through corresponding holes 104. This is illustrated in FIG. 6*f*. The screws may be screwed in by a DIY battery operated screw driver or using a manual screwdriver.

Figure 6G:
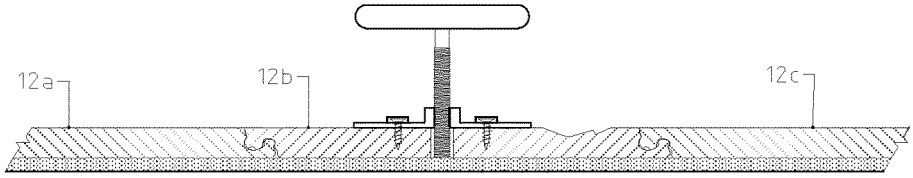
Figure 6H:
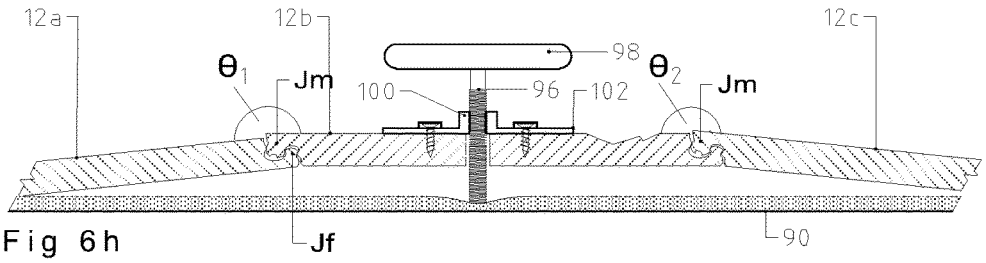

The next stage in the removal process is shown in FIGS. 6*g* and 6*h* involves engaging the shank 96 with the threaded boss 100 and then screwing down the shaft 96 by use of the handle 98 to lift the panel 12*b* above the surface 90. It should be immediately recognised that this action requires the relative rotation of the joints Jm and Jf of panel 12*b* while maintaining their engagement with the joints of adjacent panels 12*a* and 12*c*. This rotation is a relative negative rotation as will be explained shortly. However simultaneously there is also a positive rotation of the joints between the panels engaged on either side of panels 12*a* and 12*c* opposite the panel 12*b*.

The jack 92 is operated to lift the damaged panel 12*b* vertically upward by a distance sufficient to effect a negative rotation between the damaged panel 12*b* and the adjacent adjoining panels 12*a* and 12*c*. The negative rotation is in the order of 7°-10°. This is explained with particular reference to FIG. 6*h* which shows an angle θ1 between the major surfaces 14 of panels 12*a* and 12*b*; and an angle θ2 between major surfaces 14 of panels 12*b* and 12*c*. Prior to lifting of the panel 12*d*, it should be understood that the angles θ1 and θ2 will be 180° assuming that the surface 90 is flat. Formation of a negative angle between adjoined panels 12 is indicative of the angle θ1 exceeding 180°. The amount by which the angles θ1 and θ2 exceed 180° during the disengagement is equated to the negative rotation of the panels during this process. For example if angle θ1 is say 187° then the relative negative rotation between panels 12*a* and 12*b* is 7°.

It will be understood by those skilled in the art that vertically raising of any prior art system having a lateral projection (e.g. a tongue) that seats in a groove or recess of an adjacent panel is virtually impossible without breaking the tongue or fracturing the panel with the groove. Thus this action if attempted with a prior art system is very likely to result in the damaging of one more panels which were not previously damaged or in need of replacement.

The ability for the panels incorporating embodiments of the present joint system to be removed by vertical lifting is a direct result and consequence of the joint system. This provides a lay-down disengagement process of panels being directly opposite to the prior art which requires a lay-up disengagement process. As a consequence of the joint system and the ability to disengage without damaging adjacent panels by vertical lifting, repair of a floor can be achieved in a world's best practice manner fully reinstating the integrity of the floor without the need to peel back the entire floor from one wall to the damaged area, and/or engaging a professional installer.

The jack 92 mechanically lifts and self supports the panel 12*b*, panels 12*a*, 12*c* and panels adjacent to panels 12*a* and 12*c*. Thus the installer does not need to rely on their own strength to lift and hold the panels. In contrast some prior art systems use suction cups for example as used by glaziers to hold glass sheets to grip a panel to be removed. The installer must then use their strength to lift the panel. While this is difficult enough it becomes impossible if the panel is also glued to the surface 90. The jack 92 which provides a mechanical advantage is able to operate in these circumstances. In addition as the jack self supports the panels 12 the installer is free to use both hands in the repair process and indeed is free to walk away from the immediate vicinity of the panel 12*b*.

The jack 92 is operated to lift the panel 12*b* vertically upwards to a location where the negative rotation between the panel 12*b* and adjacent panels 12*a* and 12*c* is in the order of 7° to 10°. This is the position shown in FIGS. 6*h* and 9*d*. In this position, there is partial dislocation of the joints Jm and Jf between panels 12*a* and 12*b*. This partial dislocation arises from the surface Cm1 rolling over surface Cf1 with the surface 38 snapping past the apex of surface Cf1 and is denoted by an audible "clunk". Notwithstanding this dislocation the panels remain engaged due to the pinching of protrusion Pf between surfaces Cm2 and Cm3.

The jack 92 can be provided with a scale to give an installer an indication of the when the negative rotation is in the order of 7° to 10°. The scale could comprise for example a coloured band on the shank 96 which becomes visible above the boss 100 when shank has been screwed down to lift the panel sufficiently to create the above mentioned negative rotation. Several bands could be provided on the shank for panels of different thickness.

In order disengage panel 12*b* one must first disengage whichever of the panels 12*a* or 12*c* has its female joint Jf engaged with panel 12*b*. In this instance this is panel 12*a*.

Figure 6I:
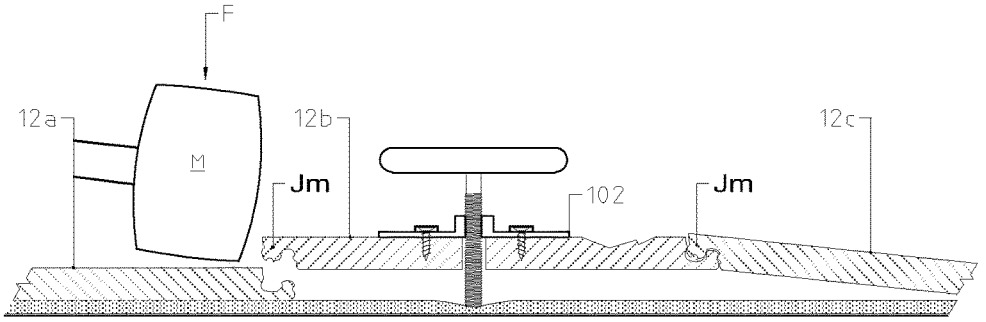

Working above the panels 12 an installer will not immediately know that it is panel 12*a*. But this can be easily determined by either: lightly tapping on both panels 12*a* and 12*c*; or, applying light hand pressure and feeling for joint movement. Due to the orientation of the joints this tapping will result in panel 12*a* fully disengaging in the vicinity of the tapping. Thereafter as shown in FIG. 6*i*, applying a downward force or pressure on the panel 12*a* at other locations along its length will result in a total disengagement of joints Jm and Jf on the panels 12*a* and 12*b*.

The interaction between the respective surfaces on the joints Jm and Jf on the panels 12*a* and 12*b* from the position where the panels are fully engaged and lie on the same plane as shown in FIG. 6*f* to the point of disengagement shown in FIG. 6*h* will be described in more detail with reference to FIGS. 9*a*-9*e*.

Figure 9A:
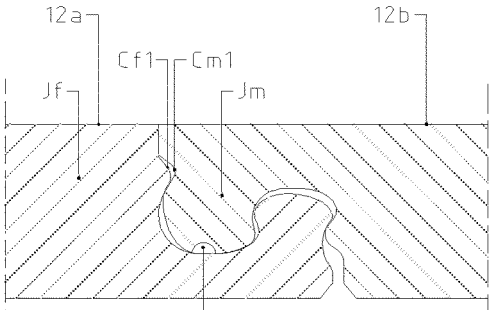
FIGS. 9*a*-9*f* depict in sequence the disengagement of joined panels from an initial fully engaged state depicted in FIG. 9*a* to a fully disengaged state shown in FIG. 9*f;*

FIG. 9*a* illustrates the panels 12*a* and 12*b* prior to operation of the jack 92. This equates the relative juxtaposition of the panels shown in FIGS. 6*a*, 6*b*, and 6*d*-6*g*. As the jack 92 is operated to progressively lift the panel 12*b* from the surface 90, there is a gradual rotation between the respective joints Jm and Jf. FIG. 9*b* illustrates the joint Jm of panel 12*b* and joint Jf of panel 12*a* at relative rotation of approximately −2°. Here the abutment surfaces 24 and 26 commence to separate with the surface Cm1 and in particular the ridge 38 commencing to ride up the surface Cf1. Simultaneously the surface 40 of projection Pm commences to lift from the surface 46 of recess Rf. There is also now a slight increase in the separation between upper portions of inflexion surfaces and Im3 and If3. Finally, the surface Cm2 rides down the surface Cf2.

Figure 9D:
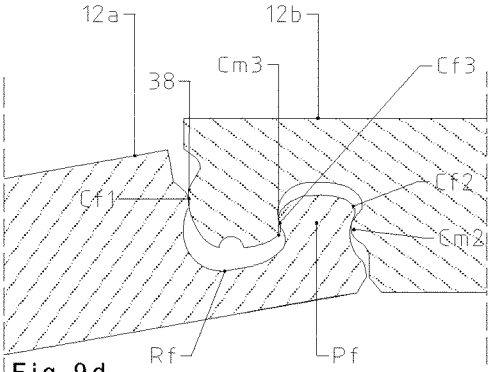
Figure 9B:
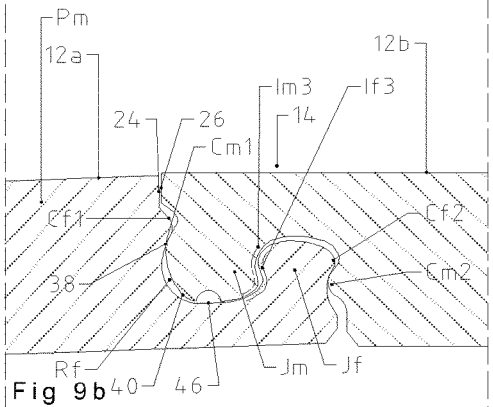
Figure 9E:
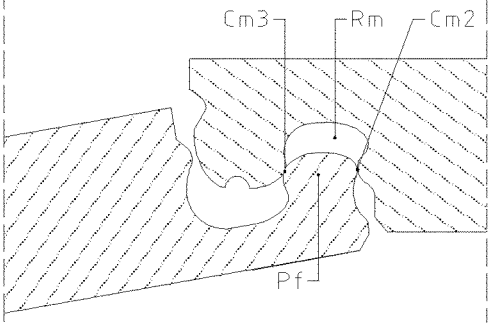
Figure 9C:
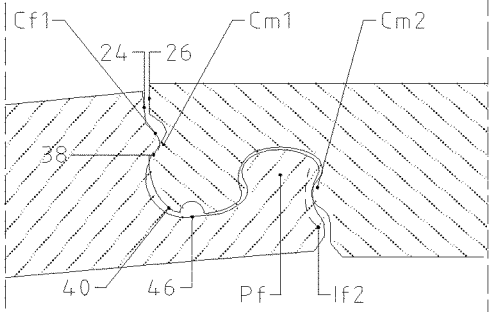

FIG. 9*c* shows the effect of continued lifting of the panel 9*b* to a position where the relative negative rotation between the panels 12*a* and 12*b* is about 5°. Here the separation between abutment surfaces 24 and 26 is more pronounced and the surface Cm1 and in particular ridge 38 reside higher on the surface Cf1 but not yet disengaged from the surface Cf1. There is an increase in the separation between the surfaces 40 and 46 and the surface Cm2 is now seated firmly in a deepest portion of the concavity in inflexion surface If2. This is increasing pressure/force exerted by: surface Cm2 on the neck of protrusion Pf; and, surface Cm1 on surface Cf1.

Continued operation of the jack 92 further increases the angle between the panels 12*a* and 12*b* to approximately −7° as shown in FIG. 9*d*. At this point, the surface Cm1 and ridge 38 have now moved past the surface Cf1 and lie outside of the neck 66 of recess Rf. This would ordinarily be indicated to the installer by an audible "clunk". However the surface Cm3 is engaged by and below the surface Cf3; and the surface Cm2 resides below the surface Cf2. More particularly, the protrusion Pf is now being compressed or pinched on opposite sides by the surfaces Cm3 and Cm2. Thus while at this −7° disposition, the joints Jm and Jf are still partially engaged and in the absence of any external force, maintain vertical and horizontal locking of the panels 12*a* and 12*b*. Further, during the rotation of the joints Jm and Jf up to the −7° rotation the surface Cm2 operates as a fulcrum lifting the projection Pm from the recess Rf.

Figure 9F:
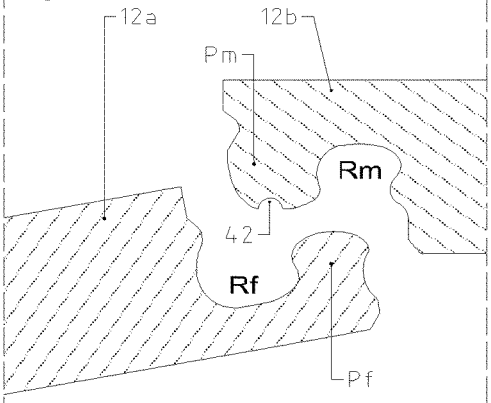

The application of a downward pressure or force on the panel 12*a* results in one or both of: compressing the projection Pf; or, opening the neck of recess Rm formed by the surfaces Cm3 and Cm2, to enable the projection Pf to escape the recess Rm. Wax in the joint will reduce friction and now assist in the disengagement of the joints. Now the panel 12*a* is free to fall back to the surface 90 as shown in FIG. 9*f* and FIG. 6*i*. Thus at this point in time the panels 12*a* and 12*b* are fully disengaged.

Figure 6J:
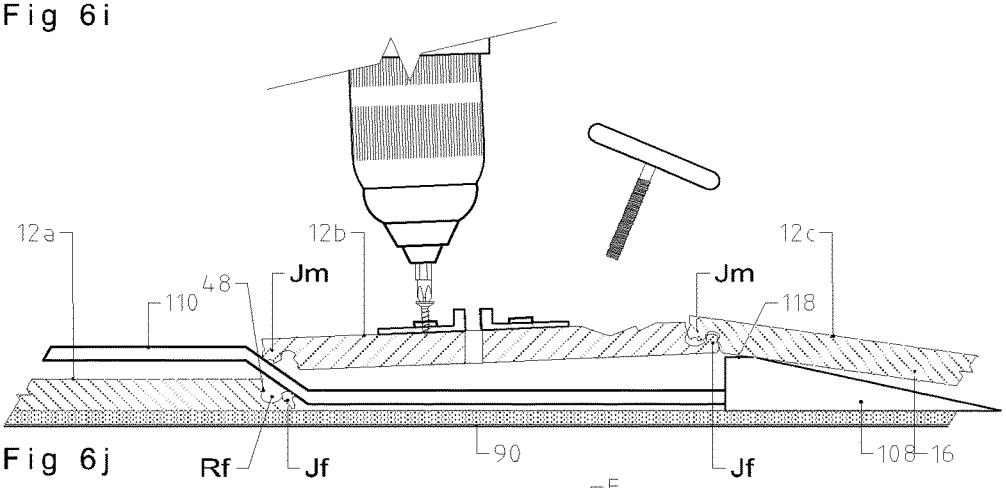

However removal of the panel 12*b* also requires disengagement of the joint Jf of panel 12*b* from the joint Jm of panel 12*c*. This process is shown in FIGS. 6*j* to 6*l*.

Immediately after disengagement of panels 12*a* and 12*b*, the panel 12*b* is held above surface 90 by the jack 92. To continue the replacement process the panel 12*b* is lowered back to the surface 90 by unscrewing shaft 96 from the boss 100 of the clamp plate 102. An installer next grips and lifts the joint Jm of panel 12*b* to insert the wedge tool 94 between the disengaged joints of the panels 12*a* and 12*b* and push it to a position where the land 118 of surface 114 is in contact with the major surface 16 of panel 12*c* and inside of the joints Jm and Jf. This is shown in FIG. 6*j*. Disengagement of the panel 12*b* from the panel 12*c* is now effected by initially rotating the panel 12*b* by about −7° to −10° to effect a disengagement of the surface Cm1 of panel 12*c* from the surface Cf1 in the joint Jf of panel 12*b*. The wedge tool 94 is configured to assists the installer in achieving this rotation. This is also depicted in FIG. 6*j*. Moreover when the wedge block 108 is under the under panel 12*c* slightly inboard of its joint Jm, and the panel 12*b* is rotated in the anti-clockwise direction toward the handle 110, the panel 12*b* will rotate or pivot by 7° to 10° prior to or by the time it abuts the handle 110. The reaching of this position is ordinarily denoted by an audible "clunk" as the surface Cm1 passes from below to above surface Cf1. This juxtaposition of the joints Jm and Jf is as shown in FIG. 9*d*.

Figure 6K:
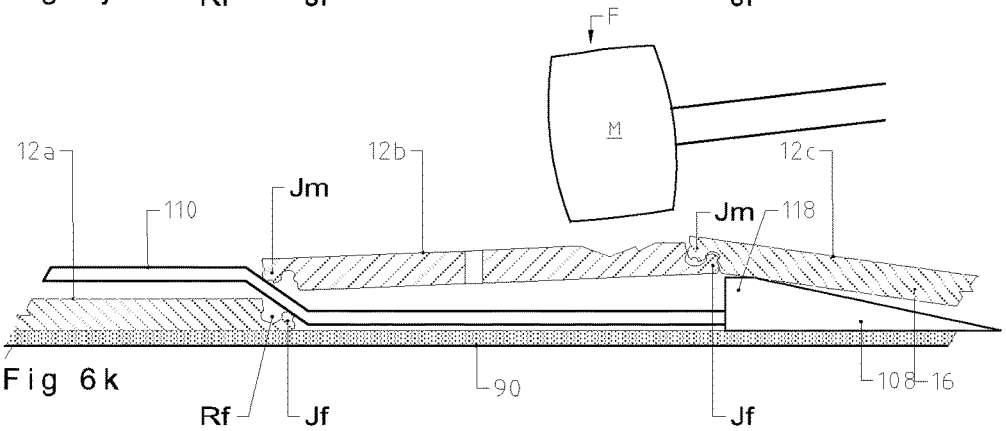
Figure 6L:
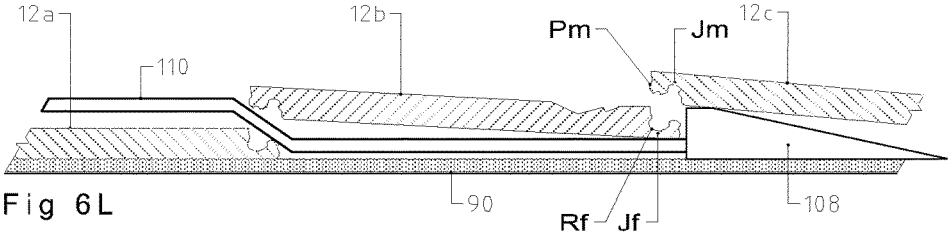
Figure 6M:
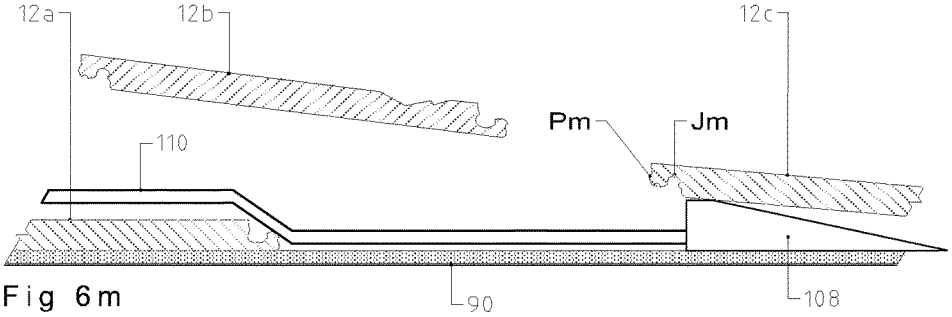
Figure 6N:
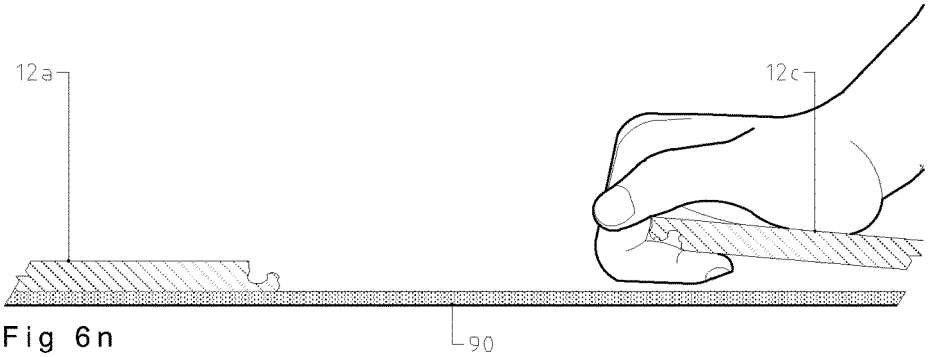
Figure 6O:
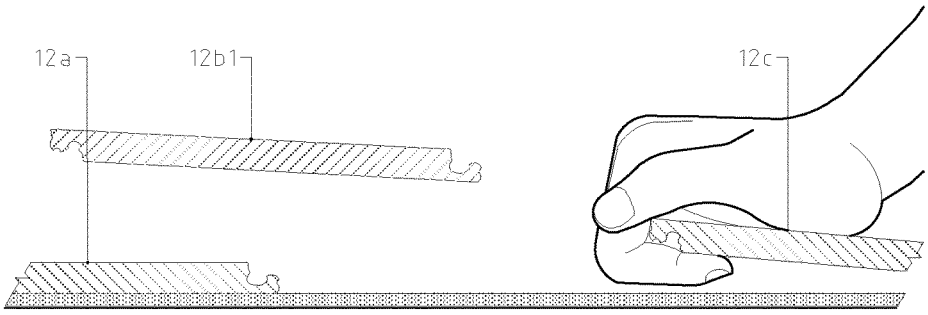
Figure 6P:
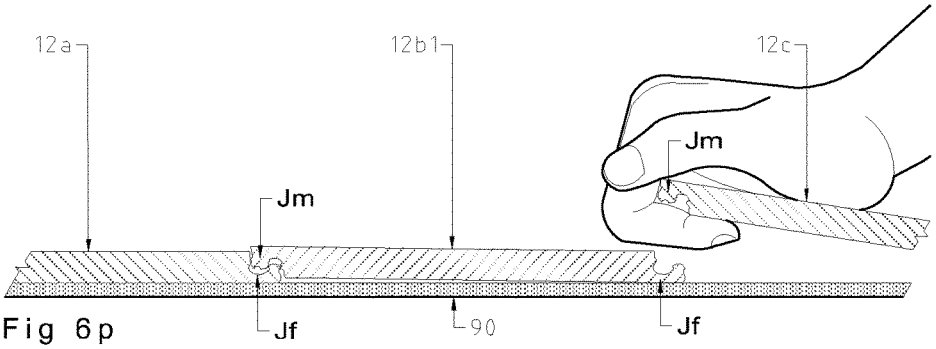

Subsequent application of downward pressure or force for example by way of rubber mallet M as shown in FIG. 6*k* will result in total disengagement of the joints Jf and Jm of panels 12*b* and 12*c* respectively as shown in FIG. 6*l*. Now the damaged panel 12*b* is totally disengaged from both adjacent panels 12*a* and 12*c* and can be removed.

To replace the damaged panel 12*b* with a new panel 12*b*1 an installer now removes the wedge tool 94, lifts the edge of panel 12*c* by hand and slides a new panel 12*b*1 beneath the raised panel 12*c* so that the joint Jm lies above the joint Jf. The opposite side of panel 12*b*1 rests on panel 12*a*. This sequence of events is shown in FIGS. 6*m*-6*p*.

Figure 6Q:
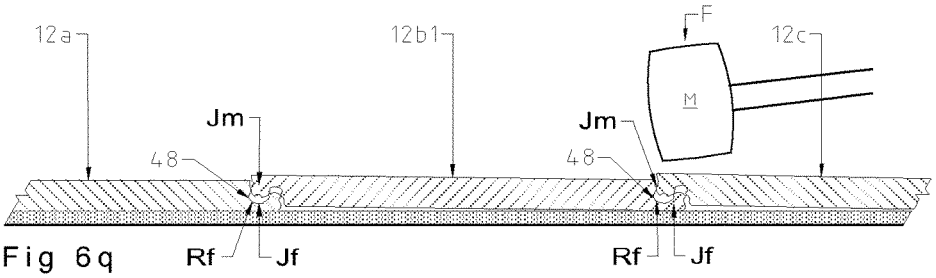

The installer now lowers the panel 12*c* onto the panel 12*b*1. When this occurs, the male joint Jm of panel 12*c* rests on the neck 48 of female joint Jf of panel 12*bi*; and the joint Jm of panel 12*b*1 will rest on the neck 48 of the joint Jf of previously laid panel 12*a*. This is shown in FIG. 6*q*.

Figure 6R:
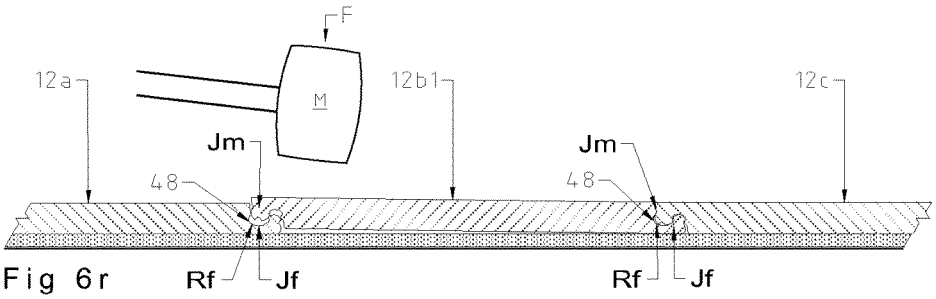
Figure 6S:
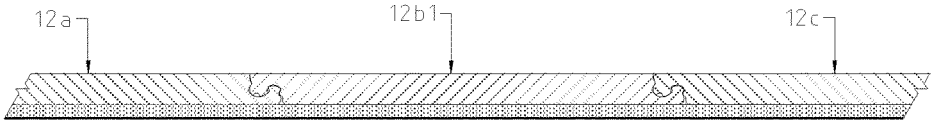
Figure 7A:
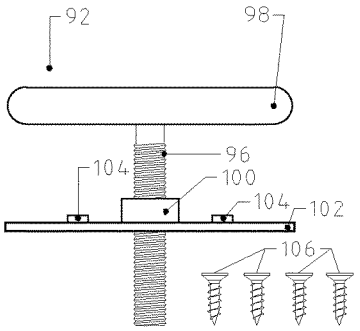
FIG. 7*a* is a side elevation of the jack depicted in FIG. 6*c;*
Figure 7B:
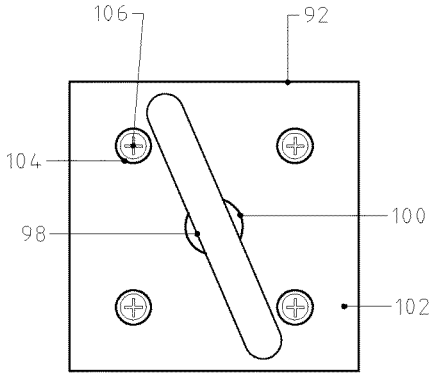
FIG. 7*b* is a top elevation of the jack shown in FIG. 6*c;*
Figure 8A:
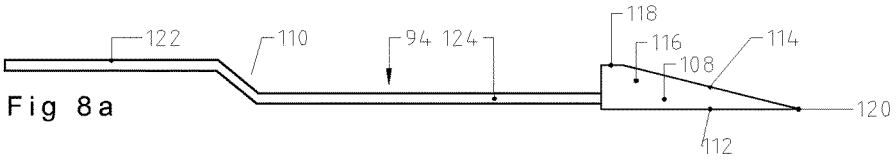
FIG. 8*a* is a side elevation of a wedge used in conjunction with the jack for extracting an engaged panel.
Figure 8B:
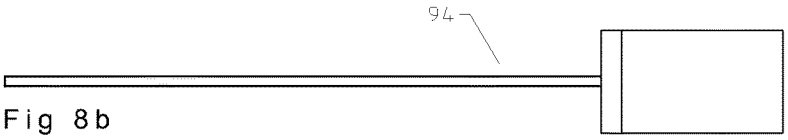
FIG. 8*b* is an elevation view of the wedge shown in FIG. 8*a;*

To fully engage the panel 12*b*1 downward force or pressure is applied on the male joints Jm of panels 12*c* and 12*b*1. This can be done in either order, i.e. panel 12*c* then panel 12*b*1 or panel 12*b*1 then panel 12*c*. FIG. 6*q* shows the configuration when joint Jm of panel 12*c* is first engaged with joint Jf of panel 12*b*1. FIG. 6*r* depicts the joint Jm of panel 12*b*1 now engaged with joint Jf of panel 12*a*, reinstating the floor as shown in FIG. 6*s*. The self aligning properties of the joint system as described above with reference to FIGS. 5*f*-5*k* will operate during this process if the panels are initially misaligned.

The ability to easily remove and replace only the panels 12 which are damaged instead of peeling back the entire floor has enormous practical, commercial and environmental benefits. These are summarised as follows:

The panels can be easily replaced by handypersons of limited skill and with very rudimentary and low cost equipment. This avoid the need for hiring professional installers The repair is also relatively clean as there is no need to chisel or cut out panels or parts thereof.

As only the damaged panels need be replaced there is no need to move furniture which in itself is often difficult and inconvenient.

From the view point of the retailer there is initial benefit in that the retailer should encourage the purchaser to purchase slightly more panels that required to cover a given area to provide spare panels in the event of damage. For example the retailer would explain the benefits in purchasing say an additional one to three square meters of panels. This is much the same as when say a new house in build and the builder leave extra floor and roof tiles or paint for the purposes of repair. A major issue with repair of damaged flooring it the difficultly is sourcing identical panels several years after installation. If identical panel cannot be sourced it may be that an entire level of flooring will need to be replaced when only a small number (e.g. two or three) panels are damaged. For example say the ground floor of a house has three bed rooms a hallway, kitchen and family room all cover by wooden floor panels of the same appearance forming a continuous floor. The entire housing furniture selection and decor is often selected to match with the floor. In such instances when matching replacement panels are not available the entire ground level floors may need to be replaced. Indeed this occurred on a large scale flooring a freak storm in Perth, Western Australia in March 2010. A much more common trigger for this is the spilling overtime of water from refrigerators with water dispensers. Having a small supply of replacement panel at hand avoids the need for full scale floor replacement. A new and growing market for wooden flooring is that uses a relative cheap and plentiful material for the panel and using a bubble jet printer to print a pattern for example the wood grain of exotic trees on the upper major surface 12. It will be appreciated that these patterns can be very complex and trying to rectify a scratch by use of an ink pen is virtually impossible. Again a small supply of additional panels made with the initial purchase of the flooring can potentially save thousands of dollars. A similar situation applies with wooden flooring is that use a relative cheap and plentiful material and are stained on their major surface to mimic the appearance of a more exotic and expensive timber.

The commercial consequence of full floor replacements as described above should not be underestimated. Often this is at the expense of insurance companies. This naturally has a knock effect with insurance premiums increasing and shareholder dividends reducing. Also there are timing issue where insurance companies may not be able to have damage assessed and therefore rectified for months.

Now consider the environmental aspects. Typically wooden floor panel are coated with polyurethane or other sealants. Also they may bear adhesives and glues. This often prevents destruction of the damaged boards by incineration due to generation of toxic gases. Consequently they must go to land fill.

The joint 10 depicted in FIGS. 1-9*f* is representative of one of a large number of possible embodiments. A small selection of other possible embodiments will now be described. In describing these embodiments the same referencing system will be used as for the joint 10 however each specific embodiment of a joint will be demarcated by the addition of the alphabetical suffix e.g. "a, b, c, . . . ".

Figure 10A:
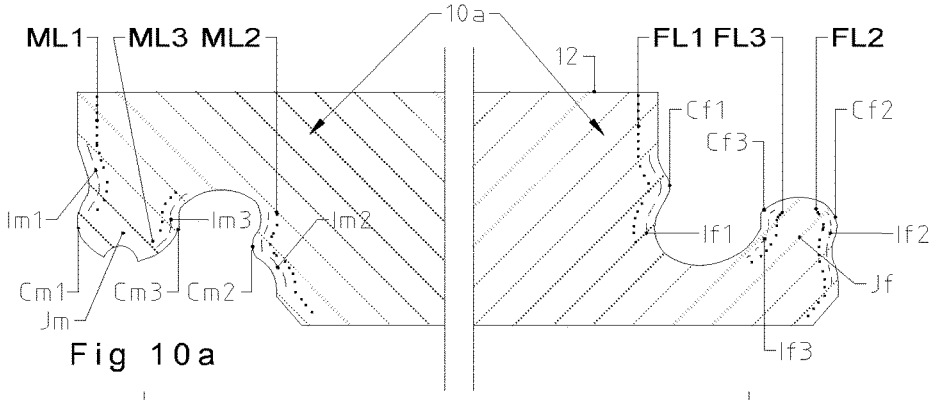
FIG. 10*a* depicts a panel incorporating a second embodiment of the vertical joint system.
Figure 10B:
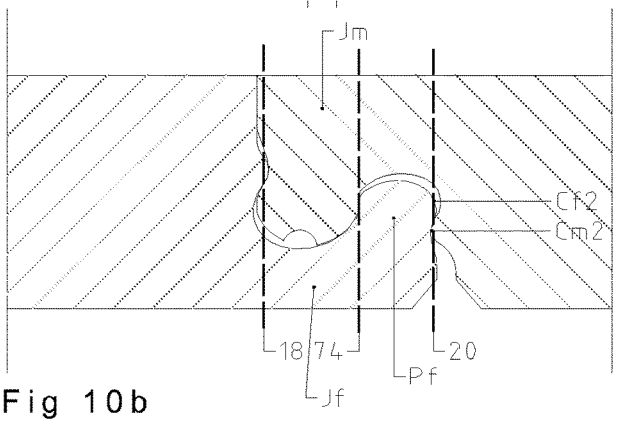
FIG. 10*b* illustrates the engagement of two panels incorporating the second embodiment of the vertical joint system.

FIGS. 10*a* and 10*b* depict a second embodiment of a joint system 10*a* incorporated into a substrate 12. The joint system 10*a* comprises a male joint Jm and female joint Jf along opposite sides. It can be seen that the joint system 10*a* is of the same general configuration as the joint system 10 shown in FIGS. 1 and 2. In particular the male joint Jm comprises male locking surfaces ML1, ML2, ML3; inflexion surfaces Im1, Im2, and Im3; as well as surfaces Cm1, Cm2, and Cm3. Likewise the female joint Jf is provided with female locking surfaces FL1, FL2, FL3; inflexion surfaces If1, If2, If3 and surfaces Cf1, Cf2 and Cf3. The relative locations of the locking surfaces, inflexion surfaces and surfaces for the joint system 10*a* are generally the same as for the joint system 10. However, there are subtle differences in the specific shape and depth of the surfaces. In particular the surface Cm1 in the joint 10*a* is continuously curved rather than being provided with the ridge 38 of the joint system 10. In addition the mating inflexion surfaces Im1 and If1 are shallower so that the spaces 76 and 78 about the locking plane 18 are smaller than that for the joint system 10. This can be seen by comparison between FIG. 10*b* and FIG. 1*b*. Further, there is a lessening in the depth of the inflexion surfaces Im3 and If3 to the extent that there is no space equivalent to the space 80 of the joint system 10. It can also be seen that the inflexion surfaces Im2 and If2 in the joint system 10*a* are shallower than the corresponding surfaces in the joint system 10 resulting in a smaller overlap in the surfaces Cf2 and Cm2 when the joints Jm and Jf of adjacent panels 12 are engaged.

The joint system 10*a* may be used in the same circumstances and with the same materials with the system 10. However due to the slightly shallower depth of the inflexion surfaces I, the joint system 10*a* is suited to more rigid substrates such as but not limited to bamboo where the compressibility of the projections Pm and Pf2 when passing through the necks of the corresponding recesses Rm and Rf may be limited.

FIGS. 11*a* to 11*d* depict a further embodiment of the joint system 10*b* provided on opposite sides of the substrate 12. The substantive differences between the joint systems 10*b* and 10 lie in: (a) the configuration of the immediate inflexion surfaces Im3 and If3; and, (b) the removal of the concave recess 42 from the projection Pm and the formation of a similar recess 42*f* on the surface 58 of recess Rf.

Figure 11A:
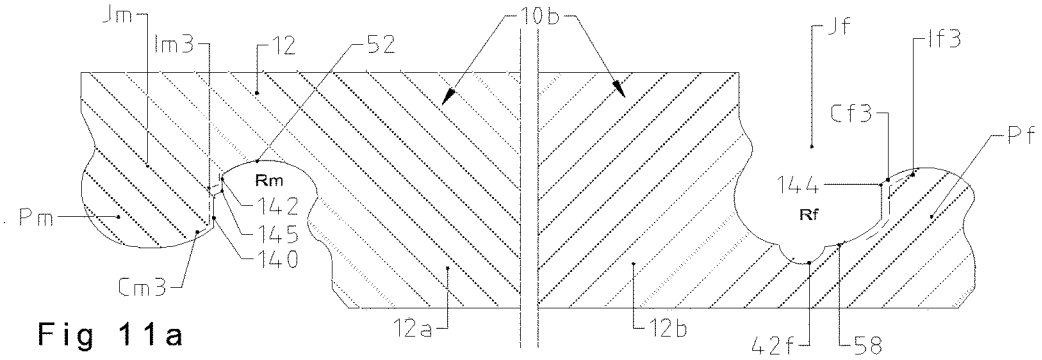
FIG. 11*a* depicts a panel incorporating a third embodiment of the vertical joint system.
Figure 11B:
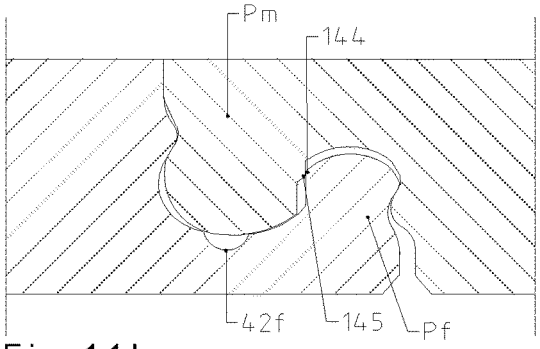
FIG. 11*b* illustrates the engagement of two panels incorporating the third embodiment of the vertical joint system.

In general, the inflexion surfaces Im3 and If3 are "angularised" in that they are not smoothly or continuously curved for their entire length. Specifically the surface Cm3 (which is part of the inflexion surface Im3) is provided with a narrow ridge 140 similar to the ridge 38 depicted on the protrusion Pm of joint system 10. In addition the inflexion surface Im3 is provided with a "V" shaped gear tooth 142 extending toward the root 52 of the recess R. On the female joint Jf the surface Cf3 is sharpened to form a narrow ridge 144. As depicted in FIG. 11*b*, the apex 145 of gear tooth 142 bears against surface Cf3 below the ridge 144 when joints Jm and Jf are engaged.

Figure 11C:
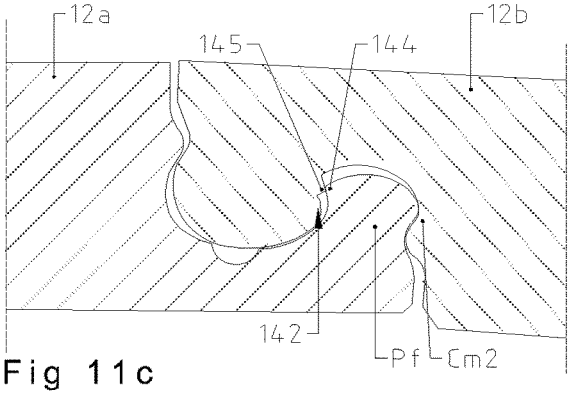
FIG. 11*c* illustrates the ability of engaged panels incorporating the joint system of the third embodiment to rotate in a first direction relative to each other.
Figure 11D:
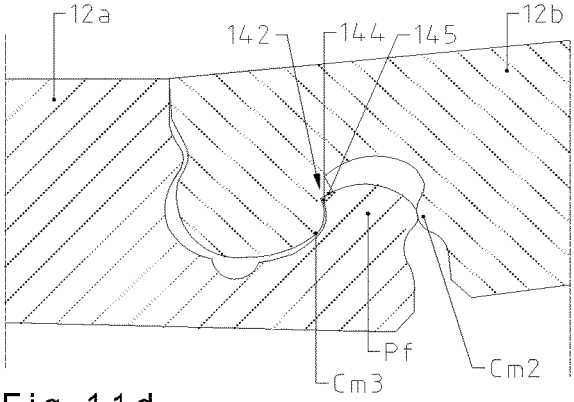
FIG. 11*d* illustrates the ability of engaged panels incorporating the joint system of the third embodiment to rotate in a second opposite direction relative to each.

The purpose and effect of the variation in configuration of the inflexion surfaces Im3 and If3, and in particular the provision of the gear 142 and variations in the configuration of the surfaces Cf3 and Cm3 is to allow greater relative rotation of up to 5° to 10° or more of between joined while maintaining engagement to assist in installation on undulating surfaces. This is shown in FIGS. 11*c* and 11*d*. The ability to increase the degree of rotation is most pronounced in the positive or upward direction of the male jointed panel 12*b* relative to panel 12*a*. This is facilitated by the surface Cm3 bearing against the surface of protrusion Pf in the recess Rf after the apex 145 of gear tooth 142 has passed over the ridge 144. As a consequence the protrusion Pf remains pinched between the surfaces Cm3 and Cm2 thus maintaining horizontal and vertical engagement. The joint system 10*b* enables a panel to ramp up relative to an adjacent horizontal panel to say a raised cross-over or floor trim piece.

Figure 12A:
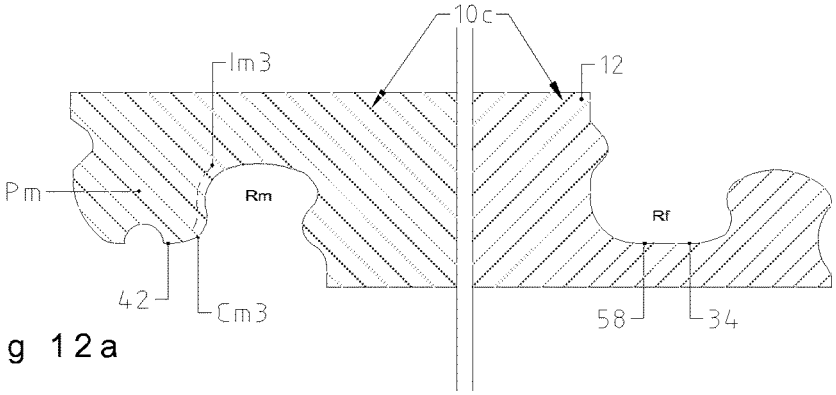
FIG. 12*a* depicts a panel incorporating a fourth embodiment of the vertical joint system.
Figure 12B:
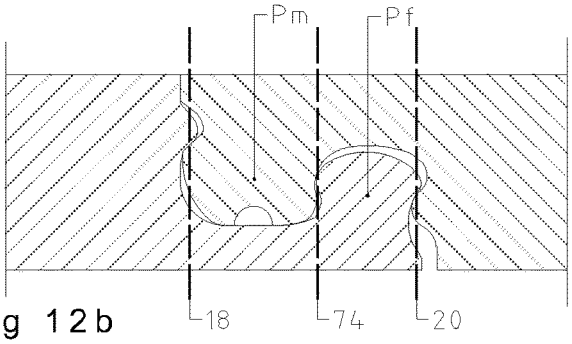
FIG. 12*b* illustrates the engagement of two panels incorporating the fourth embodiment of the vertical joint system.

FIGS. 12*a* and 12*b* depict a further embodiment of joint system 10*c* incorporated in a substrate 12. The joint systems 10*c* and 10 differ in substance in relation to their aspect ratios. Joint system 10*c* may be used for substrates of smaller thickness than for joint system 10. As there is less thickness or depth in the substrate 12 the male and female joints Jm and Jf of joint system 10*c* are shallower but broader. This is most notable by a visual comparison between the protrusion Pm and recess Rf of the joint systems 10*c* and 10. In joint 10*c* the protrusion Pm is broader and provided with a flatter bottom surface 42 as is the recess Rf. The broadening of the protrusion Pm also is the effect of sharpening the profile of the Cm3. However, the method of operation and effect of the joint system 10*c* is the same as for joint system 10. In particular the remains three vertical locking planes 18, 20 and 74 and respective substrates 12 are able to rotate by up to 3 degrees in opposite directions relative to each other.

Figure 13A:
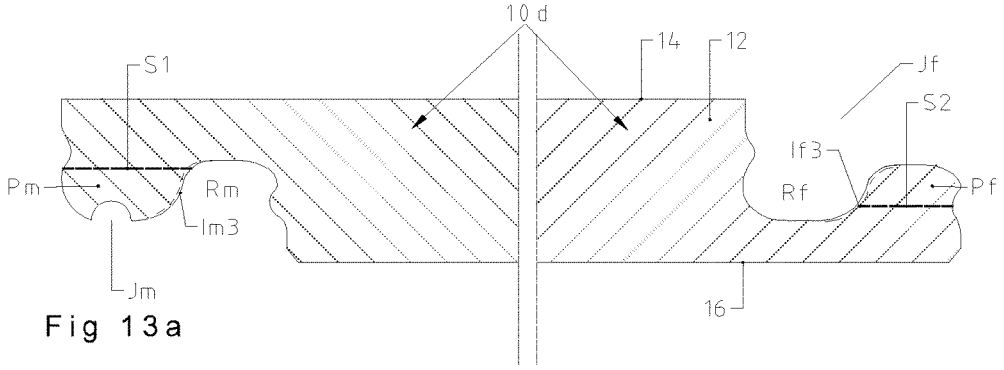
FIG. 13*a* depicts a panel incorporating a fifth embodiment of the vertical joint system.
Figure 13B:
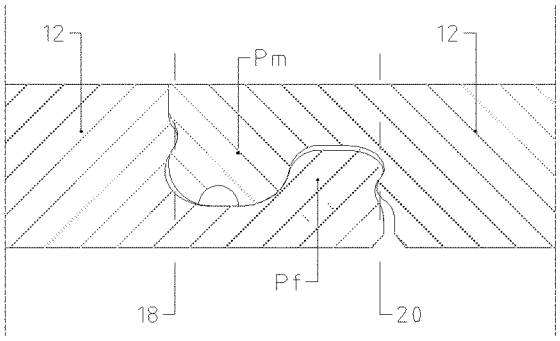
FIG. 13*b* illustrates the engagement of two panels incorporating the fifth embodiment of the vertical joint system.

FIGS. 13*a* and 13*b* depict a further embodiment of the joint system 10*d* applied to a substrate 12. The substantive differences between the joint system 10*d* and 10 lies in the depth and relative disposition of the intermediate inflexion surfaces Im3 and If3; and the width of the protrusions P and recesses R. In the joint system 10*d*, the inflexion surfaces Im3 and If3 are shallower and are inclined more towards the horizontal i.e. toward a plane containing major surfaces 14 and 16. As a consequence, when the male and female joints Jm and Jf are engaged only inner and outer locking planes 18 and 20 are created; the third locking plane 74 which arises with the earlier embodiments of the joint system being absent. In the joint system 10*d*, there is no point on the inflexion surface Im3 which is vertically below and laterally inside of a point on the inflexion surface If3. Also the protrusions P and recesses R are broader in the joint system 10*d*. This provides greater horizontal shear strength along shear planes S1 and S2 which pass through the protrusions Pm and Pf parallel to the major surfaces 14 and 16. This is beneficial with panels of smaller thickness (e.g. say 7 mm-3 mm) which are otherwise susceptible to shearing along planes S1 and S2. Notwithstanding this, the joint system 10*d* operates in substantially the same manner as the joint systems 10-10*c* in that it is a vertical system and adjoining substrates 12 can to rotate by 3 degrees relative to each other without disengagement.

Figure 14A:
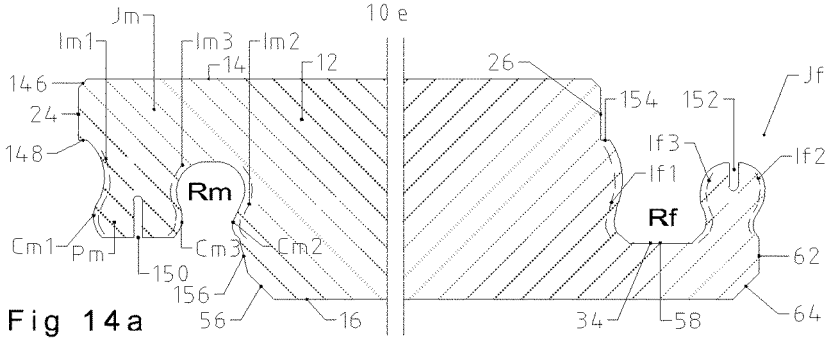
FIG. 14*a* depicts a panel incorporating a sixth embodiment of the vertical joint system.
Figure 14B:
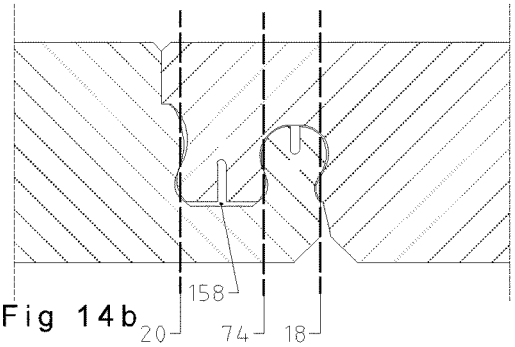
FIG. 14*b* illustrates the engagement of two panels incorporating the sixth embodiment of the vertical joint system.

FIGS. 14*a* and 14*b* illustrate a further embodiment of the joint system 10*e* applied to a substrate 12. The joint system 10*e* embodies the same basic concepts as the joint system 10 and in particular has extreme (or inner and outermost) locking, inflexion and transversely extending surfaces which form respective locking planes 18 and 20 and enable relative rotation between the male and female joints Jf and Jm of joined substrates 12. Also as with all of the embodiments the joint system 10*e* is a vertical system where joints are engaged by the application of a force or pressure in a direction perpendicular to the major surfaces 14 and 16. However as it is readily apparent from a comparison between the joint system 10*e* and the joint system 10 there are numerous differences in the specific configuration of the projections P and recesses R on the male or female joints Jf and Jr.

Starting with the male joint Jm, in the system 10*e*, there is a bevelled surface 146 between the major surface 14 and the side surface 24. In addition, between the side surface 24 and the inflexion Im1 the joint system 10*e* comprises a right angle rebate 148. The protrusion Pm is more symmetrical than in joint system 10 and is provided with a central slot 150 which extends in a direction perpendicular to the major surfaces 14 and 16. Additionally surface 40 of the protrusion Pm is flat rather than arcuate. The slot 150 provides the protrusion Pm with a degree of resilience. This resilience is not in order to effect engagement of the protrusion Pm with recess Rf but rather provides resilience to assist in the rotation of the protrusion Pm within the recess Rf.

The protrusion Pf is more rounded than the corresponding protrusion Pf in system 10 and is also provided with a central slot 152 which extends parallel to the slot 150. Slot 152 also provides resilience to the protrusion Pf to assist in its rotation within the socket Rm. Surface 58 at the root 34 of recess Rf is flat and lies parallel with the major surfaces 14 and 16 and also parallel with the surface 40. A square shoulder 154 is formed between the inflexion surface If1 and side surface 26 on the female joint Jf. Shoulder 154 engages the rebate 148 when the joints Jf and Jm are engaged as shown in FIG. 14*b*. A further difference in the configuration of joint system 10*e* is the provision of an inclined surface 156 between the inflexion surface Im2 and the bevelled surface 56 at the joint Jm.

It will be seen from FIG. 14*b* that the joint system 10*e* has three vertical locking planes 18, 20 and 74 as in the joint system 10. A space 158 is created between the surfaces 40 and 58 when the male joint Jm is engaged with a female joint Jf. This space may be used in the same manner as the void 44 shown in FIG. 1*b* for the collection of debris.

Figure 15A:
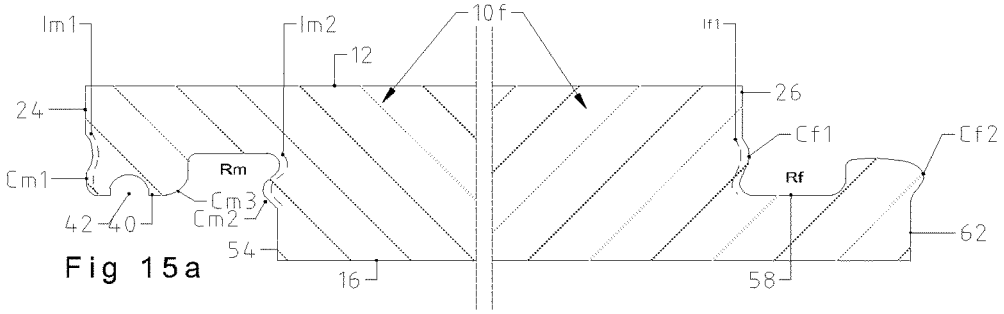
FIG. 15*a* depicts a panel incorporating a seventh embodiment of the vertical joint system.
Figure 15B:
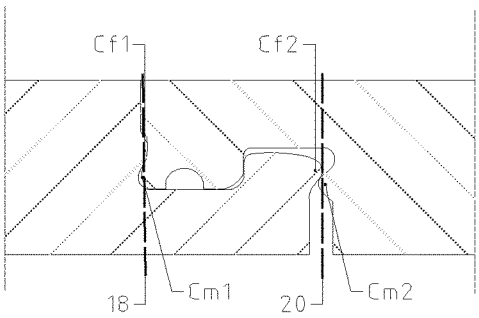
FIG. 15*b* illustrates the engagement of two panels incorporating the seventh embodiment of the vertical joint system.

FIGS. 15*a* and 15*b* depict a further embodiment of a joint system 10*f* incorporated on a substrate 12. In the joint system 10*f*, the male and female joints Jm and Jf are shallower and squarer than that in the system 10. Male joint Jm comprises an inflexion surface If1 and corresponding surface Cm1 on an outermost surface and an inflexion surface Im2 and corresponding surface Cm2 on an innermost surface. There is also an intermediate surface Cm3 but no intermediate inflexion surface Im3. The female joint Jf is formed with: surfaces Cf1 and Cf2 on inner and outermost surfaces of the joint respectively; and, an inflexion surfaces If2. However, the joint system 10*f* does not include an intermediate inflexion surface If3 nor an inflexion surface If2 on the outermost surface of the female joint.

Projections P and recesses R in the joint system 10*f* are squatter than those in the joint system 10. This provides improved shear strength as in the joint system 10*d*. When substrates 12 incorporated in the joint system 10*f* are engaged with each other two locking planes 18 and 20 are created by the surface Cf1 and Cm1; and Cf2 and Cm2 respectively. A "quasi" intermediate locking plane is formed by the provision of planar surfaces 25 and 27 on protrusions Pm and Pf respectively. The surfaces 25 and 27 are perpendicular to the major surface 14. When the joints Jm and Jf are engaged the surfaces 25 and 27 abut each other. This provides frictional locking against relative motion between the joints Jm and Jf in the vertical plane. This provides an effect similar to but to less degree than the locking plane 74 in the joint system 10*f*. Vertical arrestment between the joined substrates 12 is created by the abutment of the surface 40 of projection Pm with the surface 58 in the recess Rf.

A further difference in the configuration between the joint systems 10*f* and 10 is the omission in the joint system 10*f* of bevelled surfaces 56 and 64 which lead from the surfaces 50 and 62 respectively to the major surface 16. Thus, in the joint system 10*f*, the surfaces 54 and 66 extend directly from the respective surfaces Cm2 and Cf2 to the major surface 16.

Figure 16A:
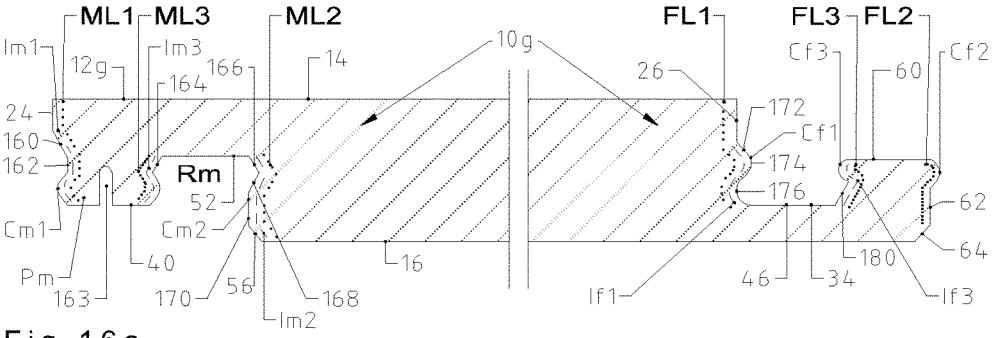
FIG. 16*a* depicts a panel incorporating a eighth embodiment of the vertical joint system.
Figure 16B:
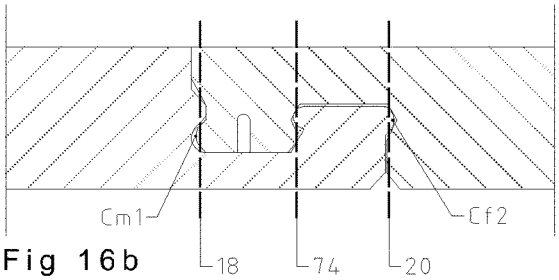
FIG. 16*b* illustrates the engagement of two panels incorporating the eighth embodiment of the vertical joint system.

FIGS. 16*a* and 16*b* depict a further joint system 10*g* which is suited to panels made of plastics materials such a vinyl or other relatively soft/flexible materials. In the joint system 10*g* various inflexion surfaces or transversely extending surfaces are formed comprising one or more planar surfaces. However, on each of the extreme locking planes 18 and 20, there remains at least one arcuate transversely outward extending surface to facilitate a rolling motion enabling rotation between the joint panels 12. More specifically it can be seen that the projection Pm in the joint system 10*f* comprises a first locking surface ML1 and having abutment surface 24 and contiguous inflexion surface Im1. The inflexion surface Im1 includes a planar and inwardly sloping surface 160 depending from the surface 24, and an additional planar surface 162 which extends parallel to the surface 24 and is contiguous with the surface 160. Thereafter, the inflexion surface Im1 incorporates an arcuate or a smoothly curved surface Cm1. The surface Cm1 leads to a planar bottom surface 40 of the projection Pm which lies in a plane parallel to the major surfaces 14 and 16. The surface 40 is contiguous with an intermediate and smoothly curved surface Cm3. However the concave recess 42 of earlier embodiments has been replaced with a slot 163 which lies perpendicular to the major surface 14. The slot 163 provides the projection Pm with an increased ability to compress within recess Rm to facilitate rotation during within the recess Rm.

Extending from the surface Cm3 is an inclined planar surface 164 which leads to a planar surface 52 of the recess Rm. The surface 52 lies parallel to the major surfaces 14. The planar surface 164 and the surface Cm3 together form intermediate inflexion surface Im3 and third male locking surface ML3. This is provided with a sharp corner where the surface 164 meets the surface Cm3. The innermost surface ML2 of the male joint Jm includes an angular inflexion surface Im2 and planar surface 56. The inflexion surface Im2 comprises contiguous planar surfaces 166 and 168 which are inclined relative to each other to form a generally concave but angular or sharp corner in the recess Rm. The inflexion surface Im2 further comprises another planar surface 170 which extends perpendicular to the major surfaces 14 and 16. This surface then joins bevelled surface 56 leading to the major surface 16.

The female joint Jf has first female locking surface FL1 comprising abutment surface 26 which extends perpendicular to major surface 14 and contiguous inflexion surface If1. Inflexion surface If1 is composed of planar surface 172 which slopes toward the recess Rf, planar surface 174 which is parallel to surface 26 and a smoothly curved concave surface 176 which leads to the surface 58 at the root of recess Rf. The surfaces 172, 174 and upper portion of surface 176 together form a transversely extending surface in the form of a generally convex cam Cf1. Surface 58 at the root 34 of recess Rf is planar and parallel to the major surface 14. Thereafter, the female joint Jf comprises an intermediate surface If3 which may be considered to be in inverted form of the inflexion surface Im3. To this end the inflexion surface If3 comprises a planar surface 180 which is inclined in a direction toward major surface 14, and a contiguous smoothly curved surface Cf3. The surface Cf3 joins with a planar surface 60 parallel to the major surface 14. The outermost side of the female joint Jf in system 10*f* is formed with a second female locking surface FL2 having smoothly curved surface Cf2 which leads to a planar surface 62 and subsequently to inwardly bevelled surface 64 leading to the major surface 16.

The joints Jm and Jf are engaged by application of a force or pressure in a direction perpendicular to the major surfaces 14 and 16. As is evident from FIG. 16*d*, that joint system 10*f* results in the provision of three locking planes 18, 20 and 74 as a result of the relative juxtaposition of the surfaces Cf1 and Cm1; Cm1 and Cm2; and Cm3 and Cf3. Further, in the engaged joint, the surfaces Cm1 and Cm3 reside in the angular corners of the recess Rf while smoothly curved surfaces Cf2 and Cf3 reside in the angular corners formed in the recess Rm. In this embodiment it will be noted that there remains on each of the inner and outermost locking planes, an arcuate or smoothly curved surfaces C. Specifically, on locking plane 18, the smoothly curved surface Cm1 is able to roll against the surface of the joint Jf while on the locking plane 20, the arcuate surface Cf2 is able to roll on the surface of the male joint Jm. Also due to the non-symmetrical configuration of the joints Jm and Jf voids or spaces are created between the engaged surface to further assist in the relative rotation between joints and allow for expansion.

Figure 17A:
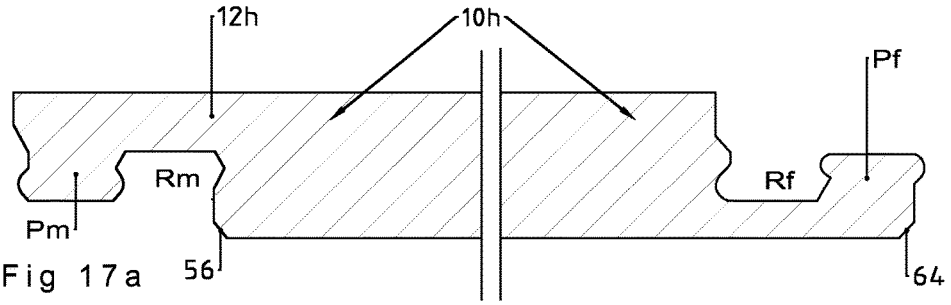
FIG. 17*a* depicts a panel incorporating a ninth embodiment of the vertical joint system.
Figure 17B:
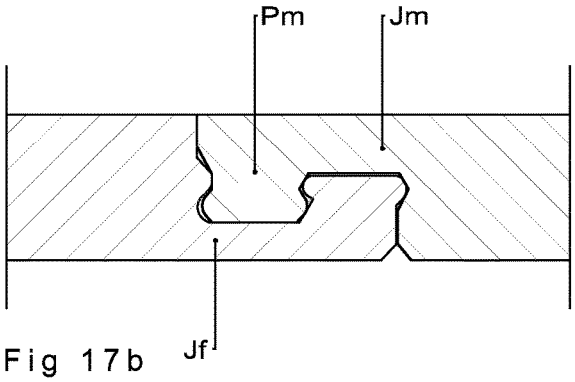
FIG. 17*b* illustrates the engagement of two panels incorporating the ninth embodiment of the vertical joint system.

FIGS. 17*a* and 17*b* depict a further joint system 10*h* which is based on and very similar to the joint system 10*f*. In particular, the system 10*h* is of the same general shape and configuration of the system 10*g* with the substantive differences being the omission of the slot 163 and a reduced length in the bevelled surfaces 56 and 64. This reduced length is a function of the thickness of the substrate 12*h* which is less than that of the substrate 12*g*. In a non-limiting example, the substrate 12*g* incorporating the joint system 10*g* may have a thickness in the order of 5.2 mm, while the substrate 12*h* incorporating the joint system 10*h* may have a thickness in the order of 3.5 mm.

In all other respects, the joint system 10*h* is the same in configuration and function as the joint system 10*g*.

Figure 17C:
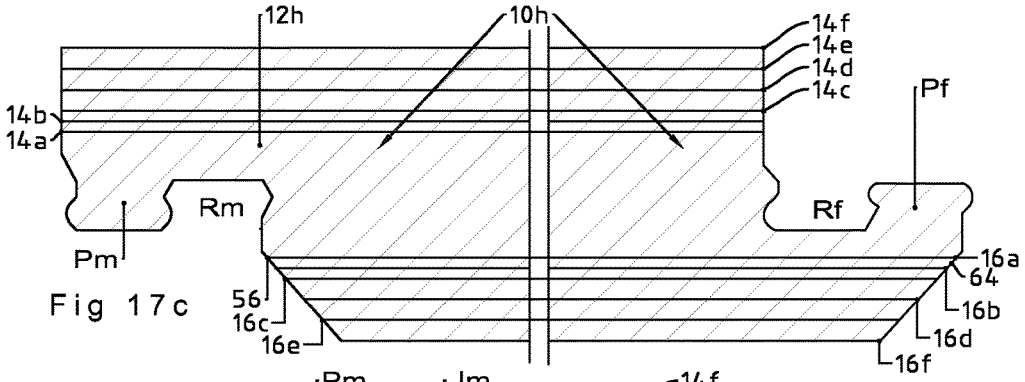
FIG. 17*c* schematically illustrates panels of different thickness incorporating the ninth embodiment of the vertical joint system.
Figure 17D:
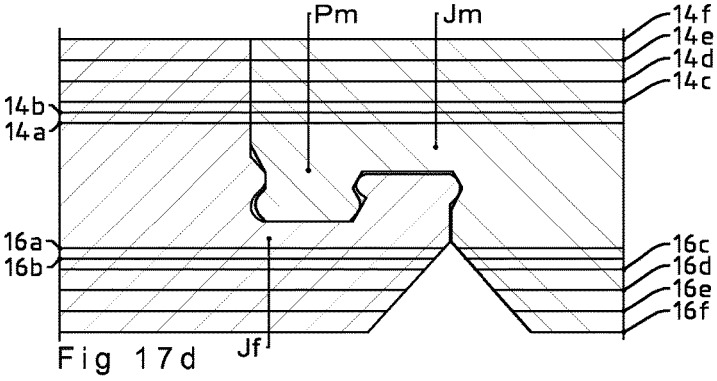
FIG. 17*d* illustrates the engagement of two panels shown in FIG. 17*c;*
Figure 17E:
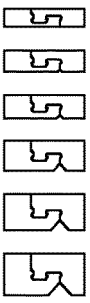
FIG. 17*e* provides a series of representations of illustrating the engagement of separate pair of panels of varying thickness the incorporating the ninth embodiment of the vertical joint system

FIGS. 17*c* to 17*e* illustrate a further feature of embodiments of the joint system relating to the ability to manufacture the system and panels of varying thickness using a single set of tools. FIGS. 17*a* and 17*b* illustrate the joint system 10*h* formed in panels 12 of a nominal thickness of say 3 mm. In FIGS. 17*c* and 17*d* the nominal thickness of 3 mm is marked as the innermost horizontal lines 14*a* and 16*a*. These lines indicate the major surfaces 14 and 16 of a panel 12. The next adjacent pair of lines 14*b* and 16*b* illustrates the major surfaces of the panel 12 if it were made to a thickness of 3.5 mm. Continuing in an outward direction line pairs 14*c* and 16*c*; 14*d* and 16*d*; 14*e* and 16*e*; and 14*f* and 16*f*; illustrate the major surfaces 14 and 16 for panels 12 made to thicknesses of 4 mm, 5 mm, 6 mm and 7 mm respectively. FIG. 17*e* provides perspective for panels 12 made to these different thicknesses. As explained in greater detail hereinafter the ability to manufacture joint systems on panels of varying thickness with a single set of cutting tools provides benefits over the prior art. A further feature of this is that notwithstanding the variation in thickness of the panels 12 it will be seen that the physical size of the joints Jm and Jf and the interlocking surfaces remains constant. Thus the strength of the engagement between panels is not compromised by a variation in the thickness of the panels.

Figure 18A:
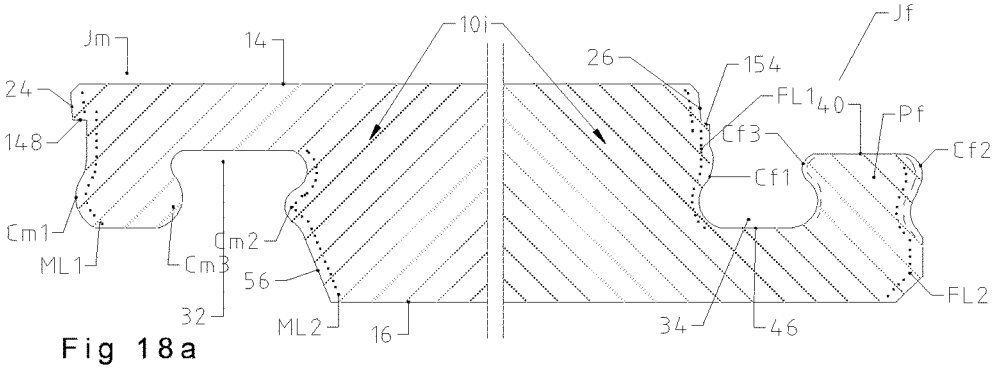
FIG. 18*a* depicts a panel incorporating a tenth embodiment of the vertical joint system.
Figure 18B:
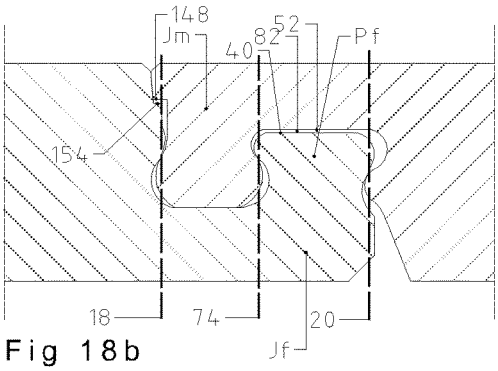
FIG. 18*b* illustrates the engagement of two panels incorporating the tenth embodiment of the vertical joint system.

FIGS. 18*a* and 18*b* depict a further embodiment of the joint system 10*i*. The joint system 10*i* may be viewed as a hybrid combining various features of earlier described joint systems. Both the male and female joints Jf and Jm comprise ball or bulbous like protrusions P, and recesses R having smoothly or continuously curved surfaces. The respective surfaces C of the male and female joints Jf and Jm are arranged to provide three locking planes 18, 20 and 74 when mutually engaged as depicted in FIG. 18*b*. The male and female joints comprise complimentary planar stepped surfaces 148 and 154 which lie parallel to the major surface 14 similar to the joint system 10*e*. Indeed the joint system 10*i* may be viewed as a modification of the joint system 10*e* but with the following differences: broadening of the respective protrusions P and recesses R; a marginal inclining of the surfaces 24 and 26 from the perpendicular of major surface 14; a flattening of a portion of the inflexion surface If1 between an upper end of surface Cf1 and surface 154; and extension of the bevelled surface 56 so as to extend directly from the Cm2 to the major surface 16. It will be further noted from a comparison between FIGS. 18*b* and 14*b* that a space 82 now exists between the planar surfaces 40 and 52, and there is a space between the surfaces 154 and 148 in the engaged joints Jm and Jf. The joint system 10*i* operates in the same way as the previously described joint systems in terms of engagement and disengagement and the rolling action between the joints.

Figure 19A:
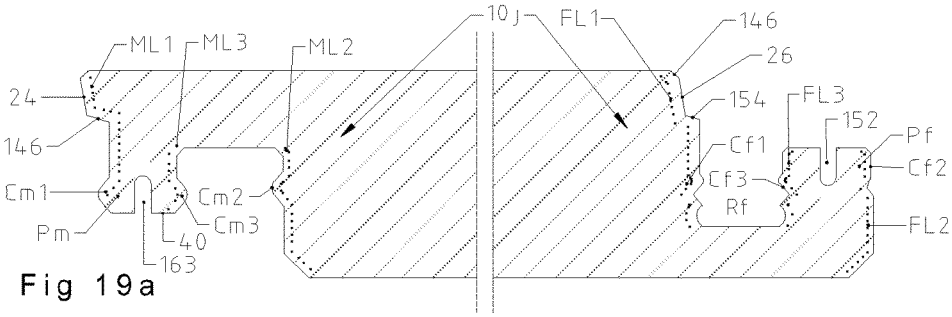
FIG. 19*a* depicts a panel incorporating a eleventh embodiment of the joint system.
Figure 19B:
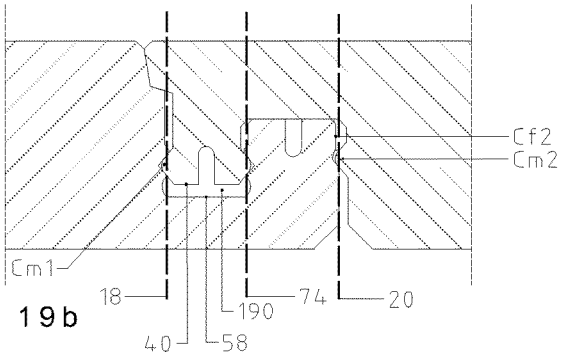
FIG. 19*b* illustrates the engagement of two panels incorporating the eleventh embodiment of the vertical joint system.

FIGS. 19*a* and 19*b* depict a further embodiment of the joint system 10*j*. The protrusions Pm and Pf are each provided with respective slots 163 and 152 similar to that of the joint system 10*e*. In the joint system 10*j* the surfaces Cm1, Cm2, Cm3, Cf1 and Cf3 are each smoothly curved. However the surface Cf2 on the female joint Jf is angular, being composed of a plurality of contiguous planar surfaces. Nevertheless, as shown in FIG. 19*b*, when the joints Jm and Jf are engaged the locking surfaces ML1 and FL1; ML2 and FL2; and ML3 and FL3 create three locking planes 18, 20 and 74 as herein before described. In each of the outermost locking planes 18 and 20, one of the two respective engaged surfaces is continuously curved. Specifically in locking planes 18 and 20 surfaces Cm1 and Cm2 are continuously curved. This maintains the ability of the joints to roll provided the positive and negative relative rotation and the ability to disengage and thus move and replace a damaged substrate in an identical manner as described in relation to the earlier embodiments. The joint system 10*j* further includes surfaces 146 and 154 similar to the subsystem 10*e* but in this instance these surfaces are inclined at an acute internal angle relative to the major surface 14. Further the projection Pm and recess Rf are relatively configured to form a relatively large void or space 190 between surfaces 40 and 58. The slots 152, 163 provide an internal suspension system enabling compression of the protrusions Pm and Pf to assist in the rolling motion.

Figure 20A:
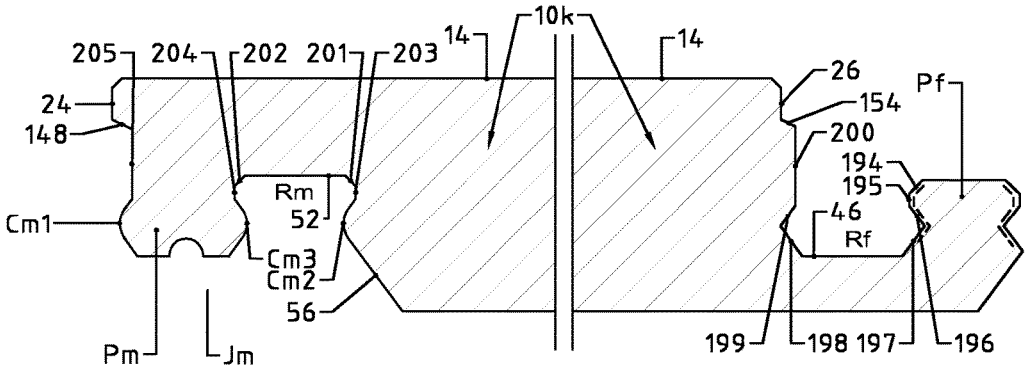
FIG. 20*a* depicts a panel incorporating a twelfth embodiment of the vertical joint system.
Figure 20B:
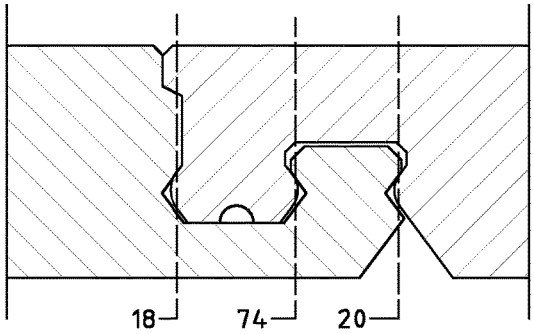
FIG. 20*b* illustrates the engagement of two panels incorporating the twelfth embodiment of the vertical joint system.

FIGS. 20*a* and 20*b* depict a further embodiment of the joint system 10*k*. The protrusion Pm is formed with continuously curved surfaces Cm1, Cm2 and Cm3. On the female side the protrusion Pf is formed with angular surfaces Cf2 and Cf3, surface Cf1 comprises contiguous planar surfaces 191, 192 and 193. Surface Cf3 comprises contiguous planar surfaces 194, 195 and 196. The surfaces 191 and 194 each lead to the surface 60 of protrusion Pf which lies parallel with major surface 14. Both surfaces 192 and 195 extend perpendicular to the major surface 14 while surfaces 193 and 196 are inclined toward each other surface 193 leads to an oppositely inclined surface 162 which in turn leads to bevelled surface 64 which is cut inwardly but substantially parallel to surface 193. The surface 64 leads to the major surface 16. The route 34 of the recess Rf is formed with planar surface 46 which lies parallel to major surface 14, and to oppositely and outwardly inclined surfaces 197 and 198. Surface 198 leads to an inwardly inclined surface 199 which in turn is formed contiguously with planar surface 200. Surface 200 lies perpendicular to the major surface 14 and joins with surface 154. The combination of surfaces 196 and 197; and surfaces 198 and 199 form respective concave recesses for seating the surfaces Cm1 and Cm3 as shown clearly in FIG. 20*b*.

Looking at the male joint Jm, it will be seen that opposite ends of the surface 52 in the recess Rm lead to contiguous outwardly inclined surfaces 201 and 202. Surface 201 then leads to a planar surface 203 which leads to the surface Cm2. On the opposite side the surface 202 is formed contiguously with a further planar surface 204 which then leads to the surface Cm3. Surfaces 203 and 204 lie perpendicular to the major surface 14. In combination the surfaces 201, 203 and part of the surfaces Cm2 form a concave recess for the surface Cf2. Similarly, the combination of the surfaces 202, 204 and part of the surface Cm3 forms a further concave recess for seating the surface Cf3.

The protrusion Pm is also formed with a planar surface 205 that lies perpendicular to the major surface 14 and extends between the surface Cm1 and the surface 148. When the joints Jm and Jf are engaged, the surfaces 205 and 204 are spaced apart while the respective surfaces 148 and 154; and 26 and 24 are in abutment.

Figure 21A:
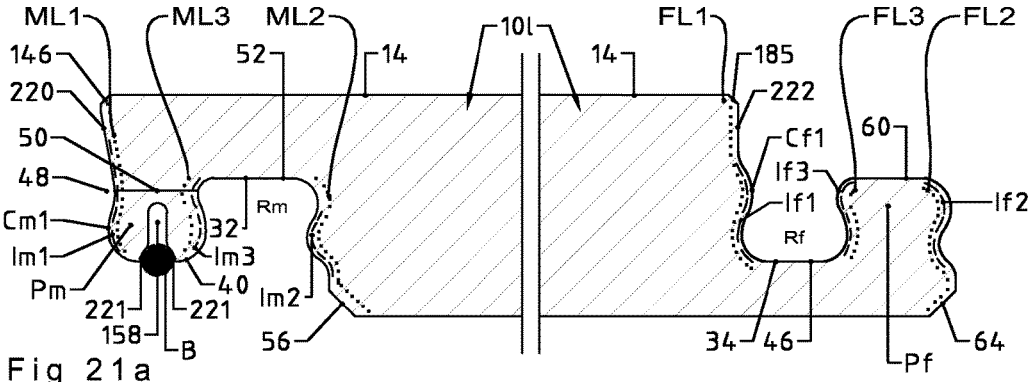
FIG. 21*a* depicts a panel incorporating a thirteenth embodiment of the vertical joint system.
Figure 21B:
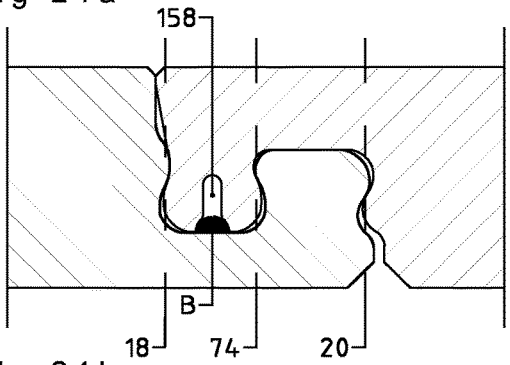
FIG. 21*b* illustrates the engagement of two panels incorporating the thirteenth embodiment of the vertical joint system.

FIGS. 21*a* and 21*b* depict a further embodiment of the joint system 10*l*. The protrusion Pm has a male locking surface ML1 which, starting from the major surface 14 is initially provided with a small bevelled surface 146 similar to that shown in the joints 10*e* and 10*i* and extends downwardly ending in a smoothly curved surface Cm1. The first male locking surface ML1 also comprises an inflexion surface Im1 which includes a planar portion 220 and extends from the bevelled surface 146 toward the surface Cm1.

Protrusion Pm also includes a slot 158 similar to that of the joint system 10*e*. The protrusion Pm is formed with a curved distal surface 40 and is of a generally symmetrical configuration about a centreline passing through the slot 158. To this end the line of shortest distance 50 across the neck 48 of the protrusion Pm lies on a plane parallel to the major surface 14. The slot 158 in the protrusion Pm is outwardly flared near the surface 40 so as to create in effect two prongs or a bifurcation with generally rounded or curved extremities 221.

The third inflexion surface Im3 and corresponding third male locking plane ML3 on a side of protrusion Pm opposite the inflexion surface IM1 is smoothly curved and leads to a planar surface 52 in the root 32 of recess Rm. The surface 52 lies parallel to the major surface 14. On an opposite side of the recess Rm the joint Jm is formed with a second male locking surface ML2 which comprises a smoothly curved inflexion surface IM2 which subsequently leads to bevelled surface 56.

The first female locking surface FL1 in the joint Jf comprises a short bevelled surface 155 commencing from the major surface 14 followed by a planar surface portion 222 which extends perpendicular to the major surface 14. Surface 222 leads to inflexion surface If1 which is smoothly curved and extends toward a root 34 of recess Rf. The root 34 is provided with a planar surface 46 that extends parallel to the major surface 14. The surface 46 in turn leads to third inflexion surface If3 which is smoothly curved and corresponds with the third female locking surface FL3. Distal surface 60 of female protrusion Pf extends between the second and third female locking surfaces FL2 and FL3 and lies in a plane parallel to major surface 14. The second female locking surface FL2 extends continuously toward the major surface 16 beyond the inflection surface IF2 in a smoothly curved manner and subsequently leads to bevelled surface 64.

It will be seen from FIG. 21*b* that each of the respective male and female locking surfaces and the corresponding inflexion surfaces engage about respective locking planes 18, 20 and 74.

In a further variation of the joint system 10*l* embodiment a bead B (shown in phantom line) of adhesive of the type described in detail shortly can be accommodated in the mouth of the slot 158. This provides additional vertical locking between engaged panels as well as cushioning.

Figure 22:
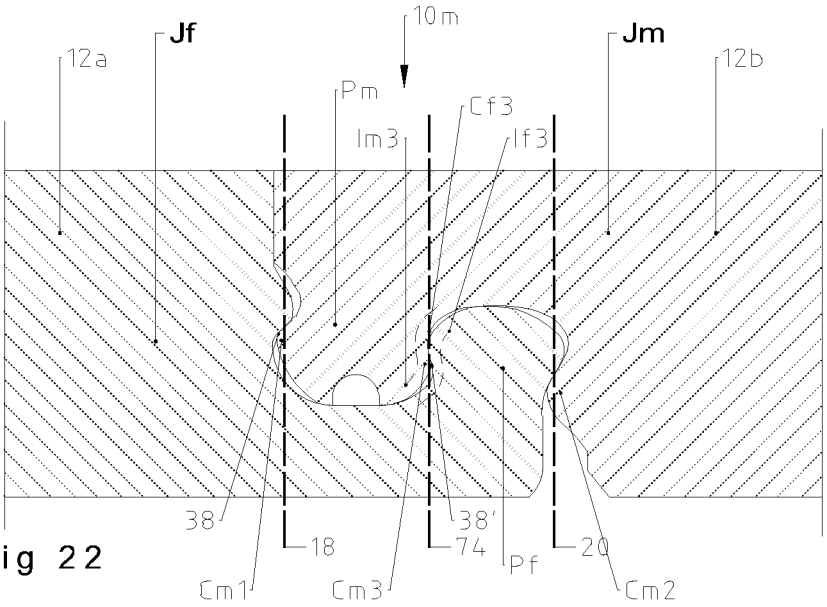
FIG. 22 illustrates the engagement of two panels incorporating a fifteenth embodiment of the vertical joint system.

FIG. 22 depicts a further embodiment of the joint system 10*m* with joints Jf and Jm depicted on separate but engaged panels 12*a* and 12*b*. The joint system 10*m* is similar to the joint system 10 depicted in FIGS. 1*a*-2 with the main differences residing in the configuration of the surfaces Cm3 and If3 on the male protrusion Pf. In the joint system 10*m* the surface Cf3 extends further in the transverse outward direction so as to hook under the surface Cf3 when the joints Jm and Jf are engaged. This provides greater resistance to vertical separation along the intermediate plane 74 in comparison to that of the joint system 10. Further, the surface Cf3 is provided with small ridge or peak 38' similar in configuration and effect to the peak 38 on the surface Cm1. Due to the configuration of the surface Cf3 there is an increased grab or pinching of the protrusion Pf between the surfaces Cm3 and Cm2 during the rotation of the joint Jm in a negative sense relative to the joint Jf. The joint Jm is particularly well, but not exclusively, suited for use with panels or substrates made of softer material.

Figure 23A:
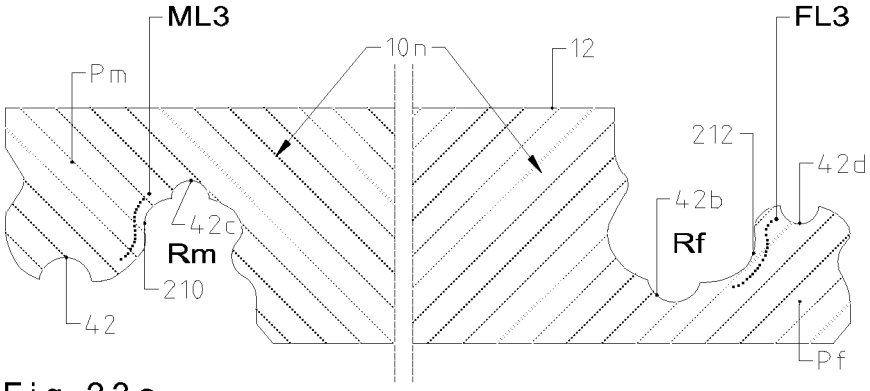
FIG. 23*a* depicts a panel incorporating a fourteenth embodiment of the vertical joint system.
Figure 23B:
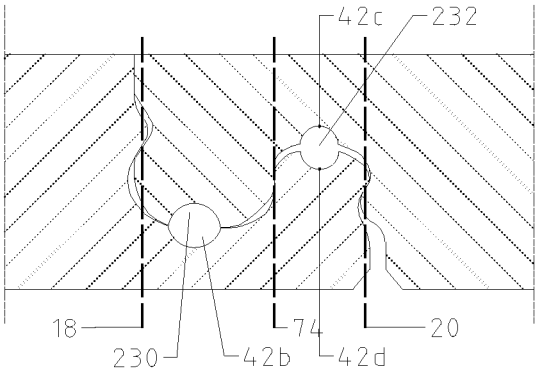
FIG. 23*b* illustrates the engagement of two panels incorporating the fourteenth embodiment of the vertical joint system.

FIGS. 23*a* and 23*b* depict a further embodiment of the joint system 10*n*. The joint system 10*m* differs from the joint system 10 depicted in FIGS. 1-3*b* by the provision of additional of three concave recesses, namely concave recesses 42*b*, which is formed in the root of the recess Rf; concave recess 42*c* which is formed in the root of the recess Rm; and concave recess 42*d* formed in the protrusion Pf. The recess 42*d* is located so that when joints Jm and Jf are engaged the recesses 42 and 42*b* face each other to form a substantially cylindrical or elliptical void 230. Similarly, the concave recesses 42*c* and 42*d* are located to face each other when the joints Jm and Jf are engaged to form a further substantially cylindrical void 232. The void 230 may be used as a dam or void to collect dirt and other debris generated during the laying of substrates 12 provided with the joint system Jm.

Alternately, one of the recesses 42 and 42*b* may be provided with a pre-laid re-stickable flexible adhesive and configured to extend into the other of the recess 42 and 42*b*. The expression "re-stickable adhesive" throughout the specification and claims is intended to mean adhesive which is capable of being able to be removed and re-adhered, does not set or cure to a solid rigid mass and maintains long term (e.g. many years) characteristics of flexibility, elasticity and stickiness. The characteristic of being re-stickable is intended to mean that the adhesive when applied to a second surface can be subsequently removed by application of a pulling or shearing force and can subsequently be reapplied (for example up to ten times) without substantive reduction in the strength of the subsequent adhesive bond. Thus the adhesive provides a removable or non-permanent fixing. The characteristics of flexibility and elasticity require that the adhesive does not solidify, harden or cure but rather maintains a degree of flexibility, resilience and elasticity. Such adhesives are generally known as fugitive or "booger" glues and pressure sensitive hot melt glues. Examples of commercially available adhesives which may be incorporated in embodiments of the present invention includes, but are not limited to: SCOTCH-WELD™ Low Melt Gummy Glue; and GLUE DOTS™ from Glue Dots International of Wisconsin.

It is noted that manufacturers of re-stickable glue/adhesive may advise that the adhesive is not suitable for particular materials for example wood. However when the joint system is incorporated in wooden or wood based panels this is does not preclude the use of such adhesives. This is because wooden or wood based panels are usually, and if not can be, coated with a polymer sealant or other coating. Thus provided the adhesive is recommended for use with polymer surfaces can be used on polymer coated wooded or wood based panels.

Alternately, both recesses 42 and 42*b* may be provided with the re-stickable adhesive so as to engage each other when the joints Jm and Jf are engaged.

In a similar manner, one or both of the concave recesses 42*c* and 42*d* may be provided with a bead of re-stickable adhesive of the type described hereinafter. When only one of the two recesses 42*c* and 42*d* is provided with the adhesive the adhesive is configured in a bead so as to extend into the other of the recesses 42*c* and 42*d*. However when both are provided with adhesive, the adhesive material while still in the form of a bead may be formed of a smaller thickness or depth.

Provision of the adhesive material has multiple effects. Firstly, it acts to assist in minimising the possibility of vertical or horizontal separation during the normal service life of the substrates 12. In addition the adhesive may act as a seal against moisture passing either from the major surfaces 14 through a joint to the major surface 16, or in a reverse direction in the event of moisture seeping up through a surface in which the substrates 12 are laid. The provision of the re-stickable adhesive however does not interfere with the ability to remove and replace one or more damaged substrates 12 due to the unique removal system described herein above. As the adhesive is re-stickable and in particular does not set or cure, the removal system remains effective for the removal of one or more panels 12 without damage to the joint of adjoining adjacent panels 12 which are not removed.

One further feature of the joint system 10*n* is that the locking surfaces ML3 and FL3 are each provided with planar surfaces 210 and 212 which lie parallel to the locking plane 74. There surfaces are pressed together when the joints Jm and Jf are engaged. Provided no wax is placed on these surfaces they will in effect provide a frictional intermediate locking plane 74. Such frictional intermediate locking planes can be incorporated in other of the above described In one embodiment as shown in FIGS. 23*c*-23*i* adhesive is applied to both of the recesses in the male joint Jm only and not in the female joint Jf. In such an embodiment, due to the nature of the re-stickable adhesive, when a substrate 12 is removed from adjacent adjoining substrates, the adhesive remains in the recesses 42 and 42*c* of the removed substrates. Moreover, the nature of the adhesive is such that it remains in the recess in which it is originally provided. This is depicted in FIGS. 23*c*-23*i* which progressively show the disengagement of joints Jm and Jf of the joint system 10*n*

Figure 23C:
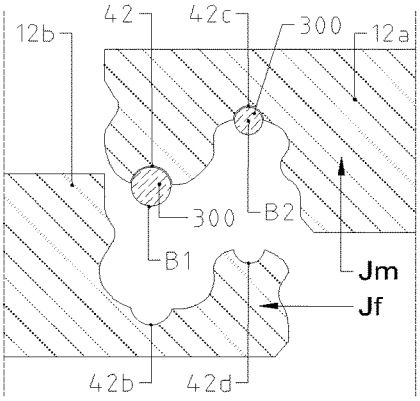
FIGS. 23*c*-23*i* depict in sequence the engagement and disengagement of the fourteenth embodiment of the vertical joint system when incorporating a re-stickable adhesive.

FIG. 23*c* shown joints Jm and Jf prior to engagement. Recesses 42 and 42*c* are each provided with respective beads B1 and B2 of re-stickable adhesive 300 covered with release strips R1 and R2. There is no adhesive in the recesses 42*b* and 42*d*.

Figure 23D:
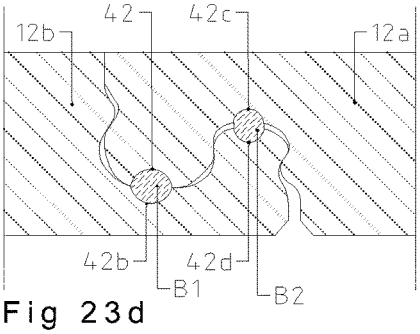
Figure 23G:
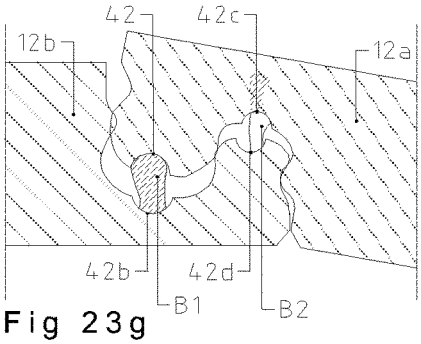
Figure 23E:
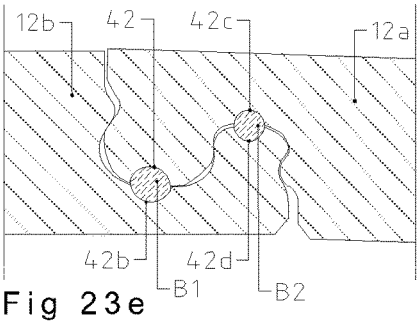
Figure 23H:
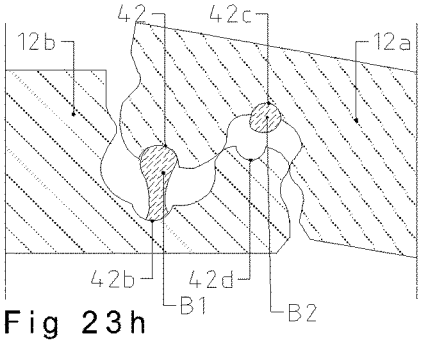
Figure 23F:
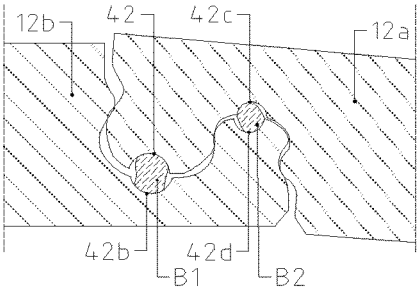
Figure 23I:
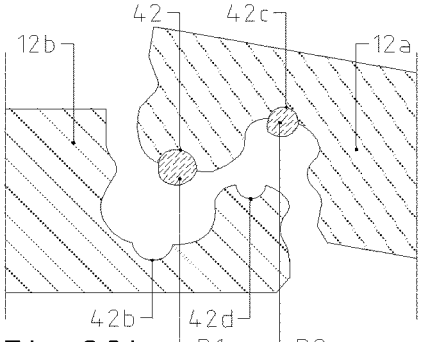
Figure 26A:
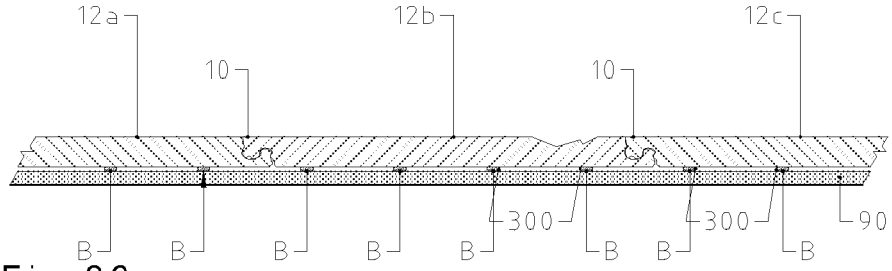
FIGS. 26*a*-26*e* depict in sequence the removal of a panel of the type shown in FIGS. 25*a* and 25*b* which is adhered to an underlying supporting.
Figure 26B:
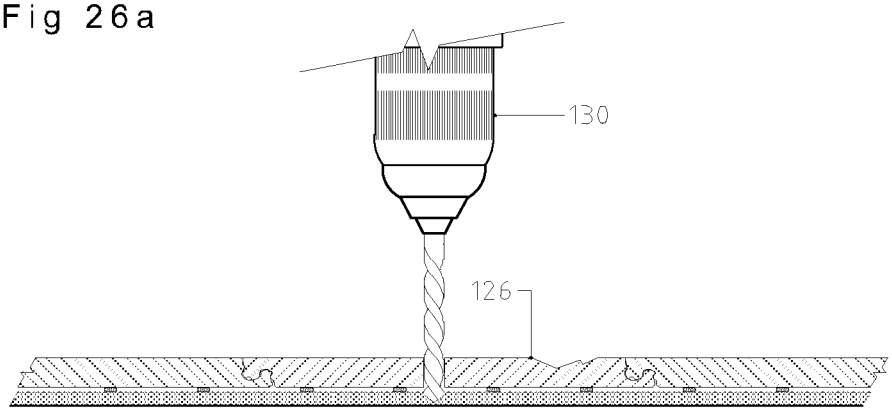
Figure 26C:
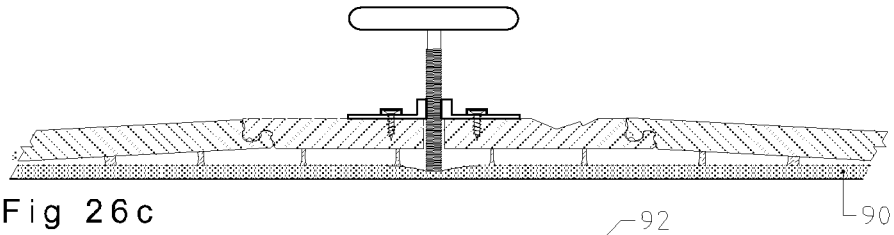
Figure 26D:
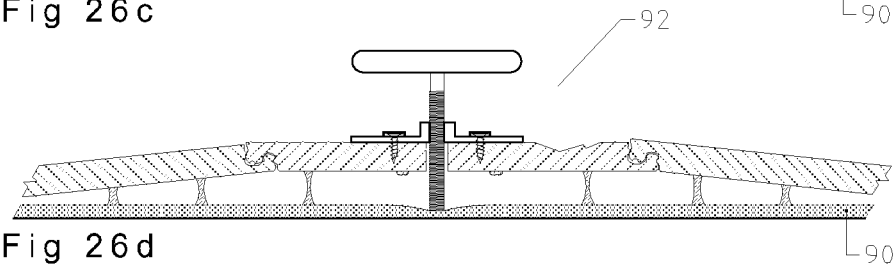
Figure 26E:
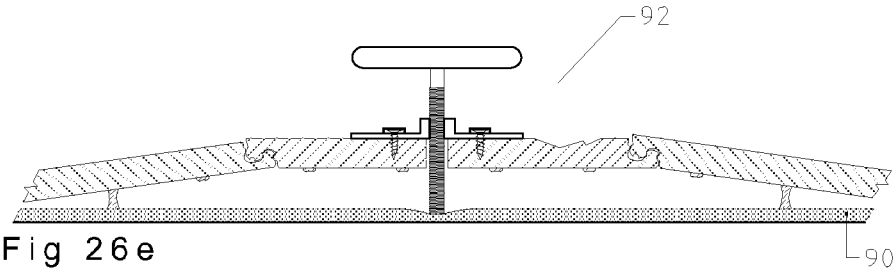

FIG. 23*d* shows the joints Jm and Jf fully engaged with the release strips R1 and R2 removed so that the re-stickable adhesive 300 in beads B1 and B2 adhere to the surface of the recesses 42*b* and 42*d*.

FIGS. 23*e*-23*i* show the typical disengagement process of joints Jm and Jf in embodiments of any joints system with initially the joint Jm being rotated in a negative (clockwise) direction relative to joint Jf to release protrusion Pm from recess Rf, and the subsequent application of downward pressure on the female joint Jf. The re-stickable adhesive is able to flex and move during the separation process to allow the rotation and subsequently is pulled from the recesses 42*b* and 42*d* to remain in recesses 42 and 42*c*.

The adhesive beads B bonded to a joint J may also act to absorb debris that lies in a recess into which the bead B is to be adhered. For example a bead B bonded in recess 42 can absorb debris in the recess 42*b* into which the bead B is adhered. The debris will initially adhere to the outside surface of the bead B. As the panels 12 move in normal use there will also be some movement and rolling of the bead B. It is believed that this will have the effect of drawing the debris into the adhesive so that the adhesive envelops the debris and provides a fresh adhesive surface to stick to the recess 42*b*.

One or more adhesive beads can be provided in each of the previously described embodiments to provide added vertical and horizontal locking strength while still allowing the full operation and benefits of the embodiments. This may be achieved for example by the provision of one or more recesses 42 in one of the joints Jm or Jf to seat a bead of the re-stickable adhesive. Depending on the thickness of the bead a receiving recess may or may not be required on the other joints Jm and Jf. The provision of the re-stickable adhesive can be seen as providing an additional locking plane to the joint system.

Typically, as in the above example, the adhesive is laid in only one of two mutually facing recesses 42. The bond when the adhesive is initially placed in that recess is stronger than the bond when that adhesive contacts a surface of the opposed recess in another substrate. Thus when a substrate is removed, the adhesive originally applied to that substrate remains with that substrate.

In all of the above described the embodiments of the joint system 10, it will be noted that the protrusions Pm and Pf are not of the same configuration, i.e. cannot be transposed over each other. Similarly the recesses Rm and Rf are not of the same configuration, i.e. cannot be transposed over each other. More particularly the respective engaging protrusions and recesses are not of a complementary configuration. Thus the protrusions Pm and Pf; the recesses Rm and Rf; and joints Jm and Jf are asymmetrical. As a consequence when a protrusion P is engaged in a recess R gaps or spaces are created between the male and female locking surfaces ML1, FL1 and ML2, FL2 at the inner and outer locking planes 18 and 20. This assists in providing the ability of embodiments of the joint system to roll or rotate in opposite directions by up to 3° by providing space into which the protrusion can roll without disengaging. In turn this aids in the ability of the joint system to be used easily and with success on undulating floors. This will be recognised by those in the art as filling a need particularly in the do it yourself market for flooring system which hitherto has endured systems that require high quality underlying surfaces for successful installation.

As a result of the specific configuration of the joint systems in accordance with embodiments of the present invention, and in particular as they are true vertical systems it is possible for manufacturers to manufacture panels with a wide range of thickness with a single set of cutting tools. For example for manufactured or natural wood substrates a single set of cutting tool can produce joint systems on panel ranging from 20 mm to 8 mm with the only adjustment required being a simple one of cutting depth. Similarly with plastics panels such LVT a single set of cutting tool can produce joint systems on panel ranging from 7 mm to 3 mm as shown and previously described with reference to FIGS. 17*c*-17*e*. This is of significant commercial benefit giving rise to reduced production costs which can be passed on to the consumer.

The range in cost for set of cutting tools for cutting a joint system is typically between US$30,000 to US$50,000. Usually a set of cutting tools used for prior art joints can be used for two different thicknesses. For example one set is used for joints on panels of thickness of 7 mm-6 mm; and a second set for thickness of 5 mm-4 mm. It also takes about 3 hours to replace a set of cutting tools then several additional hours to set up the cutting machine with the new set of tool. Subsequently several test runs are made and products evaluated to fine tune the tool and machine setting before full scale production can recommence. If the only adjustment required is to change the depth of cut then there is no cost for new cutting tools and the downtime is reduced to a total of about 1 hour. A further benefit of this is that relative small manufactures and able to afford to produce relative small production runs of at low coast and thus compete with larger manufactures. This may increase competition and thus in turn benefit the consumer.

With reference to FIGS. 24*a*-26*e* a semi floating/semi direct stick surface covering system may be provided by a plurality of substrates 12 incorporating any one of the joints systems 10 as hereinbefore described and further incorporating a quantity of the re-stickable adhesive 300 bonded to the first major surface 16. The re-stickable adhesive 300 is used in conjunction with a sealant or sealing membrane (not shown) which is applied to an underlying surface onto which the adhesive 300 is to be bonded. Many sealants are commercially available which may perform this function. Such sealants may include for example BONDCRETE™ or, CROMMELIN™ concrete sealer. The type of sealant used is simply dependent on the type of surface onto which the semi-floating surface covering system is to be used. The purpose is to prevent the generation of dust which may otherwise interfere with the bonding strength of the blue adhesive 300.

Others have in the past used glues to adhere substrates to floors. In particular adhesives have been used to glue wooden floor boards to an underlying surface. However to the best of the inventor's knowledge, all such systems use glues which are specifically designed to set or cure to a solid unyielding bonded layer. In the art of timber or wooden flooring, this is known as "direct stick" flooring. Some have proposed to utilize adhesives which take up to an hour or two to set or cure to enable installers to move the flooring panels during installation to ensure correct alignment. Indeed others propose using adhesives which may take up to 28 days to fully cure or harden.

Some consumers prefer direct stick flooring to floating flooring as it provides a harder more solid feel and significantly does not provide bounce when being walked on and does not generate noise such as creaking or squeaking. A disadvantage however of the direct stick flooring is that it is very messy to apply, and once the adhesive has cured, which it is specifically designed to do, removal and/or repair of one or more damaged panels is problematic. The removal of a direct stick panel generally requires the use of power tools to initially cut through a section of the panel, and then much hard labour in scraping the remainder of the plank and adhesive from the underlying subsurface. This generates substantial dust and noise and of course usually comes at substantial expense due to the associated time required.

Use of the re-stickable adhesive as described hereinabove with substrates 12 incorporating the joint system 10 provides a semi-floating surface covering system having the benefits of both traditional floating surface coverings and direct stick coverings but without the substantial disadvantages of direct stick surface coverings. Specifically, the use of the re-stickable adhesive 300 eliminates bounce and noise often found with conventional floating flooring, but still provides a degree of cushioning due to the flexible and elastic characteristics of the adhesive which does not set or cure. Further the characteristics of the adhesive also enable movement of substrates/panels 12 due to changes in environmental condition such as temperature and humidity. This is not possible with direct stick flooring. Indeed recently, the world market has been having problems with direct sticking of compressed bamboo substrates due to the completely rigid and inflexible bond created by the traditional adhesives. Accordingly, should the compressed bamboo need to move or expand due to variations in environmental conditions it is restricted from doing so by the direct stick adhesive. Consequently it has been suggested by multiple flooring associations around the world that compressed bamboo should not be direct stuck to substrates but limited to application in floating floor systems which enable it to move in response to dynamic seasonal changes.

The provision of the re-stickable adhesive also enables for the take up of undulations or variations in the underlying surface to which it is applied. This is facilitated by providing the adhesive 300 in beads or strips of a thickness measured perpendicular to the major surfaces 14, 16 of between 1-6 mm and more particularly 2-4 mm. In addition to taking up variations in the underlying surface, the adhesive as mentioned above also provides acoustic benefits in: (a) eliminating noise and squeak which may otherwise arise from the bounce or deflection in traditional floating floors; (b) dampening vibrations (i.e. noise) transmission between adjacent panels; and (c) dampening vibrations (i.e. noise) transmission in multi-story buildings from an upper level to an immediately adjacent lower level. This again is to be contrast with direct stick glues which due to their curing into a rigid bond, do not in any way dampen vibration or noise transmission.

The benefits and advantages of the use of re-stickable adhesive as herein before described in their own right give rise to a floor covering systems comprising substrates which may be tessellated and on which the adhesive is applied. Such systems do not necessarily require vertical joints systems of the type described hereinabove and may also be used with other types of joints systems. Indeed in certain circumstances, it is believed that the re-stickable adhesive concept gives rise to a surface covering system with jointless substrates. Thus in one embodiment there would be provided a semi-floating surface covering system which comprises a plurality of substrates each substrate having first and second opposite major surfaces, the first major surface arranged to lie parallel to and face a surface to be covered; a quantity of re-stickable adhesive as herein before described bonded to the first major surface; and one or more release strips covering the removal adhesive.

It is envisaged in one embodiment that the adhesive 300 will be applied at the time of manufacture of the substrate 12. Thus in this embodiment a commercial product would comprise for example boxes of substrates 12 provided with one or more lines of adhesive material 300 covered with release strips 302. Installers are then able to simply install a surface covering by applying, if it does not already exist, a sealing coat or membrane to the surface 304, removing the release strip 302 and pressing the substrate 12 onto an underlying surface 304. In the event that the substrate also includes a joint system such as, but not limited to, the joint systems 10 et al as described herein above, then the installer would engage joints of adjacent panels during the installation process In one example it is envisaged that the adhesive material 302 may be applied by rolling a strip or bead of hot melt pressure sensitive adhesive onto the major surface 16. FIGS. 24*a*-24*c* illustrate the adhesive 300 applied as strips of adhesive, while FIGS. 25*a* and 25*b* illustrate the adhesive 300 applied as beads B of adhesive. In embodiments where the re-stickable adhesive is provided by say GLUE DOTS™ adhesive dots, the dots can be applied by machine 16.

In the present embodiments the quantity of re-stickable adhesive 300 is applied in three spaced apart lines extending in a longitudinal direction L of a panel 12. However as will be explained in greater detail below, the adhesive material 300 may be applied in different configurations. The re-stickable adhesive material 300 is covered by one or more release strips 302. In the depicted embodiment a separate release strip 302 is applied individually to each individual line of adhesive material 300. However in an alternate embodiment, a single release strip having dimensions substantially the same as dimensions of the major surface 16 may be applied to the quantity of re-stickable adhesive 300. In that instance, when using the substrate 12, an installer need peel off only one release strip 302 rather than a number of separate release strips.

FIGS. 24*c* and 25*b* depict the use of the adhesive based surface covering systems on an underlying surface 304 which may, for example, be a concrete pad. In order to apply the panel 12 the release strips 302 are removed and the panel 12 is applied with surface 16 directed toward or facing the surface 304. By contacting the adhesive material 300 to the surface 304 and applying downward pressure, the panel 12 is adhered to the surface 304. Additional panel 12 can be likewise adhered to a surface 304 and tessellated to form a surface covering. The adhesive material 300 is sufficiently tacky and strong to adhere to the surface 304 with sufficient force to prevent lifting or separation between the panel 12 and surface 304 under normal use conditions. It is believed that providing the adhesive in the form of beads B (FIGS. 25*a* and 25*b*) may provide greater horizontal movement which typically occurs with changes in environmental conditions (e.g. temperature and humidity). This stems from the rounded nature of the beads B which may facilitate an easier rolling or shear rolling effect than the strips of adhesive.

Removal of a damaged panel (either with no joint system or with joint system of a type described herein above, i.e. a vertical joint system) can be performed in the same manner as described herein above in relation to FIGS. 6*a*-6*s*. That is, a damaged panel is removed vertically by use of one or more jacks 92. FIGS. 26*a*-26*e* depict in part the removal of a damaged panel 12*b* of a semi-floating surface covering system which includes adjoined panels 12*a* and 12*c*. Each of the panels in the semi-floating floor system is formed with a joint system 10 which may be in accordance with any one of the embodiments of the joint system described above. In addition beads B of adhesive material 300 adhere the panels 12 to the underlying surface 90. In this particular embodiment there are no beads of adhesive material in between the joints Jm and Jf of the joint system 10. However in alternate embodiments such adhesive material may be provided. In terms of the process for removal of the panel 12*b* the provision of additional adhesive between the joints Jm and Jf is of no consequence. That is, the removal process remains the same as irrespective of whether or not adhesive material exists between the joints Jm and Jf.

FIGS. 26*b*-26*e* show sequentially the steps of attaching a jack 92 to the damaged board 12*b* and subsequently operating the jack to lift the panel 12*b* from the surface 90. The sequence of steps and the method of their performance are identical to that described herein above in relation to FIGS. 6*d*-6*h*. However in this instance due to the provision of the beads B of adhesive 300 the operation of the jack 92 to vertically lift the panel 12*b* also has the effect of initially flexing and stretching the beads B and subsequently causing the beads B to detach and lift from the underlying surface 90. This will occur generally in sequence as a jack is operated to lift the panel 12*b* from a region in the vicinity of the jack 92 outwardly to lower lying regions. Thus the first beads B to detach form surface 90 will be those on either side of or otherwise closest to the shaft 96 of the jack 92. As the jack 92 progressively lifts the panel 12*b* the beads B of adhesive 300 nearest the most recently detached beads will now lift off the surface 90 and so on.

Generally, the entirety of the bead B will lift from the surface 90 and thus remain bonded to the substrate 12. In some instances, very small portions of the adhesive 300 may remain on the underlying surface 90. Once the jack 92 has been operated to the extent to lift the panel 12*b* so that all of the adhesive beads B have been detached, the remainder of the normal removal process as described in relation to FIGS. 6*g*-6*i*; and indeed the entirety of the replacement processes shown and described in relation to FIGS. 6*j*-6*o* is be employed to reinsert a fresh undamaged panel.

It will be noted that some of the beads B of adhesive 300 have separated from the adjacent panels 12*a* and 12*c*. During the reinstatement process, these beads which remain on the panels 12*a* and 12*c* will re-adhere to the underlying surface 90. In addition, of course when a fresh panel is joined to the panels 12*a* and 12*c*, the adhesive 300 on that fresh panel will now also adhesively bond to the surface 90.

As will be understood by those skilled in the art, this represents a huge advantage over direct stick flooring systems in terms of the ability to properly repair a damaged floor. The accepted industry standard for optimal repair of a damaged floor is to peel back all of the panels from the closest wall to the damaged panel or panels. With direct stick systems, this is such a difficult task, that generally repairers take shortcuts and simply attempt to remove and replace only the damaged panels. This makes it impossible to reconnect mechanical joints between panels. In the event of any dimensional variation in the panels either due to environmental expansion or contraction, or simply due to the inability to source dimensionally equivalent fresh panels, installation will generally also require the use of fillers to make good any gap between the existing panels and the newly instated panel.

A further feature of substrates incorporating having embodiments of the joint system 10 is the ability to reverse lay. Reverse laying has two meanings in the art. One meaning refers to the ability to lay form both sided of a panel. For example consider a first panel approximately midway between parallel walls in a room. The ability to reverse lay enables two installers (or two teams of installers) to lie in opposite directions away from the first panel. This naturally greatly reduces the installation time. This is used with direct stick panels and has the benefit of enabling run out to be amortised between opposing walls of a room to provide a superior visual appeal. Reverse laying with direct stick is possible because a layer can fix with glue a first panel in an optimum position in or near the middle of the room to minimise run out near the walls. Additional panels can be stuck down form opposite side of the first panel. This cannot be done with floating floors because a first panel placed in an optimum position is not fixed, it floats, and thus cannot be used as a base to lay in opposite directions.

The other meaning of reverse lay refers to the ability to engage panels 12 which extend perpendicular (or some orientation other than parallel) to each other. This enables for example the ability to lay in say a herring bone pattern.

Current prior art, even with direct stick, makes it reasonably difficult to reverse lay flooring because traditionally one must lay from the female joint away. This is because in the prior art lay down process the male joint is traditionally 50+% shorter than the female joint thus creating a less extreme angle needed or not needed to engage the male portion into the female portion into a locked horizontal plane. As the present joint system 10 is vertical, there is no lay down process. Rather the vertical nature of the joint system 10 makes it exceptionally easy to engage panels from either side, either placing a male joint on an exposed female joint, in order to lay in one direction, or sliding the female joint under a male joint of a previously laid panel in order to lay in the reverse direction.

Figures 27A, 27B:
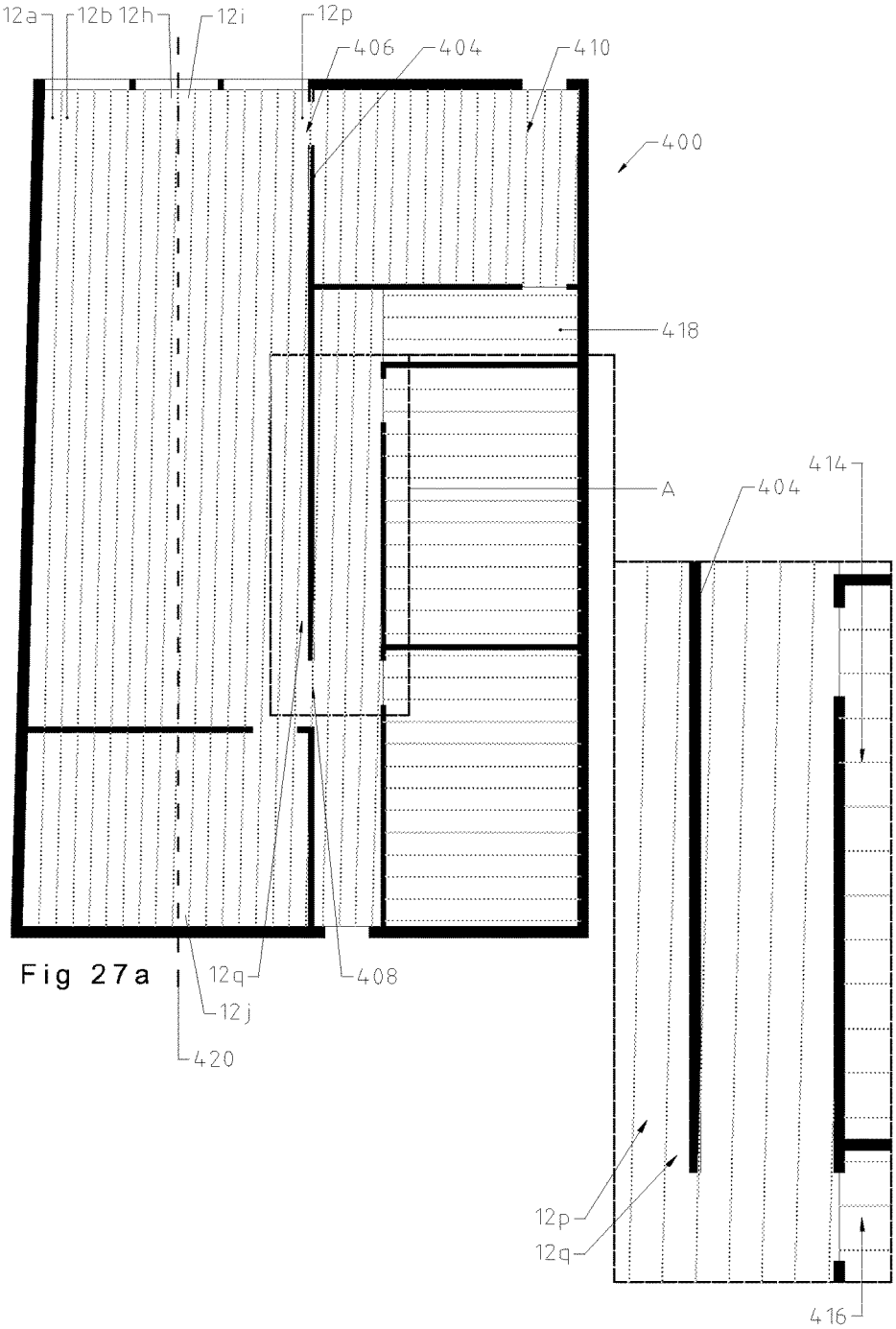
FIGS. 27*a* and 27*b* depict a method of laying a floor using jointed panels.

FIGS. 27*a* and 27*b* illustrate the above aspects or meaning of reverse laying pictorially. FIG. 27*a* shows a floor plan 400 of a building in which a floor comprising a plurality of panels 12 is laid. FIG. 27*b* illustrates in enlarged view detail A of FIG. 27*a* encompassing a portion of a passageway of the building. Consider the laying a traditional floating floor in the building. The layer would choose a wall for example wall 402 in a room 403 as a starting wall against which a first panel 12*a* is laid. It is well known that walls in buildings are never perfectly parallel or square to each other and may be out of alignment by up to 100 mm or more. In the current floor plan, wall 404 runs generally but not exactly parallel to a wall 402 and may be out of alignment by a length of say 100 mm between opposite ends of the walls 402 and 404. Thus as the layer lays additional panels 12*b*, 12*c*, etc. up to panel 12*p* the misalignment or divergence between the walls 404 and 402 becomes apparent as the edge of panel 12*p* does not abut the wall 404. Rather, there is a divergence between the edge of panel 12*p* and wall 404 requiring the provision of obliquely cut panels 12*q* laid end to end to make up the gap between the panels 12*p* and wall 404. (It should be explained that it would be unusual for a single panel to be of a length sufficient to extend for the full length of the room 403. Thus reference to panels 12*a*, 12*b* etc. is made solely for the purposes of ease of description. Ordinarily for example panels 12*a*, 12*b* etc. shown in room 403 would comprise a plurality of panels joined end to end.)

The substantial misalignment between the walls 402 and 404 is highlighted by the obliquely cut panel 12*q*. It will be also seen in FIG. 27*a* that there are openings 406 and 408 for example as doorways in wall 404 into room 410 and hallway 412. The panels laid in room 410 and 412 follow the same direction and alignment with the panels 12 in the room 403. This then continues on the degree of misalignment between the panels and the walls of the house.

It will also be seen however that in other areas for example rooms 414, 416, and hallway 418 the panels 12 are laid generally perpendicular to the panels laid in the other rooms. This is provided as an illustration of the second form or type of reverse laying.

With the use of the semi-floating semi-direct stick floor system as described above in relation to FIGS. 24*a*-25*b*, a layer can now utilise a centre line 420 of say room 401 as a starting point for the laying of the first panel and then reverse lay in opposite directions. By doing so the misalignment between the walls 402 and 404 from a visual perspective can be minimised by amortising the run out in the panels 12 immediately adjacent the walls 402 and 404. This can be seen by the center line 420 passing obliquely through the panels 12*i* and 12*j* which are shown in positions provided by traditional laying practice for floating floors.

Figure 28A:
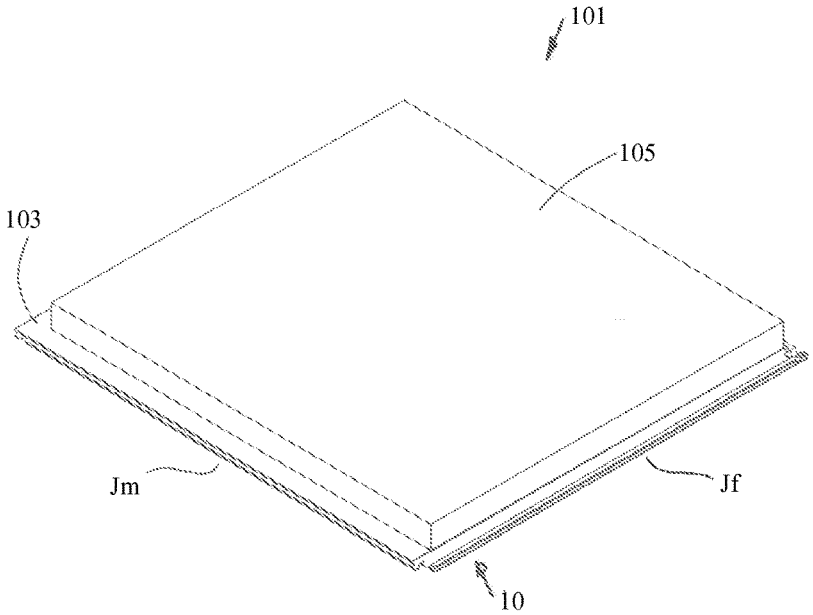
FIG. 28*a* is a perspective view of a panel for a ceramic tile surface covering system incorporating an embodiment of the vertical joint system.
Figure 28B:
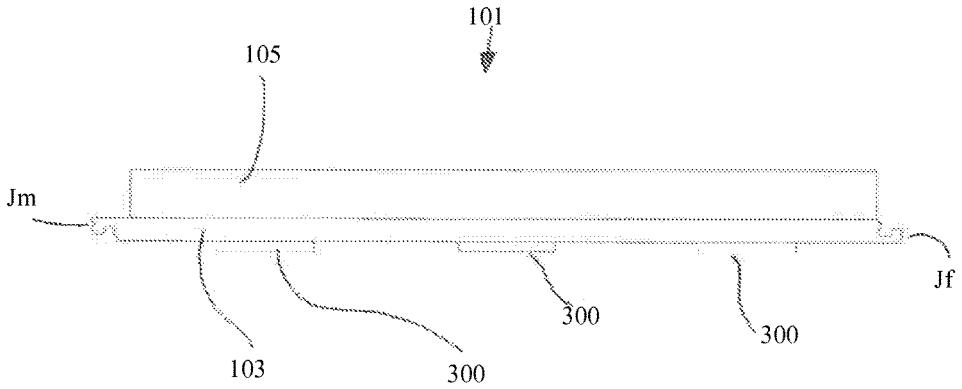
FIG. 28*b* is a side view of a panel shown in FIG. 28*a.*

Now that embodiments of the vertical joint system and surface covering system have been described in detail it will be apparent to those skilled in the art that numerous modifications and variations can be made without departing from the basic inventive concepts. For example embodiments are decided in relation to wooden flooring panels. However the systems are applicable to many different materials and may also be applied to surfaces or structures other than floors. For example panels incorporating the joint system may be made from plastics material to treat the LVT ("luxury vinyl tile") market or may be provided on base substrates made of plastics materials to which are attached face panels of other material such as carpet or ceramic tiles. In this embodiment the resultant panel has a laminate type structure where the base includes embodiments of the joint system and the face panel is provides a consumer with the desired finish. FIG. 28*a* shows an example of a panel 101 for a ceramic tile surface covering system incorporating embodiments of the vertical joint system 10. The panel 101 has a base substrate 103 made from a plastics material with an overlying attached ceramic tile 105. The base panel 101 is formed with an embodiment of the disclosed vertical joint system 10 having male and female joints Jm and Jf enabling the coupling together of a plurality of panels 101 to form the surface covering. In this embodiment the floor covering will have the appearance of a ceramic tile floor but is laid as if it were a floating floor using mutually engaging joints rather than tile adhesives which permanently fix the ceramic tile to an underlying substrate such as a concrete floor. However as in the previously described embodiments the panel 101 may also be provided with respective beads of re-stickable adhesive 300 as shown for example in the embodiments of FIGS. 24*a*-25*b* to form a semi-floating floor. It will also be apparent many of the features of different embodiments are interchangeable or can be additionally applied. For example the recess 42 can be applied to each and every embodiment of the joint system. As can: an opposing recess of the type shown as recess 42*b* in FIG. 22*a*; or indeed additional recesses 42*b*, 42*c* and 42*d*. Further the re-stickable adhesive 300 may be applied to such recesses. Also the jack 92 is described as a screw jack. However other types of jacks or lifting system can be used such as lever jack or pneumatic or hydraulic operated systems. Further the joint systems 10 are largely described in application to elongated rectangular panels. However they can be applied to panels of any shape that can tessellate. For example the joint system may be applied to square, hexagonal or triangular panels. Also there is no need for the panels to be of identical shape and/or size. All such modifications and variations together with others that would be obvious to persons of ordinary skill in the art are deemed to be within the scope of the present invention the nature of which is to be determined form the above description and the appended claims.

The invention claimed is:

1. A panel for a ceramic tile surface covering system comprising:

a substrate having: a plurality of sides; a planar upper surface extending between the sides; a lower surface opposite the upper surface and a vertical joint system extending along each side, the vertical joint system having a first joint that runs along a first one of the plurality of sides and a second joint that runs along a second one of the of the plurality of sides;

a ceramic tile attached to the upper surface of the substrate, the ceramic tile configured to lie within an area of the substrate bound by the vertical joint system:

wherein the vertical joint system is configured to enable every side of the panel to be engaged with a respective identical panel in response to a force applied in an engagement direction which is perpendicular to the upper surface and to enable engaged panels to be disengaged by lifting one of two or more engaged panels in a direction opposite the engagement direction; and wherein first and second joints are non-symmetrical joints, the first joint extending along the first side and a third side adjacent to the first sides and the second joint extending along the second side and a fourth side adjacent to the second sides, the first and second joints configured to enable two or more substrates with like joint systems to engage each other in response to a force applied in the engagement direction which is perpendicular to the upper surfaces and to enable engaged substrates to be disengaged by lifting a first substrate in a direction opposite the engagement direction to facilitate rotation of adjacent engaged substrates along opposite sides of the first substrate to lie in planes declined from the first substrate and subsequently applying a force in the engagement direction to the second joints of the engaged substrates, wherein the first and second joints are each provided with two laterally spaced transversely extending surface portions configured to enable the first joint of one substrate to engage the second joint of a second substrate with the two transversely extending surfaces of the first joint located relative to the two transversely extending surfaces of the second joint to form respective first and second locking planes on an innermost and an outermost side of each joint to inhibit separation of the engaged joints in a direction opposite the engagement direction, wherein the first joint extends in the engagement direction from an edge of the upper surface of the substrate toward the lower surface and wherein each of the transversely extending surfaces of the first joint lie inboard of the edge.

2. The panel according to claim 1 wherein the first joint has a recess that runs along the first side and is formed in the lower surface and the second joint has a recess that runs along the second side and is formed in the upper surface.

3. The panel according to claim 1 wherein the transversely extending surfaces are each provided as respective inflexion surfaces configured to enable the first joint of one substrate to engage the second joint of a second substrate with the two inflexion surfaces of the first joint engaging the two inflexion surfaces of the second joint on inner and outer most sides of each joint to form respective first and second locking planes each of which independently inhibit separation of the engaged joints in a direction parallel to the engagement direction each locking plane lying parallel to the engagement direction and wherein the inflexion surfaces associated with each locking plane lie on both sides of that locking plane.

4. The panel according to claim 1 wherein the first joint is a male joint and the second joint is a female joint, the male joint comprising a male protrusion extending generally perpendicular from the upper surface toward the lower surface and a male recess formed inboard of the male protrusion;

the female joint comprising a female protrusion extending generally perpendicular from the lower surface toward the upper surface and a female recess formed inboard of the female protrusion;

the male joint having a first male locking surface formed on a side of its male protrusion most distant from its male recess, a second male locking surface formed on a side of its male recess most distant from its male protrusion and a third male locking surface being a surface common to the male protrusion and male recess, wherein the first and second male locking surfaces comprise respective transversely extending surfaces of the first joint;

the female joint having a first female locking surface formed on a side of its female recess most distant from its male protrusion, a second female locking surface formed on a side of its female protrusion most distant from its female recess, and a third female locking surface being a surface common to the female protrusion and female recess, wherein the first and second female locking surfaces comprise respective transversely extending surfaces of the second joint; the locking surfaces being configured so that when a male and female joint of two substrates are engaged, the first male and first female locking surfaces engage to form a first locking plane, the second male and second female locking surfaces engage to form a second locking plane, and the third male and third female locking surfaces engage to form a third locking plane located between the first and second locking planes each locking plane inhibiting separation of the engaged joints in a direction parallel to the engagement direction.

5. The panel according to claim 4 wherein each protrusion has a distal end surface and each recess has a root surface, wherein when respective joints of two substrates are engaged the distal end surface of the protrusions face the root surface of the recesses, and wherein the distal end surface of at least one of the protrusions has a generally convex configuration.

6. The panel according to claim 5 wherein the distal end surface of each of the protrusions has a generally convex configuration.

7. The panel according to claim 5 wherein the distal end surface of each of the protrusions has smoothly curved corners.

8. The panel according to claim 1 wherein the vertical joint system is configured to form a third locking plane lying parallel to the engagement direction and located between the first and second locking planes.

9. The panel according to claim 1 wherein the vertical joint system is arranged so that when the vertical joint system of one panel is engaged with a vertical joint system joint of a second like panel by the application of the force in the engagement direction, the force causes a relative lateral motion of the joints toward each other.

10. The panel according to claim 1 wherein the transversely extending surfaces comprise curved cam surfaces.

11. A method of removing a first panel from a floor covering formed from a plurality of panels in accordance with claim 1 wherein the plurality of panels are joined together by the vertical joint systems being provided on each of the floor substrates, the first panel being joined on all sides with the other panels in the floor covering, the method comprising:

vertically lifting the first panel from the floor covering by applying a lifting force directly on the first panel in manner wherein the first panel initially lies parallel to the floor covering and remains substantially parallel to the floor covering during the vertical lifting to effect rotation of panels on each side of the first panel and a partial disengagement of the of panels on each side of the first panel.

12. The method according to claim 11 comprising applying a downward force on one of the panels engaged with a joint on one side of the first panel to fully disengage the one of the panels from the first panel.

13. The method according to claim 12 comprising attaching a lifting device to the first panel operable to lift the first panel vertically, the lifting device arranged to self-support the first panel when the first panel is vertically lifted.

14. A floating ceramic tile surface covering system comprising a plurality of panels according to claim 1.

15. The panel according to claim 1, wherein the substrate is made of a plastics material.

16. A panel for a ceramic tile surface covering system comprising:

a substrate made from a plastic material and having: a plurality of sides; a planar upper surface extending between the sides; a lower surface opposite the upper surface and a vertical joint system extending along each side;

a ceramic tile attached to the upper surface of the substrate, the ceramic tile configured to lie within an area of the substrate bound by the vertical joint system:

wherein the vertical joint system is configured to enable every side of the panel to be engaged with a respective identical panel in response to a force applied in an engagement direction which is perpendicular to the upper surface and to enable engaged panels to be disengaged by lifting a first substrate in a direction opposite the engagement direction to facilitate rotation of adjacent engaged substrates along opposite sides of the first substrate to lie in planes declined from the first substrate and subsequently applying a force in the engagement direction to the second joints of the engaged substrates.

17. A panel for a ceramic tile surface covering system comprising:

a substrate made from a plastic material and having: a plurality of sides; a planar upper surface extending between the sides; a lower surface opposite the upper surface and a vertical joint system extending along each side;

a ceramic tile attached to the upper surface of the substrate, the ceramic tile configured to lie within an area of the substrate bound by the vertical joint system wherein the vertical joint system comprises:

first and second non-symmetrical joints, the first joint extending along two adjacent sides of the substrate and the second joint extending along two further adjacent sides of the substrate, the first and second joints configured to enable two or more substrates with like joint systems to engage each other in response to a force applied in an engagement direction which is perpendicular to the major upper surfaces and to enable engaged substrates to be disengaged by lifting a first substrate in a direction opposite the engagement direction to facilitate rotation of adjacent engaged substrates along opposite sides of the first substrate to lie in planes declined from the first substrate and subsequently applying a force in the engagement direction to the second joints of the engaged substrates, wherein the first and second joints are each provided with two laterally spaced transversely extending surface portions configured to enable the first joint of one substrate to engage the second joint of a second substrate with the two transversely extending surfaces of the first joint located relative to the two transversely extending surfaces of the second joint to form respective first and second locking planes on an innermost and an outermost side of each joint to inhibit separation of the engaged joints in a direction opposite the engagement direction, wherein the first joint extends in the engagement direction of insertion from an edge of the first major upper surface of the substrate toward the second major lower surface and wherein each of the transversely extending surfaces of the first joint lie inboard of the edge.

* * * * *